United States Patent [19]

Takada et al.

[11] Patent Number: 4,828,969

[45] Date of Patent: May 9, 1989

[54] SILVER HALIDE PHOTOGRAPHIC LIGHT-SENSITIVE MATERIAL

[75] Inventors: Shun Takada; Kaoru Onodera, both of Odawara, Japan

[73] Assignee: Konishiroku Photo Industry Co., Ltd., Tokyo, Japan

[21] Appl. No.: 89,917.

[22] Filed: Aug. 24, 1987

Related U.S. Application Data

[63] Continuation of Ser. No. 858,182, Apr. 30, 1986, abandoned.

[30] Foreign Application Priority Data

May 1, 1985 [JP] Japan ..... 60-94375

[51] Int. Cl.[4] ..... G03C 1/46; G03C 1/16; G03C 1/12; G03C 7/38

[52] U.S. Cl. ..... 430/505; 430/558; 430/581; 430/583

[58] Field of Search ..... 430/558, 505, 583, 581

[56] References Cited

U.S. PATENT DOCUMENTS

| | | | |
|---|---|---|---|
| 3,480,434 | 11/1969 | Hanna | 430/581 |
| 3,725,067 | 4/1973 | Bailey et al. | 430/558 |
| 3,752,670 | 8/1973 | Needler et al. | 430/560 |
| 3,847,613 | 11/1974 | Sakazume et al. | 430/583 |
| 3,976,492 | 8/1976 | Hinata et al. | 430/505 |
| 4,469,785 | 9/1984 | Tanaka et al. | 430/572 |
| 4,585,732 | 4/1986 | Kawagishi et al. | 430/558 |
| 4,607,002 | 8/1986 | Nakayama et al. | 430/505 |
| 4,609,621 | 9/1986 | Sugimoto et al. | 430/567 |
| 4,695,533 | 9/1987 | Nakayama et al. | 430/558 |

FOREIGN PATENT DOCUMENTS

| | | | |
|---|---|---|---|
| 0115304 | 8/1984 | European Pat. Off. . | |
| 0170164 | 2/1986 | European Pat. Off. . | |
| 0178789 | 4/1986 | European Pat. Off. | 430/558 |
| 1810464 | 7/1969 | Fed. Rep. of Germany . | |
| 57-89754A | 6/1982 | Japan . | |

*Primary Examiner*—Paul R. Michl
*Assistant Examiner*—Lee C. Wright
*Attorney, Agent, or Firm*—Jordan B. Bierman

[57] ABSTRACT

A silver halide photographic light-sensitive material having, upon a substrate, a blue-sensitive silver halide emulsion layer, a green-sensitive emulsion layer and a red-sensitive emulsion layer. The silver halide grains contained in the blue-sensitive emulsion layer is optically sensitized for maximum spectral sensitivity in the wavelength region of 450 to 500 nm, and at least one emulsion layer other than the blue-sensitive layer contains a magenta coupler represented by the following formula, the substituents of which are defined within the Specification.

Formula [I]

Photographic materials thus formed have both an increased blue and green sensitivity.

18 Claims, No Drawings

SILVER HALIDE PHOTOGRAPHIC LIGHT-SENSITIVE MATERIAL

This application is a continuation of application Ser. No. 858,182, filed Apr. 30, 1986 now abandoned.

BACKGROUND OF THE INVENTION

The invention relates to a silver halide color photographic light-sensitive material, and further detailedly relates to a silver halide color photographic light-sensitive material excellent in color reproducibility.

The formation of a dye image with use of a silver halide color photographic light-sensitive material is made usually by that, when a color developing agent of aromatic primary amine type reduces silver halide grains in the exposed silver halide color photographic light-sensitive material, it is oxidized, and that then the oxidation product forms the dye by the reaction with a coupler preliminarily contained in the silver halide color photographic light-sensitive material. As coupler, 3 couplers which can form yellow, magenta and cyan dyes, respectively, are usually utilized because the color reproduction is carried out by a substractive process. However, any of actually utilized couplers is not ideal in view of its color reproducibility, and the spectral apsorptive properties of its color developing dye is largely different from the optimal ones, and especially the incorrect absorption of the dye leads to the decrease in reproduction of hue and saturation.

Among these couplers, for the purpose to form a magenta dye image, there are employed couplers of 5-pyrazolone, cyanoacetophenone, indazolone, pyrazolobenzimidazole, or pyrazolotriazole type.

Most of couplers conventionally utilized to form the magenta dye image have been those of 5-pyrazolone type. Whereas the dye image formed by such a coupler of 5-pyrazolone type has an advantage of light and heat fastness, in view of spectral absorptive properties it has shortcomings that the color tone is poor with an incorrect absorption having a yellow component at about 430 nm, and an unsharp foot on the longer wave side, causing color muddiness, and that the color developing dye image formed therefrom also is poor in sharpness.

These shortcomings are especially problematical for a directly observed color print which carries an image on its reflective support.

As couplers not accompanying such an incorrect absorption, couplers of pyrazolotriazole type are especially excellent which have been described in, for example, U.S. Pat. No. 3,725,067; Japanese Patent Examined Publication No. 99437/1984, 162548/1984, or 171956/1984; or Research Disclosure No. 24220, 24230, or 24531. Any of these couplers is effective in red and blue color reproduction by the substractive color reproducing process, because it has little incorrect absorption around 430 nm, and a sharp foot on the longer wave side.

Furthermore, the improvement of the color reproducibility is one of the most important technical subjects in a recent color light-sensitive material in which a high quality image is required, expecially in a printing color light-sensitive material which is printed from a color negative film. As for criteria of color reproduction in the photographic engineering, there are described, in detail, in "Fundamentals of Photographic Engineering. Silver Salt Photography", edited by Society of Photographic Science and Technology of Japan, p. 404–413, (Jan. 30, 1979). Especially in the case of the above printing color light-sensitive material, it is one of points how both the hue and the saturation of a chromatism are reproduced when an achromatism is reproduced as it is.

One the other hand, the recent age demands a high-sensitivity in a silver halide photographic light-sensitive material, from various viewpoints, and diverse technological studies on sensitization are in progress.

Concerning studies of sensitization improvement on silver halide grains, for example, a work on theoretical calculation of quanum efficiency of a silver halide under consideration of the effect of a grain size distribution is described in the preprint for the symposlum, Tokyo, 1980 on the progress in photography, "Interactions between Light and Materials for Photographic Applications", p. 91. This description suggests that the formation of a monodispersed emulsion is effective on the improvement of the quantum efficiency, or, of high sensitization. On the other hand, the optimal chemical sensitization of such silver halide emulsion also is under investigation to improve sensitization technology. As sensitizers used in chemical sensitization, there are conventionally well-known sulfur, selenium, reduction or noble metal sensitizers. Each of these chemical sensitizers is used either singly or in combination of two or more sensitizers. In addition, various methods have been studied to further raise the effect of such a chemical sensitization, including the method to chemically sensitize silver halide grains in the presence of a solvent for a silver halide (as disclosed in Japanese Patent O.P.I. Publication No. 30747/1983), or in the presence of a nitrogen-containing heterocyclic compound which forms a complex with silver (as described in Japanese Patent O.P.I. Publication No. 126526/1983).

Furthermore, it is also well-known to spectrally sensitize a silver halide emulsion by widening the range of the light-sensitive wave length inherent in the silver halide emulsion through adding a sensitizing dye. It is also known that appropriately selecting a sensitizing dye which is high in its efficiency of spectral sensitization remarkably contributes to elevation of sensitivity of the light-sensitive material.

As a sensitizing dye used for the above purpose, there is selected a sensitizing dye which is appropriate in its range of wave length of spectral sensitization, and exhibits neither diffusion to other light-sensitive layers nor interaction with other additives. Especially in case of making use of a sensitizing dye in a multilayered color photographic light-sensitive material, the one with both a further high sensitivity and an excellent color reproducibility is demanded.

Among spectally sensitizing methods as above-described, means to spectrally sensitize the range of blue color are described in, for example, U.S. Pat. Nos. 3,480,434 and 3,752,670; West german Patent OLS Application No. 2,303,204; and Japanese Patent Examined Publication No. 30023/1971, but a sensitizing dye is especially effective which can color sensitize a silver halide so that the maximum value of the spectral sensitivity by the color sensitization may come out to a range of wave length not less than 450 nm and less than 500 nm.

However in the conventional color reproduction when an image is printed from a printing multilayered color light-sensitive material using a blue-sensitive silver halide emulsion which was color sensitized as above-described and has a maximum value of spectral sensitivity in a range of wavelengths not less than 450 nm and less than 500 nm, the reproduction of green hue gets out of position toward cyan, resulting in a drawback of bluish green reproduction for green color, when the achromatism is reproduced as it is achromatic. Therefore, it has been demanded to develop a printing multilayered silver halide color photographic light-sensitive material which is high in its blue sensitivity and excellent in its green color reproducibility.

SUMMARY OF THE INVENTION

The first object of the invention is to provide a silver halide photographic light-sensitive material which has a high green sensitivity. The second object of the invention is to provide a silver halide photographic light-sensitive material which has especially an improved green color reproducibility.

After elaborate studies to achieve the above objects, the inventors have found that the above objects can be achieved by a silver halide photographic light-sensitive material which has, on its support, a blue-sensitive silver halide emulsion layer, a green-sensitive silver halide emulsion layer,n and a red-sensitive silver halide emulsion layer, and in which the blue-sensitive silver halide contained in the blue-sensitive silver halide emulsion layer has a maximum value of color sensitized spectral sensitivity in a range of wave lengths not less than 450 nm and less than 500 nm, and at least one silver halide emulsion layer other than the blue-sensitive silver halide emulsion layers contains a magenta coupler represented by the following general formula [1]:

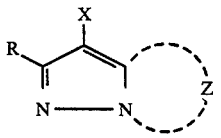

General formula [1]

wherein, Z represents a group of non-metallic atoms necessary to form a nitrogen-containing heterocyclic ring which may have a substituent, X represents a hydrogen atom, halogen atom or a monovalent group which is, upon a reaction with an oxydation product of a color developing agent, capable of being released from the coupler residue and R represents a hydrogen atom, a halogen atom or a monovalent group.

DETAILED DESCRIPTION OF THE INVENTION

The invention will now be described in detail.

In the magenta couplers relating to the invention represented by the above-given Formula [I],

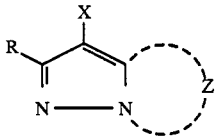

Formula [I]

wherein, Z represents a group of non-metallic atoms necessary to form a nitrogen-containing heterocyclic ring which may have a substituent, X represents a hydrogen atom, halogen atom or a monovalent group which is, upon a reaction with an oxydation product of a color developing agent, capable of being released from the coupler residue and R represents a hydrogen atom, a halogen atom or a monovalent group.

The substituents represented by the abovegiven R include, for example, a halogen, an alkyl group, a cycloalkyl group, an alkenyl group, a cycloalkenyl group, an alkynyl group, an aryl group, a heterocyclic group, an acyl group, a sulfonyl group, a sulfinyl group, a carbamoyl group, a sulfamoyl group, a cyano group, a spiro compound residual group, a cross linked hydrocarbon compound residual group, an alkoxy group, an aryloxy group, a heterocyclicoxy group, a siloxy group, an acyloxy group, a carbamoyloxy group, an amino group, an acylamino group, a sulfonamido group, an imido group, a ureido group, a sulfamoylamino group, an alkoxycarbonylamino group, an aryloxycarbonylamino group, an alkoycarbonyl group, an aryloxycarbonyl group, an alkylthio group, an arylthio group, and a heterocyclicthio group.

A halogen includes, for example, chlorine and bromine, and more preferably among them, chlorine.

The alkyl groups represented by R include, for example, those each having 1 to 32 carbon atoms and an alkenyl group; the alkynyl groups represented thereby include, for example, those each having 2 to 32 carbon atoms and a cycloalkyl group; and the cycloalkenyl groups represented thereby include, for example, those each having 3 to 12 carbon atoms and more preferably those each having 5 to 7 carbon atoms. The above-mentioned alkyl, alkenyl and alkynyl groups are allowed to be normal chained or branch chained.

The above-mentioned alkyl, alkenyl, alkynyl, cycloalkyl and cycloalkenyl groups are allowed to have such a substituent as an aryl group, a cyano group, a halogen, a heterocyclic group, a cycloalkyl group, a cycloalkenyl group, a spiro compound residual group and a cross linked hydrocarbon compound residual group. Besides the above, they are also allowed to have a substituent substituted through such a carbonyl group as that of acyl carboxy, carbamoyl, alkoxycarbonyl or aryloxycarbonyl. They are further allowed to have such a substituent substituted through a hetero atom as, typically, those substituted through oxygen such as that of hydroxy, alkoxy, aryloxy, heterocyclicoxy, siloxy, acyloxy, carbamoyloxy or the like; those substituted through nitrogen such as that of nitro, amino including, for example, dialkylamino and the like, sulfamoylamino, alkoxycarbonylamino, aryloxycarbonylamino, acylamino, sulfonamido, imido, ureido or the like; those substituted throguh sulfur such as that of alkylthio, aryltho, heterocyclicthio, sulfonyl, sulfinyl, sylfamoyl or the like; and those substituted through phosphorus such as that of phosphonyl or the like.

The above-mentioned substitutents typically include, for example, a methyl, ethyl, isopropyl, t-butyl, pentadecyl, heptadecyl, 1-hexylnonyl, 1,1'-dipentylnonyl, 2-chloro-t-butyl, trifluoromethyl, 1-ethoxytridecyl, 1-methoxyisopropyl, methanesulfonylethyl, 2,4-di-t-amylphenoxymethyl, anilino, 1-phenyl-isopropyl, 3-m-butanesulfonaminophenoxypropyl, 3-4'-{α-[4''(p-hydroxybenzenesulfonyl)phenoxy]dodecanoylamino} phenylpropyl, 3-{4'-[α-(2''-di-t-amylphenoxy)-butaneamido]phenyl}-propyl, 4-[α(o-chlorophenoxy)-tetradecaneamidophenoxy]propyl, aryl, cyclopentyl, or cyclohexyl group.

The aryl groups represented by R preferably include, for example, a phenyl group, and they are allowd to have such a substituent as an alkyl, alkoxy or acylamino group. They typically include, for example, a phenyl, 4-t-butylphenyl, 2,4-di-t-amylphenyl, 4-tetradecaneamidophenyl, hexadesiloxy phenyl, or 4'-[α-(4''-t-butylphenoxy)tetradecaneamido]phenyl group.

The heterocyclic groups represented by R preferably include, for example, the 5 to 7 membered ones. They are allowed to be substituted or condensed, and they typically include, for example, a 2-furyl, 2-thienyl, 2-pyrimidinyl, or 2-benzothiazolyl group.

The acyl groups represented by R include, for example, those of acetyl, phenylacetyl, dodecanoyl, alkylcarbonyl such as α-2,4-di-t-amylphenoxybutanoyl, benzoyl, 3-pentadecyloxy benzoyl, arylcarbonyl such as p-chlorobenzoyl, and the like.

The sulfonyl groups represented by R include, for example, an alkylsulfonyl group such as methylsulfonyl and dodecylsulfonyl groups, an arylsulfonyl group such as benzenesulfonyl and p-toluenesulfonyl groups.

The sulfinyl groups represented by R include, for example, an alkylsulfinyl group such as an ethylsulfinyl, octylsulfinyl or 3-phenoxybutylsulfinyl group; an arylsulfinyl group such as a phenylsulfinyl or m-pentadecylphenylsulfinyl group.

The phosphonyl groups represented by R include, for example, an alkylphosphonyl group such as butyloctylphosphonyl group, an alkoxyphosphonyl group such as octyloxyphosphonyl group, an aryloxyphosphonyl group such as phenoxyphosphonyl group, an arylphosphonyl group such as phenylphosphonyl group, and the like.

In the carbamoyl groups represented by R, the alkyl, aryl and more preferably phenyl groups thereof may be substituted. They include, for example, N-methylcaramoyl group, N,N-dibtylcrbamoyl group, N-(2-pentadecyloctylethyl)carbamoyl group, N-ethyl-N-dodecylcarbamoyl group, N-{3-(2,4-di-t-amylphenoxy)propyl}carbamoyl group, and the like.

In the sulfamoyl groups represented by R, the alkyl, aryl and more preferably phenyl groups may be substituted. They include, for example, N-propylsulfamoyl group, N,N-diethylsulfamoyl group, N-(2-pentadecyloxyethyl)sulfamoyl group, N-ethyl-N-dodecylsulfamoyl group, N-phenylsulfamoyl group, and the like.

The spiro compound residual groups represented by R include, for example, spiro[3.3]heptane-1-yl, and the like.

The cross linked hydrocarbon compound residual groups include, for example, bicyclo[2.2.1]heptane-1-yl, tricyclo[3.3.1.1$^{3'7}$]decane-1-yl, 7,7-dimethyl-bicyclo[2.2.1]heptane-1-yl and the like.

The alkoxy groups represented by R are allowed to substituted the substituents given to the above-mentioned alkyl groups, and they include, for example, a methoxy, propoxy, 2-ethoxyethoxy, pentadecyloxy, 2-dodecyloxyethoxy, phenthyloxyethoxy and the like groups.

The aryloxy groups represented by R preferably include, for example, a phenyloxy group, and the aryl nucleus thereof is further allowed to be substituted by the substituents or atoms given to the above-mentioned aryl groups. They include, for example, a phenoxy, p-t-butylphenoxy, m-pentadecylphenoxy and the like groups.

The heterocyclicoxy groups represented by R preferably include, for example, those each having a 5 to 7 membered heterocyclic ring which is also allowed to have a substituent. They include, for example, a 3,4,5,6-tetrahydropyranyl-2-oxy group and a 1-phenyltetrazole-5-oxy group.

The siloxy groups represented by R may further be substituted by an alkyl group or the like. They include, for example, a trimethylsiloxy, triethylsiloxy, dimethylbutylsiloxy and the like groups.

The acyloxy groups represented by R include, for example, an alkylcarbonyloxy, arylcarbonyloxy and the like groups. They are further allowed to have a substituent including, typically, an acetyloxy, α-chloracetyloxy, benzoyloxy and the like groups.

The carbamoyloxy groups represented by R may be substituted by an alkyl, aryl or the like group. They include, for example, N-ethylcarbamoyloxy, N,N-diethylcarbamoyloxy, N-phenylcarbamoyloxy and the like group.

The amino groups represented by R may also be substituted by an alkyl group, an aryl group and more preferably a phenyl group, and the like group. They include, for example, an ethylamino, anilino, m-chloranilino, 3-pentadecyloxycarbonylanilino, 2-chloro-5-hexadecaneamidoanilino and the like groups.

The acylamino groups represented by R include, for example, an alkylcarbonylamino, arylcarbonylamino and more preferably phenylcarbonylamino, and the like groups. They may further have a substituent including, typically, an acetamido, α-ethylpropaneamido, N-phenylacetamido, dodecaneamido, 2,4-di-t-amylphenoxyacetamido, α-3-t-butyl-4-hydroxyphenoxybutaneamido and the like groups.

The sulfonamido groups represented by R include, for example, an alkylsulfonylamino, arylsulfonylamino and the like groups, and they are allowed to have a substituent including, typically, a methylsulfonylamino, pentadecylsulfonylamino, benzenesulfonamido, p-toluenesulfonamido, 2-methoxy-5-t-amylbenzenesulfonamido and the like groups.

The imido groups represented by R may be of the open-chained or of the cyclic, and they may also have a substituent including, for example, a succinic acid imido, 3-heptadecyl succinic acid imido, phthalic imido, glutaric imido and the like groups.

The ureido groups repesented by R may be substituted by an alkyl, aryl and preferably phenyl or the like group. They include, for example, N-ethylureido, N-methyl-N-decylureido, N-phenylureido, N-p-tolyureido and the like groups.

The sulfamoylamino groups represented by R may be substituted by an alkyl, aryl and more preferably phenyl, or the like group. They include, for example, a N,N-dibutylsulfamoylamino, N-methylsulfamoylamino, N-phenylsulfamoylamino and the like groups.

The alkoxycarbonylamino groups represented by R may further have a substituent including, for example, a methoxycarbonylamino, methoxyethoxycarbonylamino, octadecyloxycarbonylamino and the like groups.

The aryloxycarbonylamino groups represented by R may have a substituent including, for example, a phenoxycarbonylamino, 4-methylphenoxycarbonylamino and the like groups.

The alkoxycarbonyl groups represented by R may further have a substituent including, for example, a methoxycarbonyl, butyloxycarbonyl, dodecyloxycarbonyl, octadecyloxycarbonyl, ethoxymethoxycarbonyloxy, benzyloxycarbonyl and the like groups.

The aryloxycarbonyl groups represented by R may further have a substituent including, for example, a phenoxycarbonyl, p-chlorophenoxycarbonyl, m-pentadecyloxyphenoxycarbonyl and the like groups.

The alkylthio groups represented by R may further have a substituent including, for example, an ethylthio, dodecylthio, octadecylthio, phenethylthio and 3-phenoxypropylthio groups.

The arylthio groups represented by R include preferably a phenylthio group and may further have a substituent including, for example, a phenylthio, p-methoxyphenylthio, 2-t-octylphenylthio, 3-octadecylphenylthio, 2-carboxyphenylthio, p-acetaminophenylthio and the like groups.

The heterocyclicthio groups represented by R include, preferably, a 5 to 7 membered heterocyclicthio group, and may further have a condensed ring or a substituent. They include, for example, a 2-pyridylthio, 2-benzothiazolylthio, and 2,4-diphenoxy-1,3,5-triazole-6-thio groups.

The substituents represented by X which are capable of splitting off through the reaction thereof to the oxidation products of a color developing agent include, for example, the groups substituted through carbon, oxygen, sulphur or nitrogen atom as well as such a halogen atom as chlorine, bromine, fluorine or the like atom.

The groups substituted through a carbon atom include, for example, a carboxyl group and besides, the groups represented by the following formula:

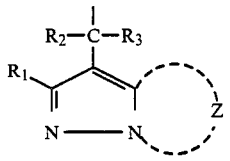

wherein $R_1$ is synonymous with the above-mentioned R; Z is synonymous with the above-mentioned Z; and $R_2$ and $R_3$ represent hydrogen, an aryl group, an alkyl group or a heterocyclic group, respectively; a hydroxymethyl group and a triphenylmethyl group.

The groups substituted through oxygen include, for example, an alkoxxy, aryloxy, heterocyclicosy, acyloxy, sulfonyloxy, alkoxycarbonyloxy, aryloxycarbonyloxy, alkyloxalyloxy and alkoxyoxalyloxy groups.

The alkoxy groups are allowed to have a substituent including, for example, an ethoxy, 2-phenoxyethoxy, 2-cyanoethoxy, phenethyloxy, p-chlorobenzyloxy and the like groups.

Among the aryloxy groups, a phenoxy group is preferred. Such aryloxy groups may have a substituent. They include typically phenoxy, 3-methylphenoxy, 3-dodecylphenoxy, 4-methanesulfonamidophenoxy, 4-[α-(3'-pentadecylphenoxy)butanamido]phenoxy, hexyldecylcarbamoylmethoxy, 4-cyanophenoxy, 4-methanesulfonulphwnoxy, 1-naphthyloxy, p-methoxyphenoxy and the like groups.

The hetero cyclicoxy groups include preferably a 5 to 7 membered heterocyclicoxy group, and may have a substituent. They typically include a 1-phenyltetrazolyloxy, 2-benzothiazolyloxy or the like group.

The acyloxy groups include, for example, such an alkylcarbonyloxy group as an acetoxy, butanoloxy or the like group; such an alkenylcarbonyloxy group as a cinnamoyloxy group; ans such an arylcarbonyloxy group as a benzoyloxy group.

The sulfonyloxy groups include, for example, a butanesulfonyloxy group or a methanesulfonyloxy group.

The alkonylcarbónyloxy groups include, for example, an ethoxycarbonyloxy group or a benzyloxycarbonyloxy group.

The aryloxycarbonyl groups include, for example, a phenoxycarbonyloxy group or the like groups.

The alkyloxalyloxy groups include, for example, a methyloxalyloxy group.

The alkoxyoxalyloxy groups include, for example, an ethoxyoxalyloxy group and the like.

The groups substituting through sulphur include, for example, an alkylthio, arylthio, heterocyclicthio, alkyloxythiocarbonylthio or the like groups.

The alkylthio groups include, for example, a butylthio, 2-cyanoethylthio, phenethylthio, benzylthio or the like groups.

The arylthio groups include, for example, a phenylthio, 4-methanesulfonamidophenylthio, 4-dodecylphenethylthio, 4-nonafluoropentanamidophenethylthio, 4-carboxyphenylthio, 2-ethoxy-5-t-butylphenylthio or the like groups.

The heterocyclicthio groups include, for example, a 1-phenyl-1,2,3,4-tetrazolyl-5-thio, 2-benzothiazolythio or the like groups.

The alkyloxythiocarbonylthio groups include, for example, a dodecyloxythiocarbonylthio or the like groups.

The groups sustituting through the above-mentioned nitrogen include, for example, those represented by the following formula:

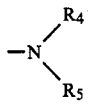

wherein, $R_4$ and $R_5$ represent hydrogen, an alkyl, aryl, heterocyclic, sulfamoyl, carbamoyl, acyl, sulfonyl, aryloxycarbonyl or alkoxycarbonyl group; and $R_4$ and $R_5$ may be so coupled each other as to form a heterocyclic ring, provided that $R_4$ and $R_5$ shall not be hydrogen at the same time.

The alkyl groups are allowed to be normal-chained or branch-chained and preferably have 1 to 22 carbon atoms. The alkyl groups may have such a substitutent as an aryl, alkoxy, aryloxy, alkylthio, arylthio, alkylamino, arylamino, acylamino, sulfonamido, imino, acyl, alkylsulfonyl, arylsulfonyl, carbamoyl, sulfamoyl, alkoxycaronyl, aryloxycarbonyl, alkyloxycarbonylamino, aryloxycarbonylamino, hydroxyl, carboxyl and cyano-groups and halogen. As for the typical examples of the alkyl groups, ethyl, 2-ethylhexyl and 2-chlorethyl groups may be given.

It is preferred that the aryl groups represented by $R_4$ and $R_5$ have 6 to 32 carbon atoms and that they are a phenyl or naphthyl group in particular. They are also allowed to have substituents including, for example, the substituents to the alkyl groups represented by the above-mentioned $R_4$ and $R_5$, and an alkyl group. The typical examples of the aryl groups include a phenyl, 1-naphthyl or 4-methylsulfonylphenyl group.

It is preferred that the heterocyclic groups represented by the above-mentioned $R_4$ and $R_5$ are the 5 to 6 membered ones. They are also allowed to be of the condensed ring and to have a substituent. The typical examples thereof include a 2-furyl, 2-quinolyl, 2-pyrimidyl, 2-benzothiazolyl, 2-pyridyl or the like group.

The sulfamoyl groups represented by the $R_4$ and $R_5$ include, for example, N-alkylsulfamoyl, N,N-dialkylsulfamoyl, N-arylsulfamoyl, N,N-diarylsulfamoyl and the like groups. These alkyl and aryl groups are allowed to have the same substituents as those given in the cases of the above-mentioned alkyl and aryl groups. The typical examples of the sulfamoyl groups include N,N-diethylsulfamoyl, N-methylsulfamoyl, N-dodecylsulfamoyl and N-p-tolylsulfamoyl groups.

The carbamoyl groups represented by the $R_4$ and $R_5$ include, for example, N-alkylcarbamoyl, N,N-dialkylcarbamoyl, N-arylcarbamoyl, N,N-diarylcarbamoyl and the like groups. These alkyl and aryl groups are allowed to have the same substituents as those given in the cases of the above-mentioned alkyl and aryl groups. The typical examples of the carbamoyl groups include N,N-diethylcarbamoyl, N-methylcarbamoyl, N-dodecylcarbamoyl, N-p-cyanophenylcarbamoyl and N-p-tolylcarbamoyl groups.

The acyl groups represented by the $R_4$ and $R_5$ include, for example, alkylcarbonyl, arylcarbonyl and heterocyclic carbonyl groups. Such alkyl, aryl and heterocyclic groups are allowed to have a substituent. The typical examples of the acyl groups include a hexafluorobutanoyl, 2,3,4,5,6-pentafluorobenzoyl, acetyl, benzoyl, naphthoyl, 2-fulylcarbonyl or the like groups.

The sulfonyl groups represented by the $R_4$ and $R_5$ include, for example, an alkylsulfonyl, arylsulfonyl or heterocyclic sulfonyl group, and they are also allowed to have a substituent. The typical examples of these sulfonyl groups include an ethanesulfonyl, benzenesulfonyl, octanesulfonyl, naphthalenesulfonyl, p-chlorobenzenesulfonyl or the like groups.

The aryloxycarbonyl groups represented by the $R_4$ and $R_5$ are allowed to have the same substituents as those given in the case of the above-mentioned aryl groups. The typical examples thereof include a phenoxycarbonyl group and the like.

The alkoxycarbonyl groups represented by the $R_4$ and $R_5$ are allowed to have the same substituents as those given in the case of the above-mentioned alkyl groups. The typical examples thereof include a methoxycarbonyl, dodecyloxycarbonyl, benzyloxycarbonyl or the like groups.

It is preferred that the above-mentioned heterocyclic rings formed by coupling $R_4$ or $R_5$ thereto are the 5 to 6 membered ones. They may be saturated or unsaturated and of the aromatic or the non-aromatic and further condensed rings. Such heterocyclic rings include, for example, N-phthalimido, N-succinic acid imido, 4-N-urazolyl, 1-N-hydantoinyl, 3-N-2,4-dioxooxazolidinyl, 2-N-1,1-dioxo-3-(2H)-oxo-1,2-benzothiazolyl, 1-pyrrolyl, 1-pyrrolidinyl, 1-pyrazolyl, 1-pyrazolidinyl, 1-piperidinyl, 1-pyrrolinyl, 1-imidazolyl, 1-imidazolinyl, 1-indolyl, 1-isoindolinyl, 2-isoindolyl, 2-isoindolinyl, 1-benzotriazolyl, 1-benzoimidazolyl, 1-(1,2,4-triazolyl), 1-(1,2,3-triazolyl), 1-(1,2,3,4-tetrazolyl), N-morpholinyl, 1,2,3,4-tetrahydroquinolyl, 2-oxo-1-pyrrolidinyl, 2-1H-pyridone, 2-oxo-1-piperdinyl and the like groups. These heterocyclic groups may also be substituted by an alkyl, aryl, alkyloxy, aryloxy, acyl, sulfonyl, alkylamino, arylamino, acylamino, sulfonamino, carbamoyl, sulfamoyl, alkylthio, arylthio, ureido, alkoxycarbony, aryloxycarbonyl, imido, nitro, cyano, carboxyl or the like groups, a halogen or the like.

The nitrogen-containing heterocyclic rings formed by the above-mentioned Z or Z' include, for example, a pyrazole, imidazole, triazole, tetrazole or the like ring. The substituents which the above-mentioned rings are allowed to have include, for example, the same substituents as those given with respect to the above-mentioned R.

In the case that such a substituent as R or one of from $R_1$ to $R_8$ on a heterocyclic ring shown in Formula [I] and Formulae [II] to [VIII] of which will be described later has the following part:

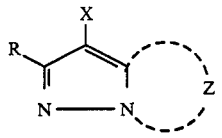

(wherein, R, X and Z are synonymous with R, X and Z in Formula [I]), a so-called bis-type coupler is formed, and it is a matter of course that such couplers shall be included in the invention. Further, in a ring formed by the Z, or $Z_1$ that is to be described later, it is also allowed that another ring such as a 5 to 7 membered cycloalkene may be condensed. For example, it is allowed to form a ring such as a 5 to 7 membered cycloalkene or benzene by coupling $R_5$ and $R_6$ to each other in Formula [V] and by coupling $R_7$ and $R_8$ to each other in Formula [VI].

The magenta couplers represented by Formula [I] may further typically be represented by the following formulae [II] to [VII]:

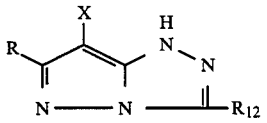

Formula [II]

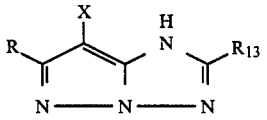

Formula [III]

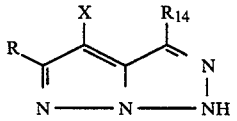

Formula [IV]

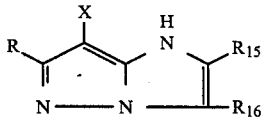

Formula [V]

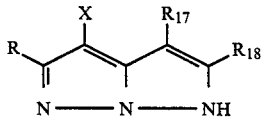

Formula [VI]

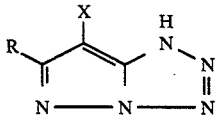

Formula [VII]

In the abovegiven Formulae [II] to [VII], R, $R_{12}$ to $R_{18}$ and X are synonymous with the aforementioned R and X, respectively.

The couplers represented by the following Formula [VIII] are the preferred ones among those represented by the Formula [I]:

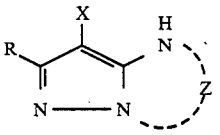

Formula [VIII]

wherein R, X and $Z_1$ are synonymous with R, X and Z denoted in the Formula [I].

The particularly preferred magenta couplers among those represented by the abovegiven Formulae [II] to [VII] are the magenta couplers represented by Forula [II].

A substituent on the heterocyclic rings in the Formulae [I] to [VIII] becomes a preferred one, provided that R in Formula [I] or $R_1$ in Formulae [II] to [VIII] satisfies the following requirement 1. It becomes a further preferred one, provided that the R or $R_1$ satisfies the following requirements 1 and 2. It becomes a particularly preferred one, provided that the R or $R_1$ satisfies the following requirements 1, 2 and 3:

Requirement 1: An atom directly coupled to a heterocyclic ring is a carbon atom.

Requirement 2: Only one hydrogen atom couples to the carbon atom, or nothing couples thereto.

Requirement 3: Every coupling of the carbon atom to the neighboring atoms is a single coupling.

The most preferred substituents R and R on the above-mentioned heterocyclic rings are represented by the following Formula [IX];

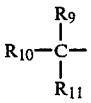

Formula [IX]

wherein $R_9$, $R_{10}$ and $R_{11}$ represent, respectively, hydrogen, a halogen, an alkyl group, cycloalkyl group, alkenyl group, cycloalkenyl group, alkynyl group, aryl group, heterocyclic group, acyl group, sulfonyl group, sulfinyl group, sulfonyl group, carbamoyl group, sulfamoyl group, cyano group, spiro compound residual group, cross-linked hydrocarbon compound residual group, alkoxy group, aryloxy group, heterocyclicoxy group, siloxy group, acyloxy group, carbamoyloxy group, amino group, acylamino group, sulfonamido group, imido group, ureido group, sulfamoylamino group, alkoxycarbonylamino group, aryloxycarbonylamino group, alkoxycarbonyl group, aryloxycarbonyl group, alkylthio group, arylthio group or heterocyclicthio group; and at least two of the $R_9$, $R_{10}$ and $R_{11}$ are not hydrogen.

Two out of the above-mentioned $R_9$, $R_{10}$ and $R_{11}$ which are, for example, $R_9$ and $R_{10}$ are allowed to couple to each other so as to form a saturated or unsaturated ring such as a cycloalkane, cycloalkene or heterocyclic ring, or so as further to produce a cross-linked hydrocarbon compound residual group by coupling $R_{11}$ to the above-mentioned ring.

The groups represented by $R_9$ to $R_{11}$ are allowed to have a substituent. The typical examples of both the groups represented by $R_9$ to $R_{11}$ and the substituents which the above-mentioned groups are allowed to have include the typical examples of the groups represented by R denoted in the above-given Formula [I] and the substituents thereto.

The typical examples of both the rings formed by coupling, for example, $R_9$ and $R_{10}$ to each other and the cross-linked hydrocarbon compounds formed by $R_9$ to $R_{11}$, and the examples of the substituents which the groups represented by $R_9$ to $R_{11}$ are allowed to have include the typical examples of a cycloalkyl group, a cycloalkenyl group, a heterocyclic group and a cross-linked hydrocarbon compound residual group each represented by R denoted in the aforegiven Formula [I] and the substituents thereto.

The following two cases are preferred with respect to the Formula [IX]:

(i) A case that two of $R_9$ through $R_{11}$ are alkyl groups, and (ii) Another case that one of the $R_9$ through $R_{11}$ is hydrogen and, $R_{10}$ and $R_{11}$ are coupled to each other so as to form a cycloalkyl group, together with the carbon atom.

Further, in the case (i), the preferable case is that two of $R_9$ through $R_{11}$ are alkyl groups and the rest is either hydrogen or an alkyl group.

The above-mentioned alkyl and cycloalkyl groups are allowed to have a substituent. The typical examples of the alkyl groups, the cycloalkyl groups and the substituents include the typical examples of the alkyl groups, the cycloalkyl groups and the substituents represented by R denoted in the aforegiven Formula [I].

For serving as the substituents which both of the rings formed by Z denoted in Formula [I] and those formed by $Z_1$ denoted in Formula [VIII] are allowed to have, and as $R_{12}$ through $R_{18}$ denoted in Formulae [II] through [VI], the preferred ones are represented by the following Formula [X];

$$-R_{21}-SO_2-R_{22} \qquad \text{Formula [X]}$$

wherein $R_{21}$ represents an alkylene group; and $R_{22}$ represents an alkyl, cycloalkyl or aryl group.

The alkylene group represented by $R_{21}$ is to have prepferably not less than 2 carbon atoms and more preferably 3 to 6 carbon atoms in the normal chained portion thereof, regardless of the normal or branch chained. The alkylene group may also have a substituent.

The examples of the above-mentioned substituents include those which an alkyl group may have provided that the alkyl group is represented by R denoted in the aforegiven Formula [I].

The preferred substituents include, for example, a phenyl group.

The typical and preferable examples of the alkylene groups represented by $R_{21}$ are given below:

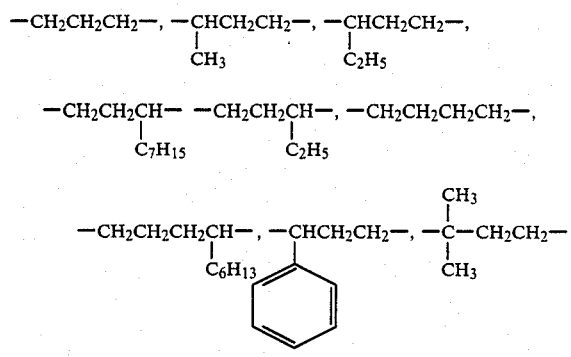

It is regardless of that the alkyl groups represented by $R_{22}$ are normal chained or branch chained.

The above-mentioned alkyl groups typically include a methyl, ethyl, propyl, isopropyl, butyl, 2-ethylhexyl, octyl, dodecyl, tetradecyl, hexadecyl, octadecyl, 2-hexyldecyl or the like group.

The cycloalkyl groups represented by $R_{22}$ preferably include a 5 to 6 membered one that is, for example, a cyclohexyl group.

The alkyl and cycloalkyl groups each represented by $R_{22}$ are allowed to have a substituent which includes, for example, the substituents to the above-mentioned $R_{21}$.

The typical examples of the aryl groups represented by $R_{22}$ include, for example, a phenyl groupand a naphthyl group. The aryl groups are allowed to have a substituent. These substituents include, for example, a normal chained or branch-chained alkyl group and, besides, the substituents exemplified as those to the above-mentioned $R_{21}$.

When there are not less than two substituents, such substituents may be the same with or the different from each other.

The particularly preferable compounds among those represented by Formula [i] are represented by the following Formula [XI];

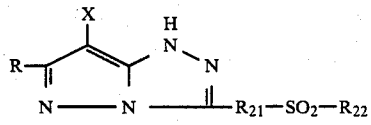

Formula [XI]

wherein R and X are synonymous with R and X denoted in Formula [I]; and $R_2$ and $R_{22}$ are synonymous with $R_{21}$ and $R_{22}$ denoted in Formula [X].

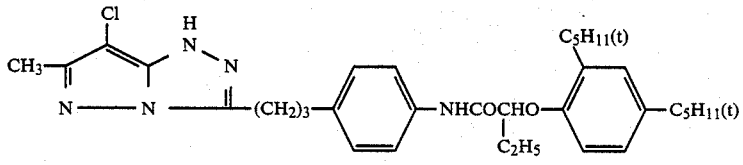

1

-continued
2
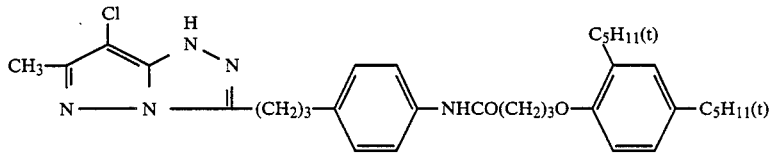
3
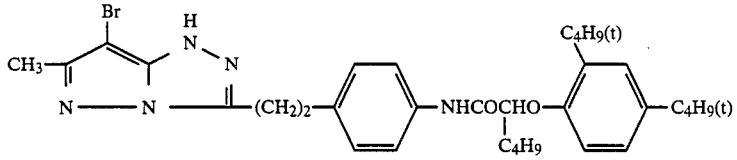
4
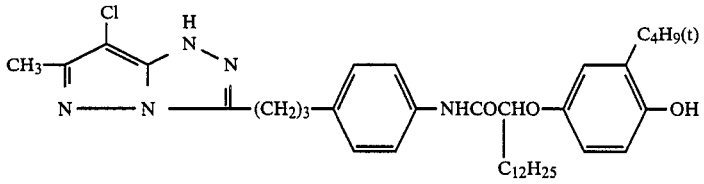
5
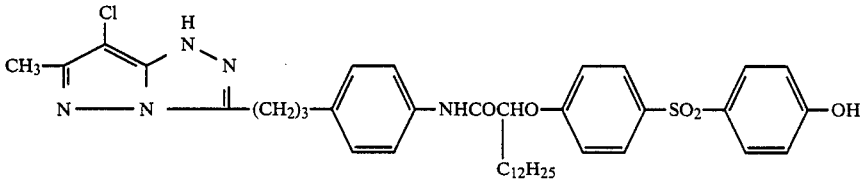
6
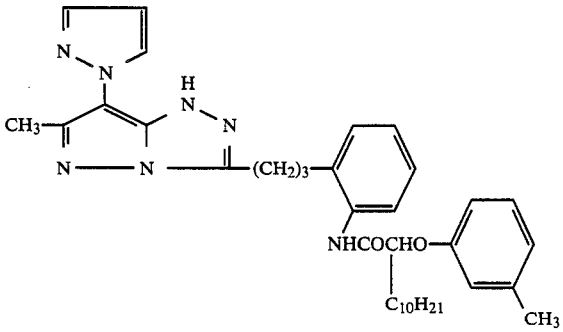
7
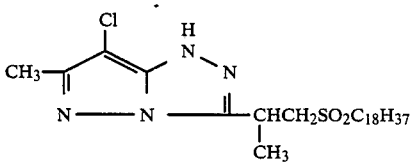
8
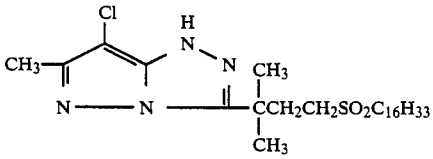
9
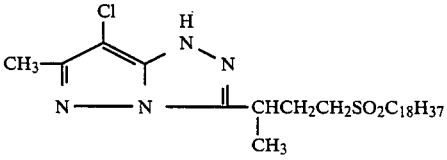

-continued
10
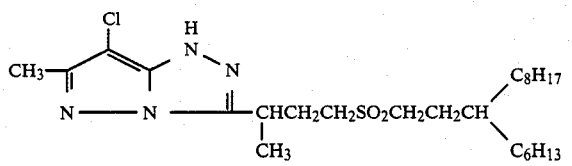
11
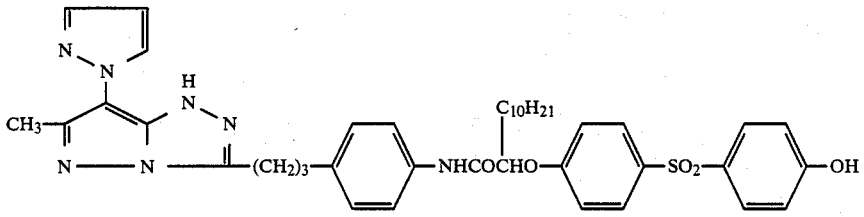
12
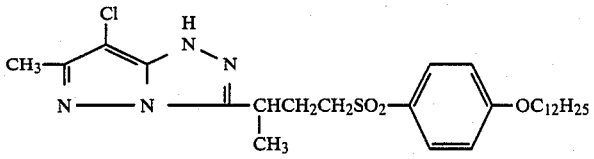
13
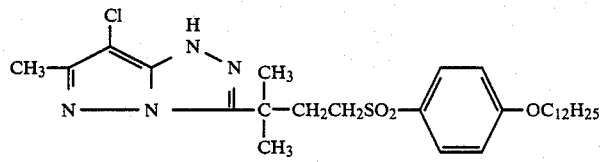
14
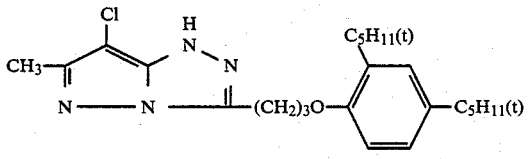
15
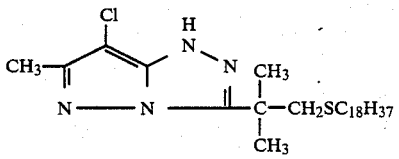
16
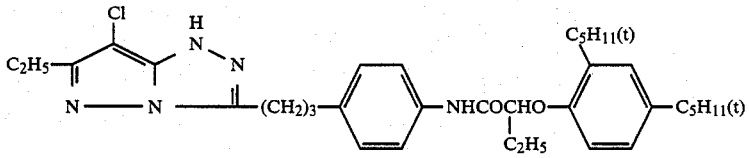
17
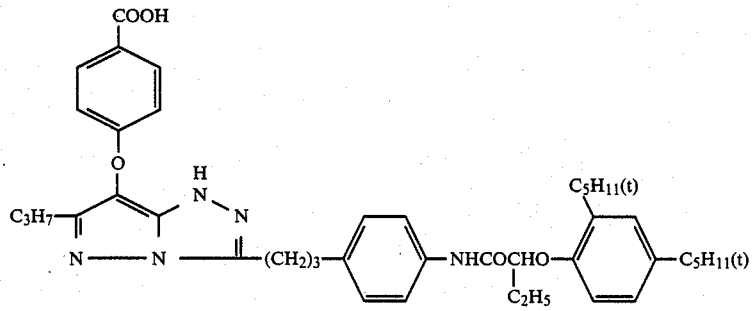

-continued
18
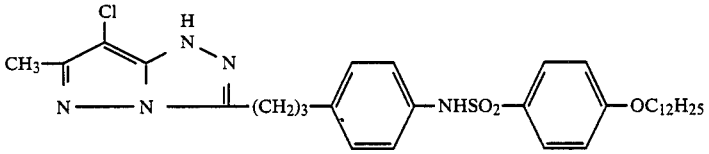
19
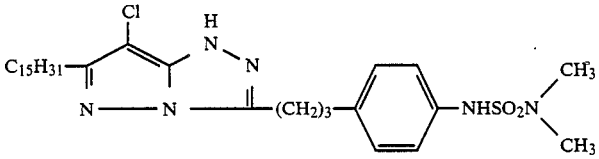
20
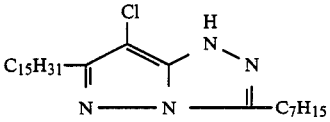
21
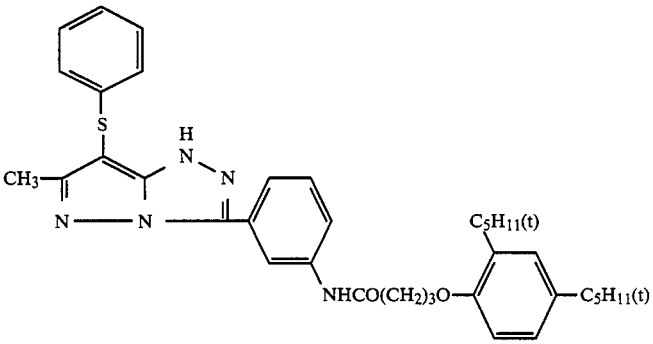
22
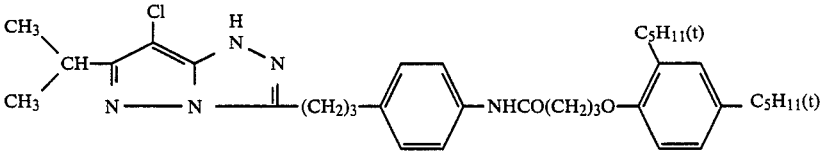
23
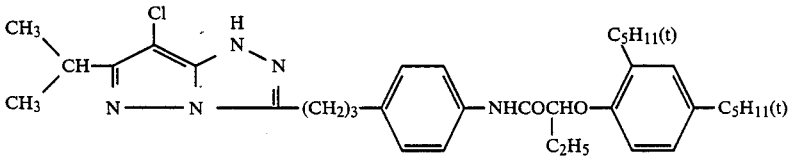
24
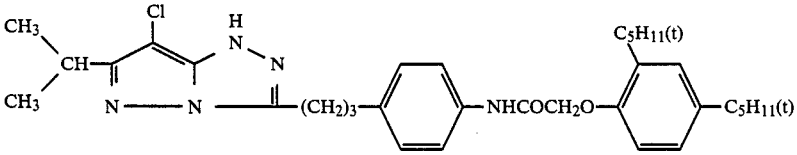
25
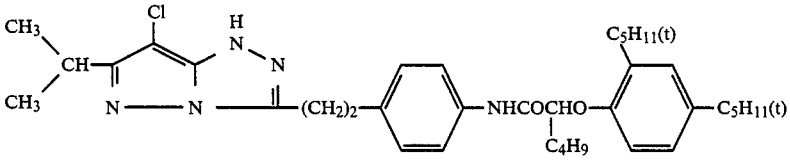
26
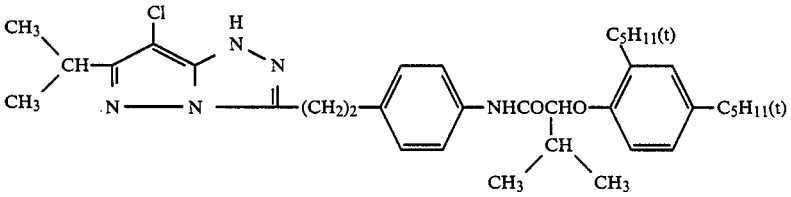

-continued
27
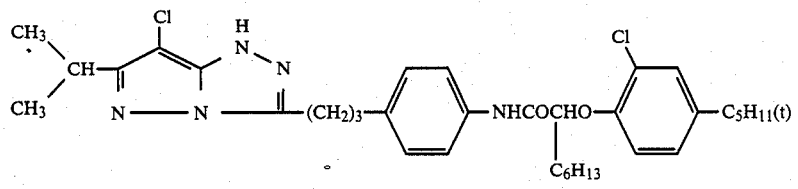
28
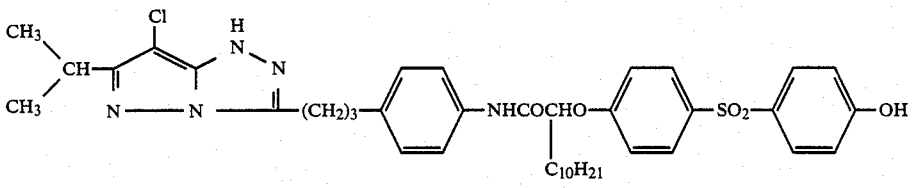
29
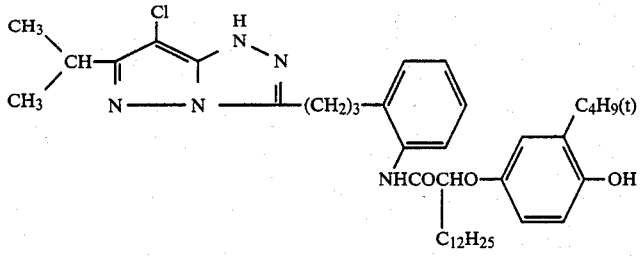
30
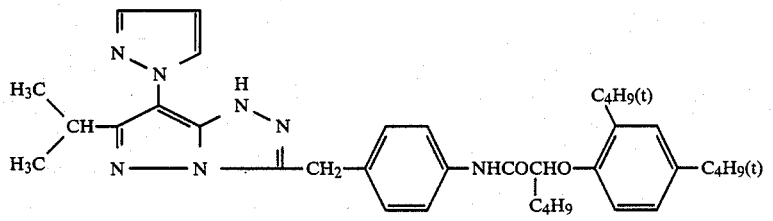
31
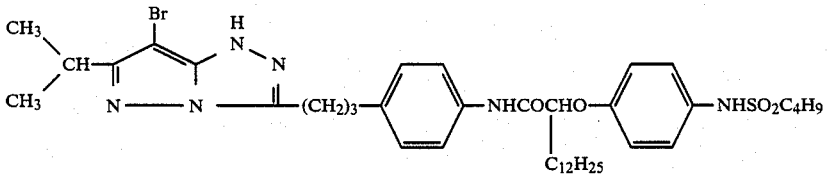
32
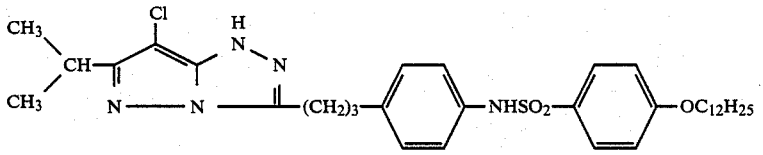
33
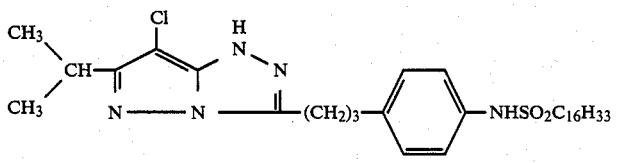

-continued
34
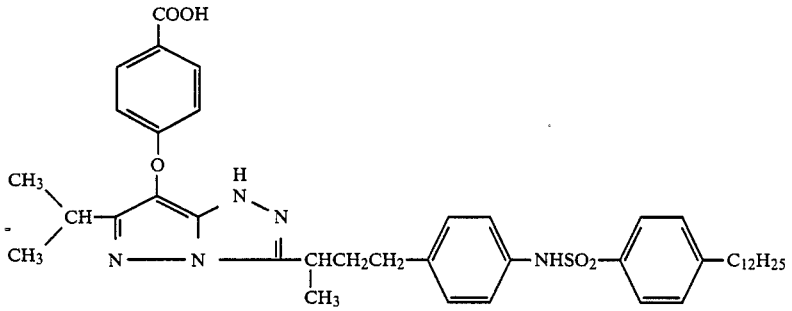
35
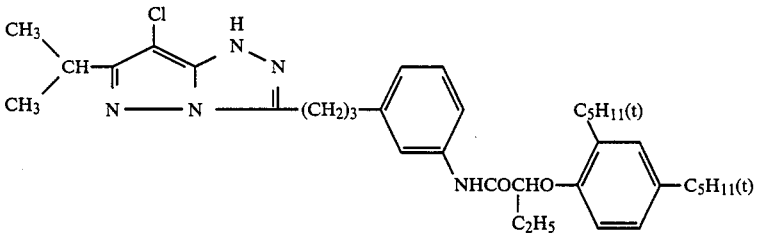
36
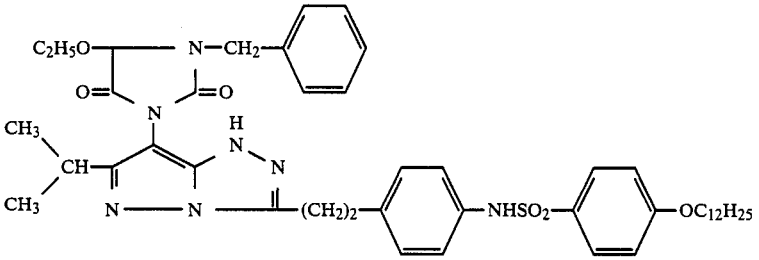
37
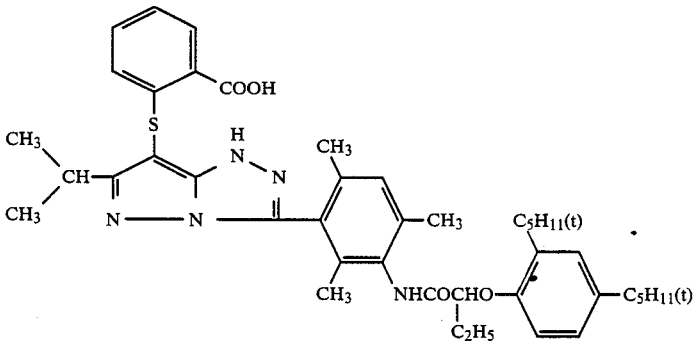
38
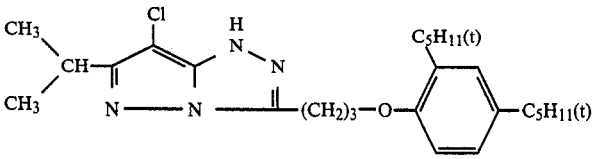
39
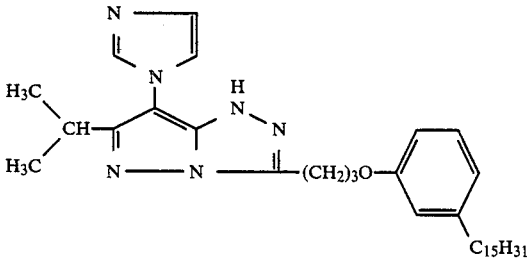

-continued
40
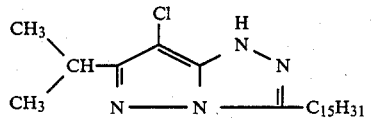
41
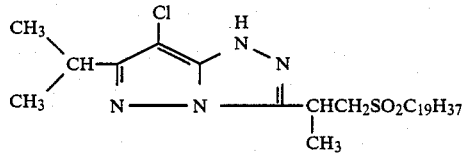
42
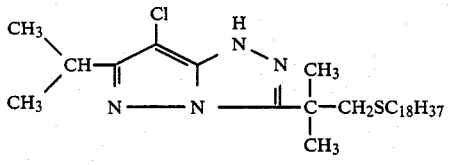
43
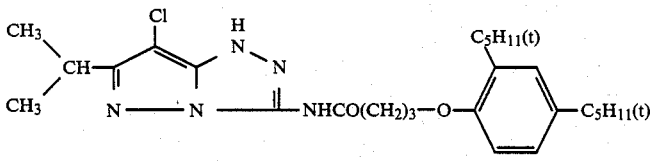
44
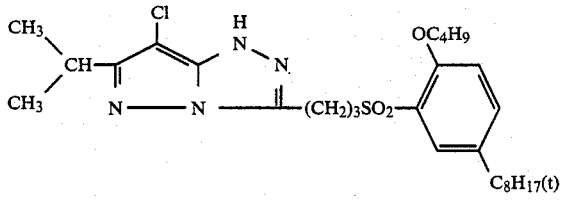
45
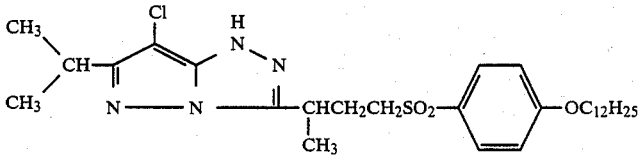
46
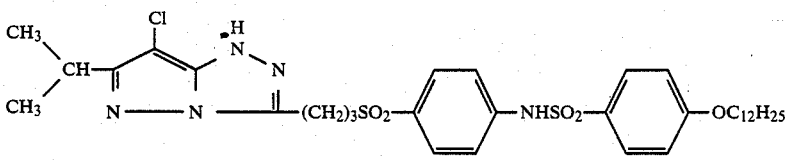
47
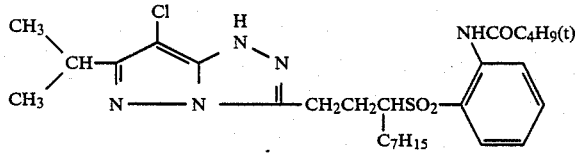
48
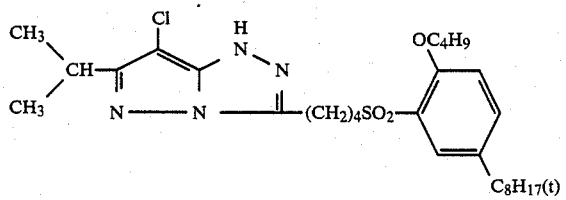

-continued
49
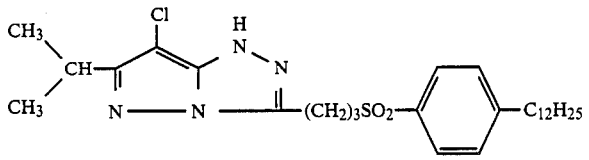
50
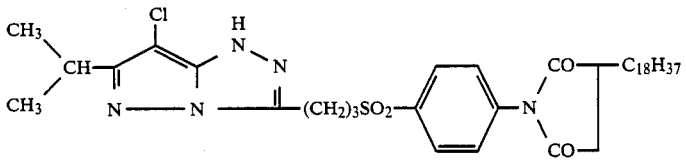
51
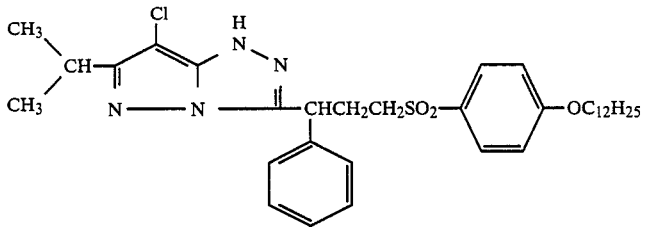
52
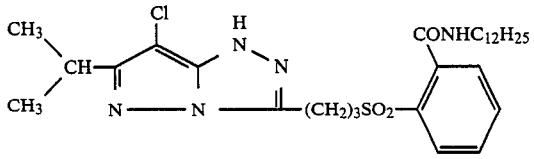
53
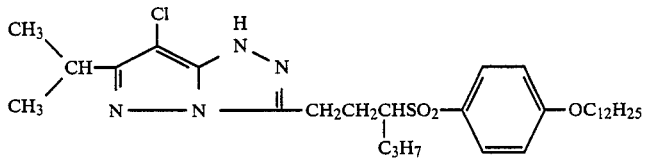
54
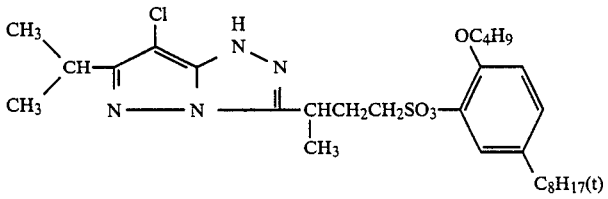
55
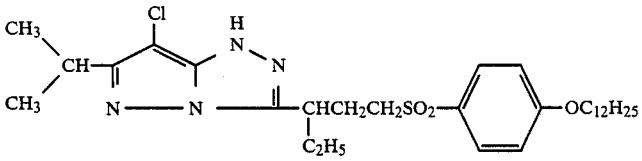
56
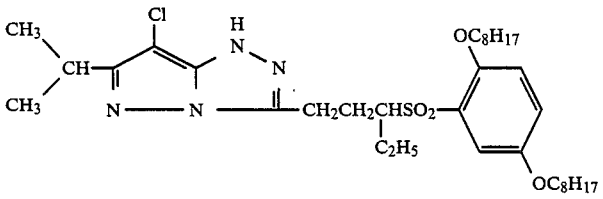
57
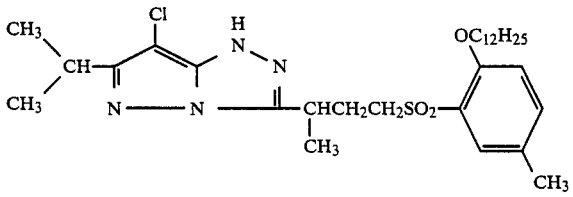

-continued
58
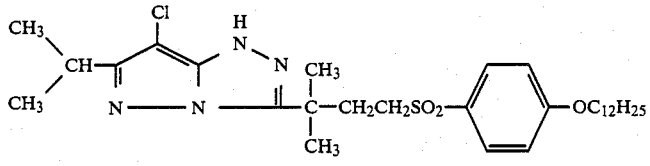
59
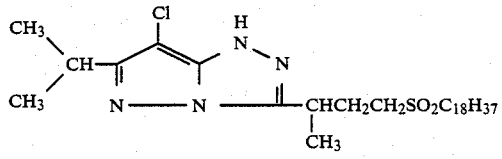
60
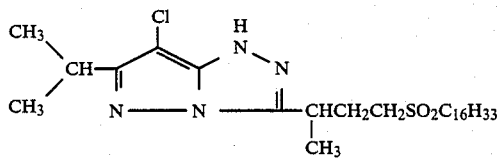
61
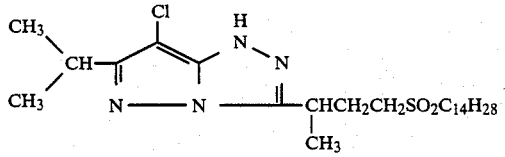
62
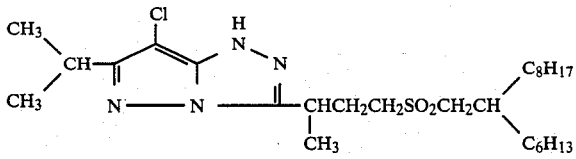
63
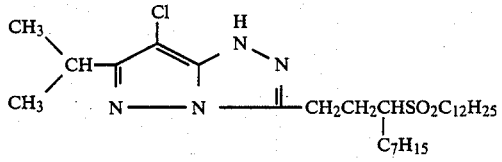
64
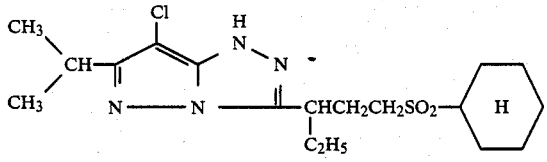
65
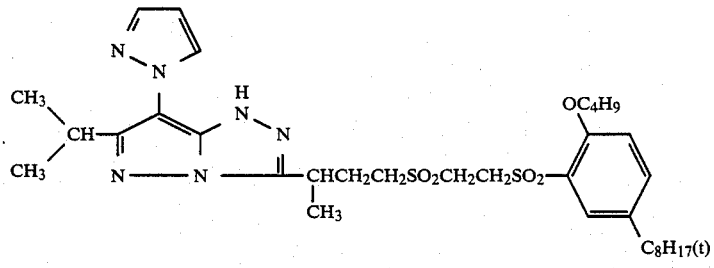
66
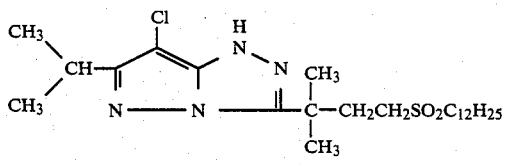

-continued
67
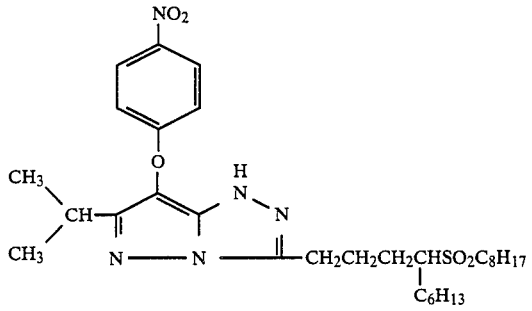
68
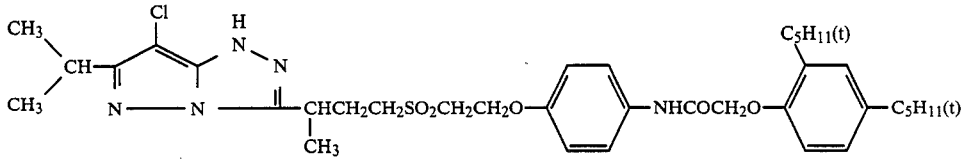
69
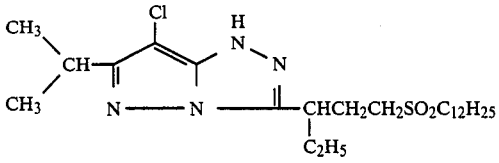
70
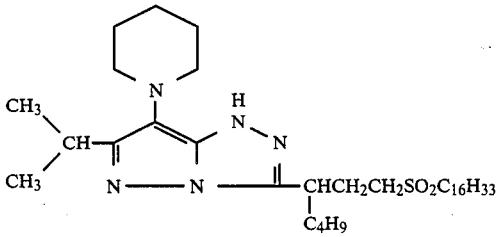
71
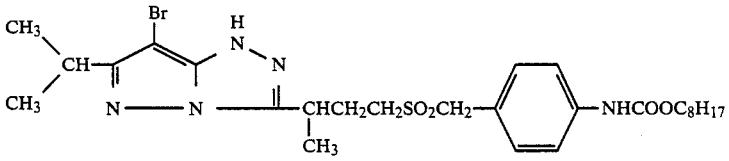
72
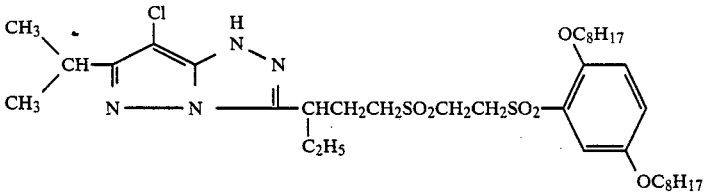
73
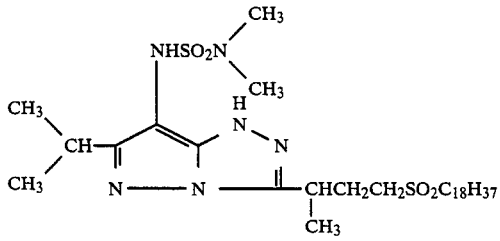
74
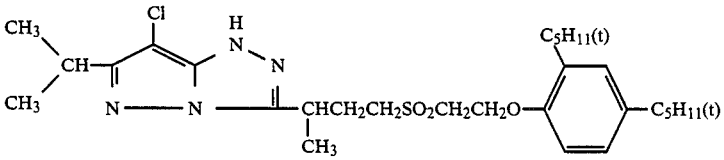

-continued
75
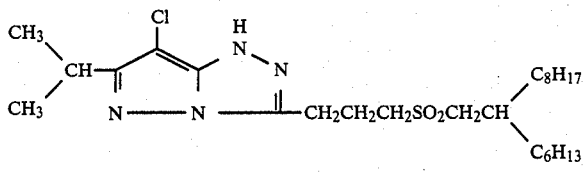
76
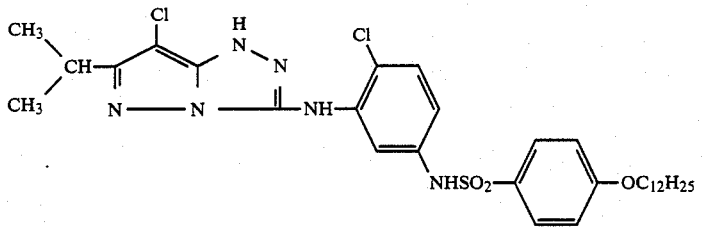
77
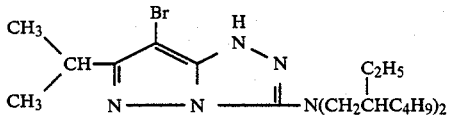
78
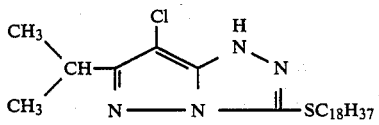
79
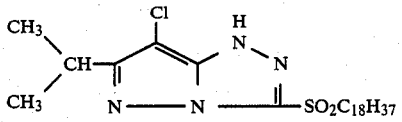
80
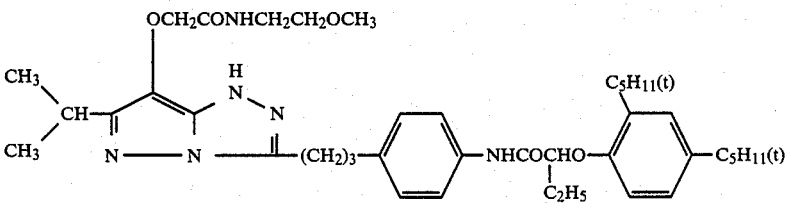
81
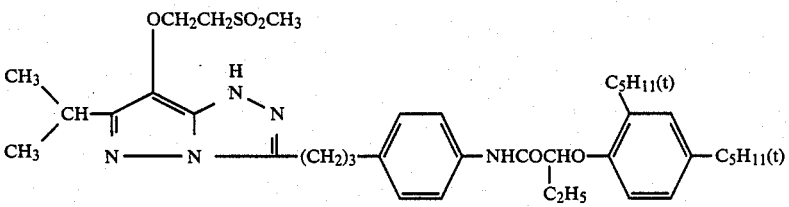
82
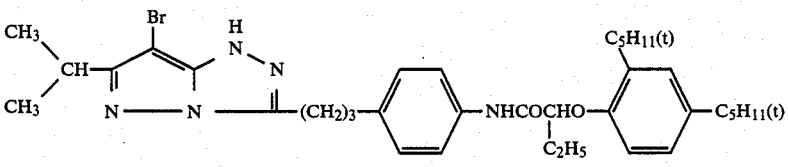
83
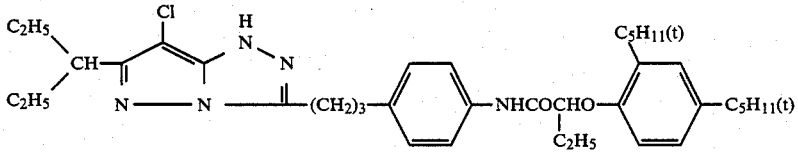

-continued
84
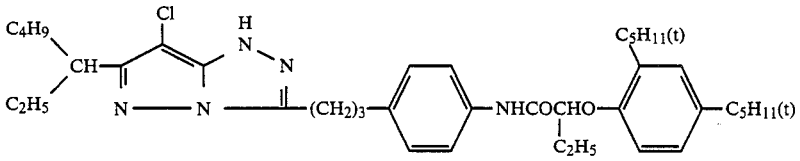
85
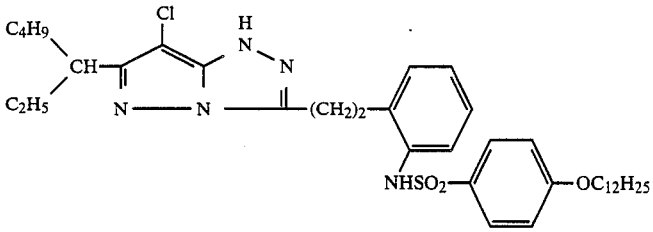
86
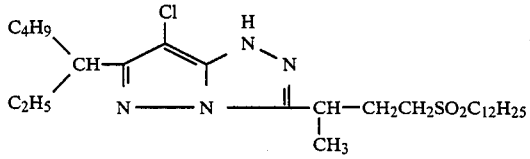
87
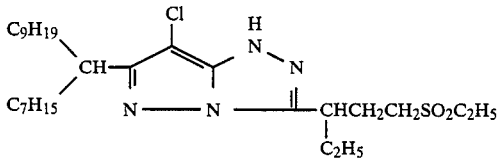
88
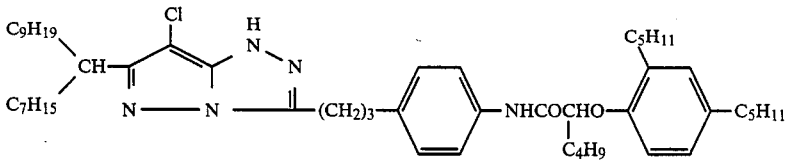
89
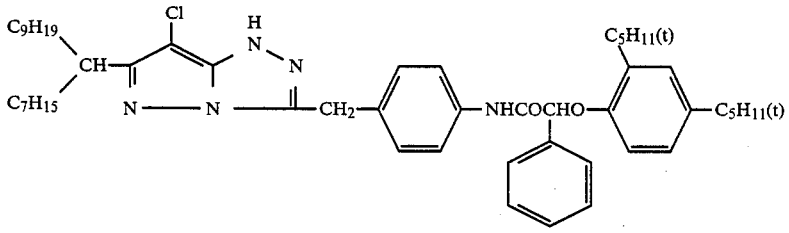
90
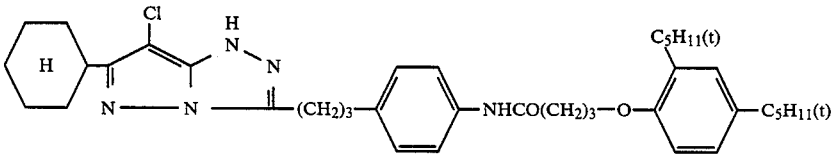
91
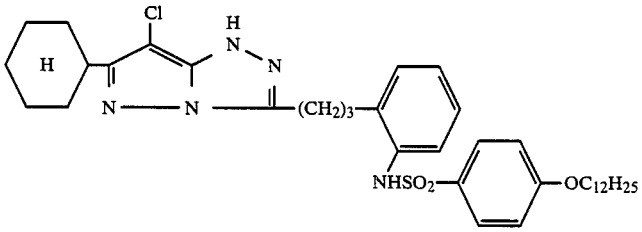

-continued
92
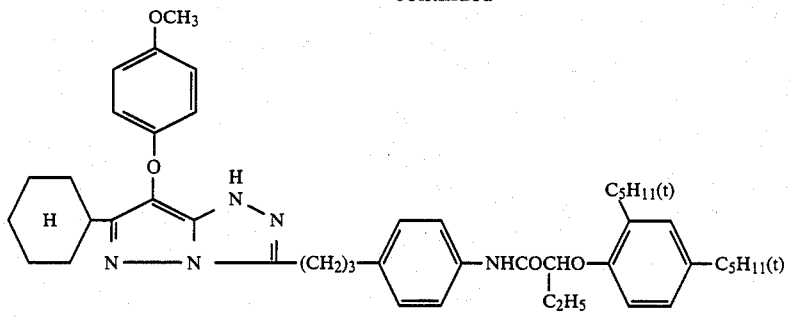
93
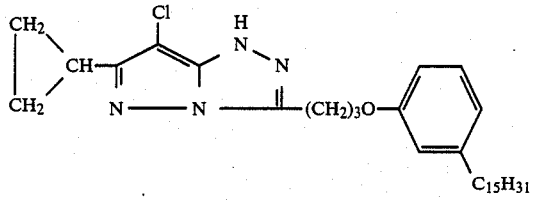
94
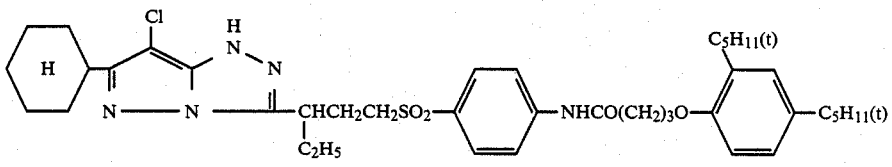
95
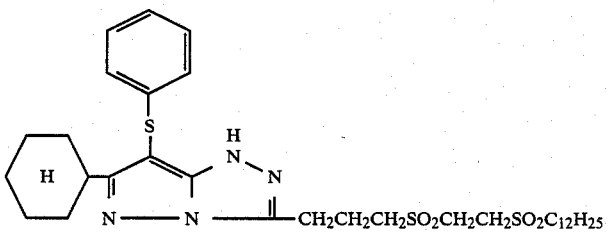
96
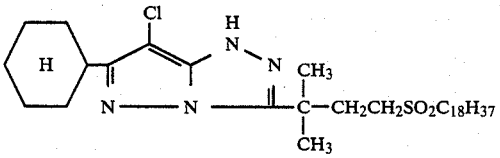
97
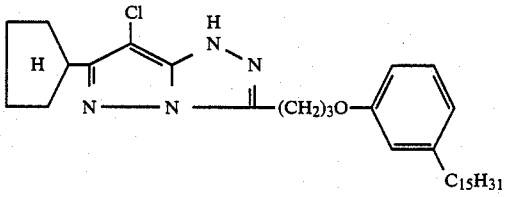
98
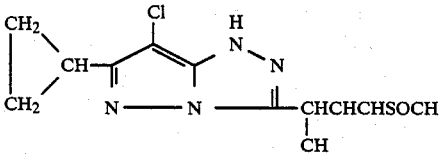
99
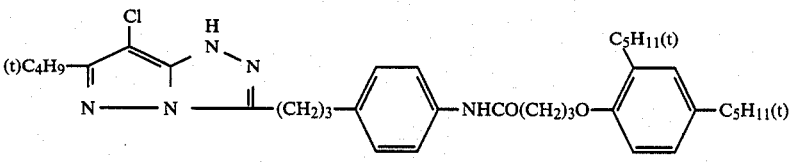

-continued
100
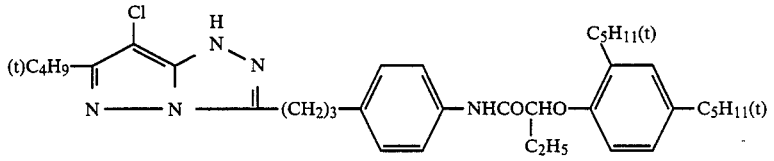
101
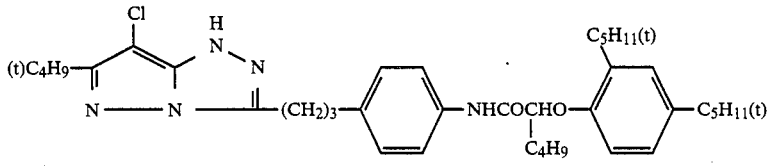
102
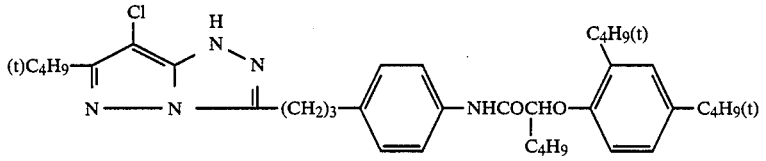
103
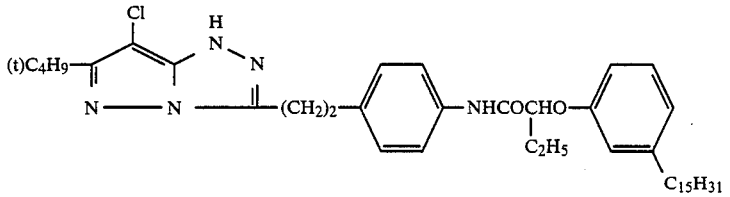
104
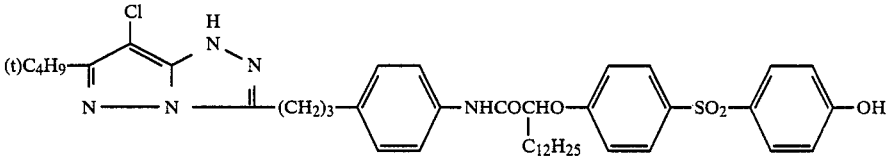
105
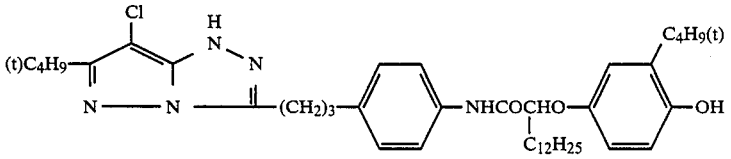
106
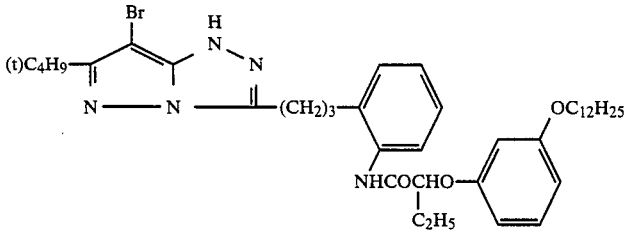
107
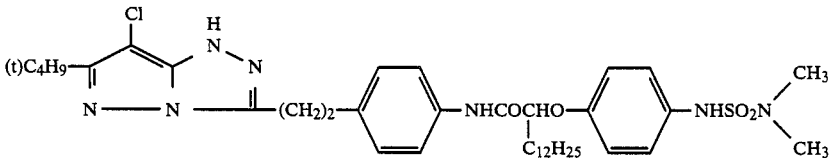
108
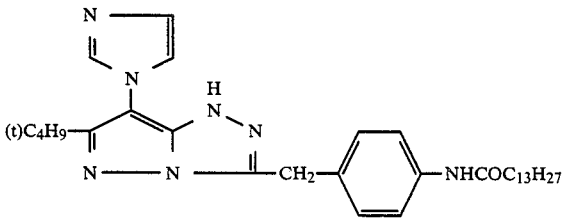

-continued
109
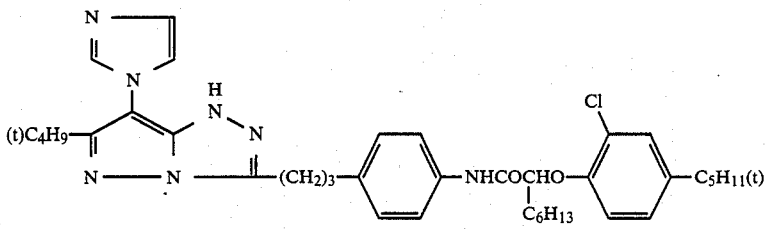
110
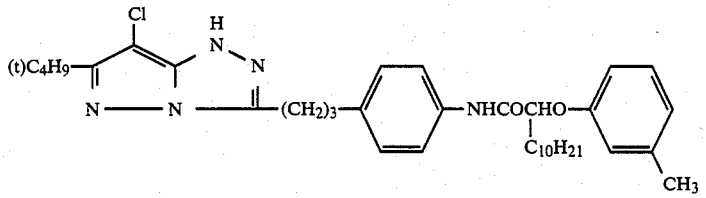
111
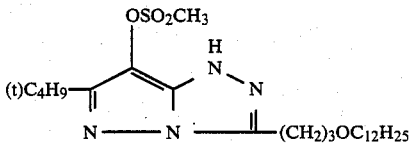
112
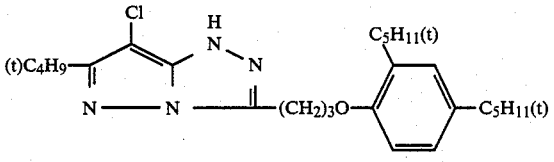
113
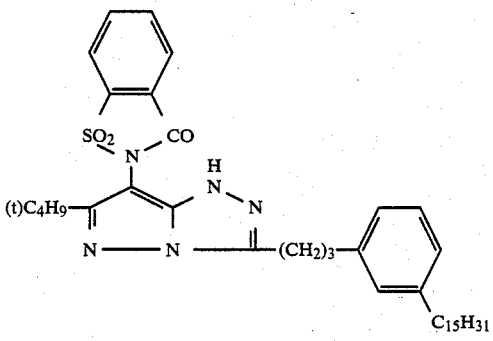
114
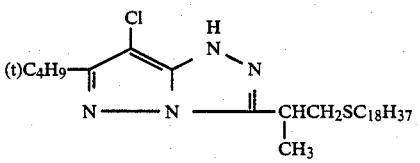
115
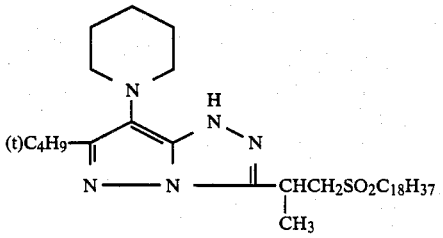

-continued
116
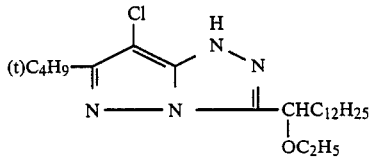
117
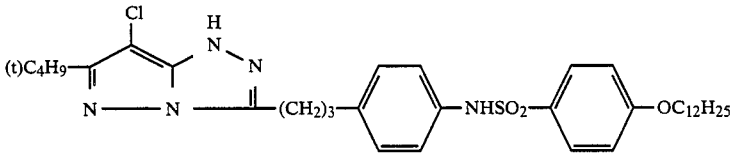
118
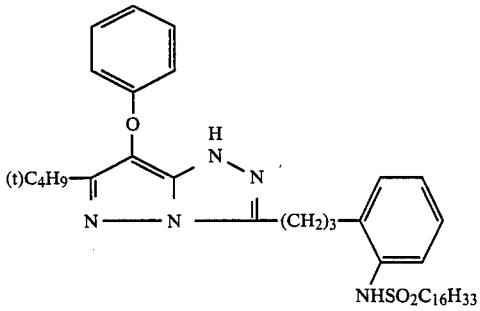
119
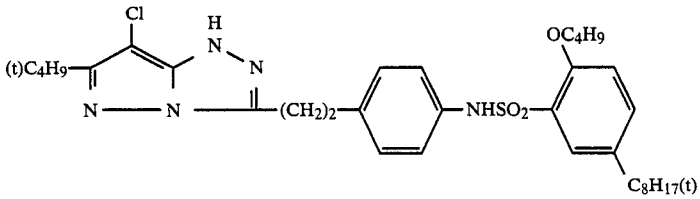
120
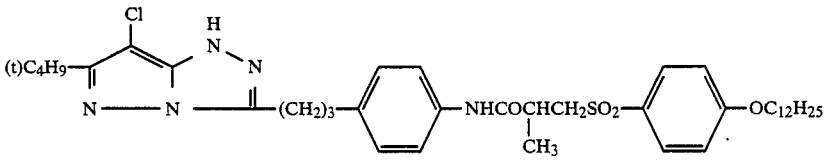
121
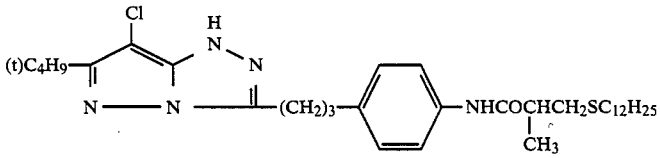
122
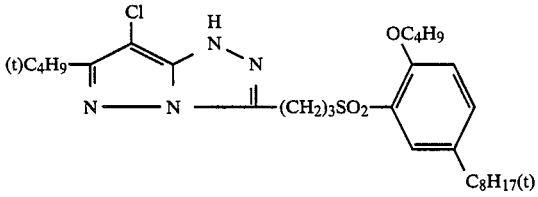
123
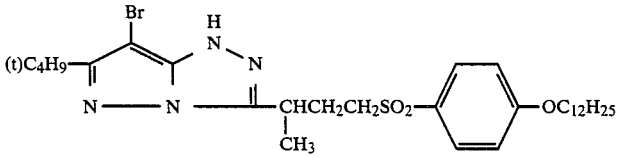

-continued
124
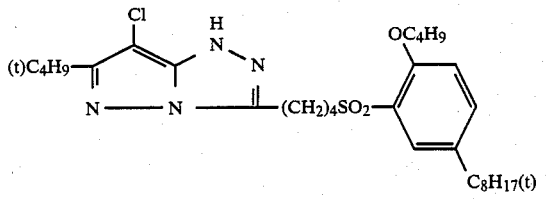
125
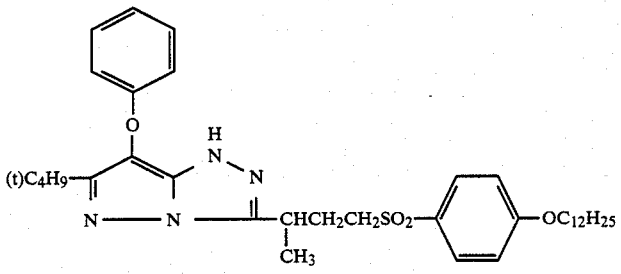
126
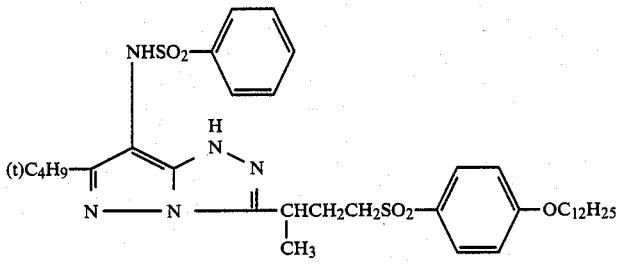
127
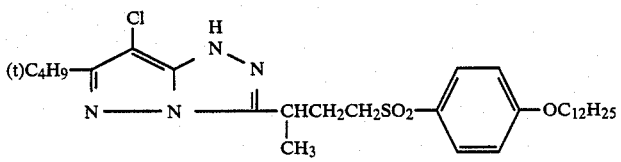
128
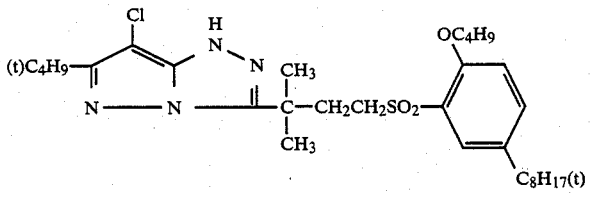
129
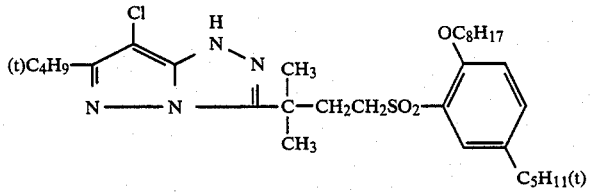
130
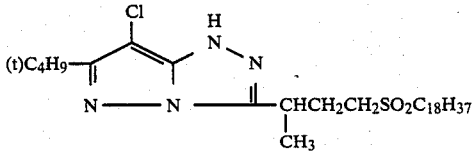

-continued
131
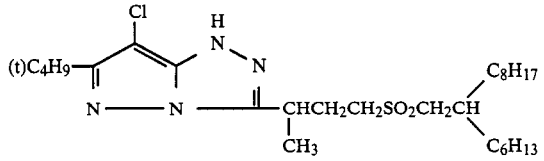
132
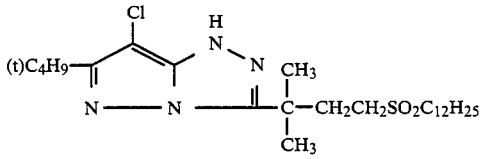
133
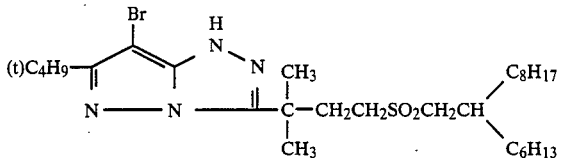
134
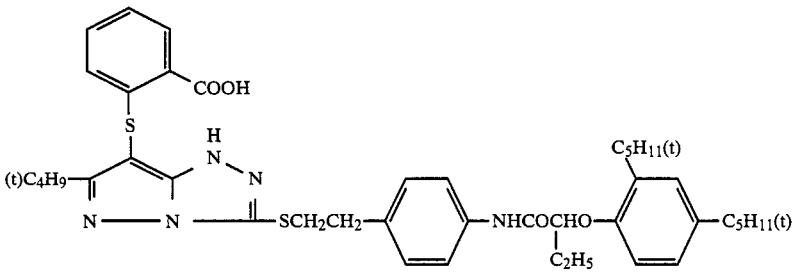
135
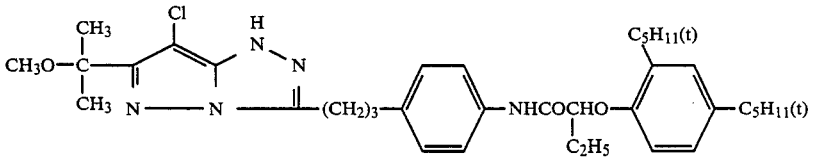
136
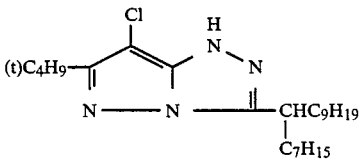
137
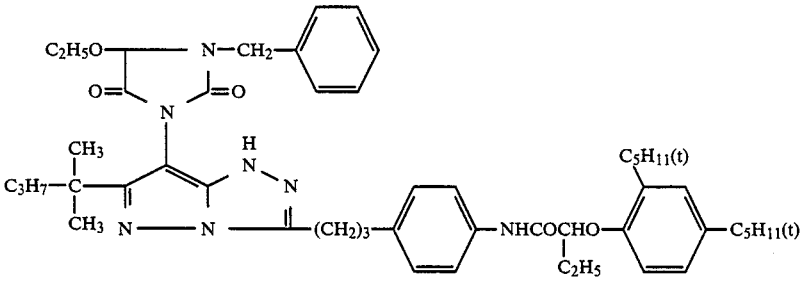
138
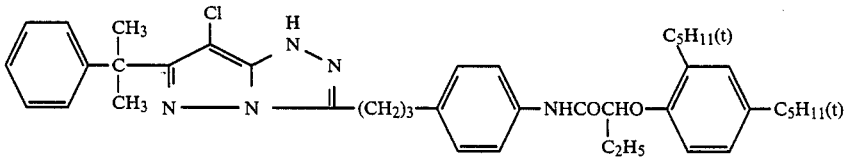

-continued
139
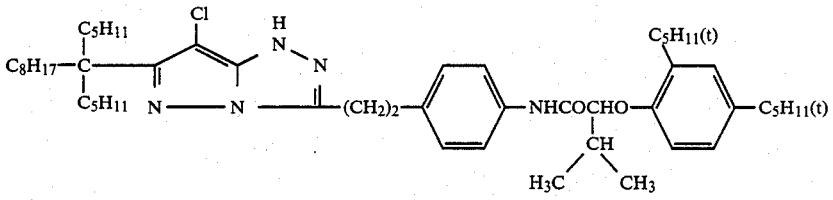
140
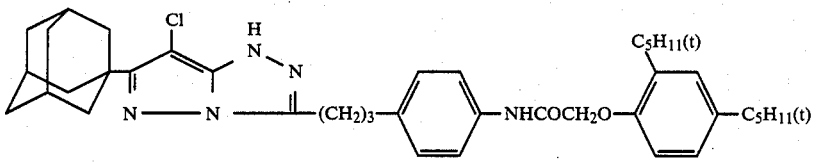
141
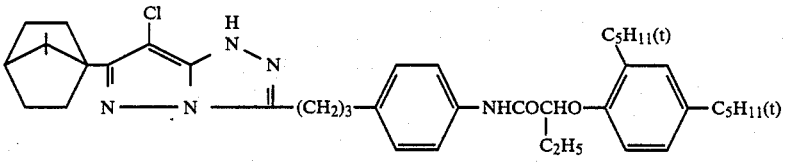
142
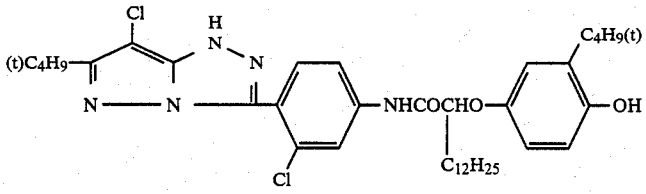
143
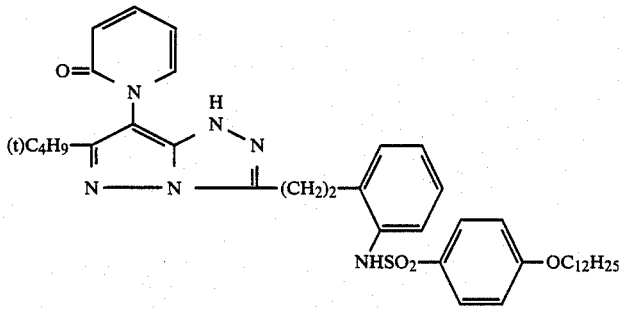
144
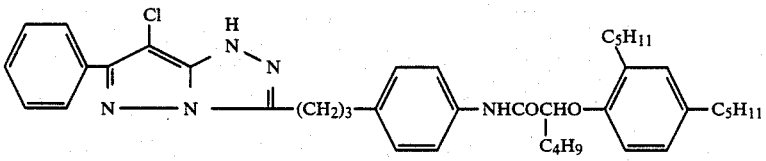
145
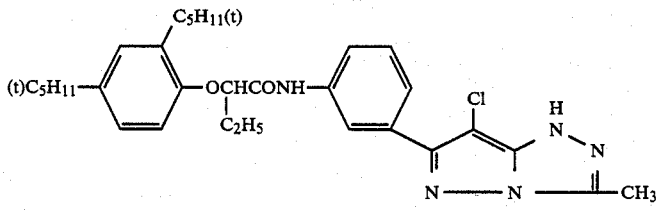
146
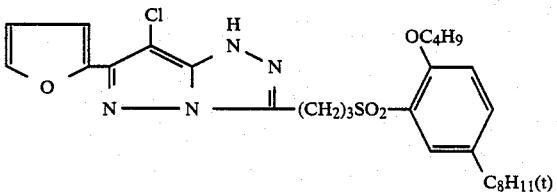

-continued
147
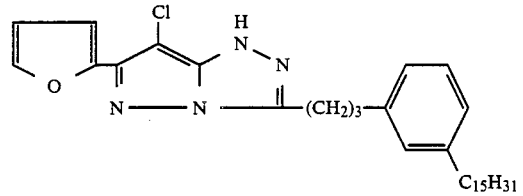
148
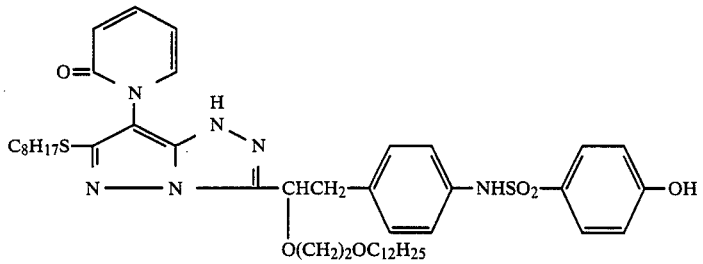
149
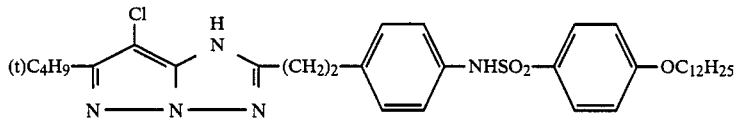
150
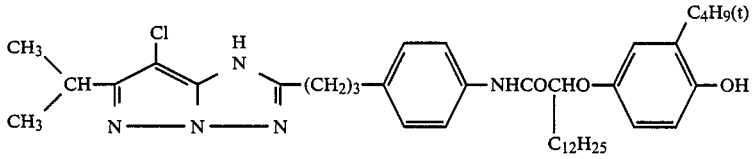
151
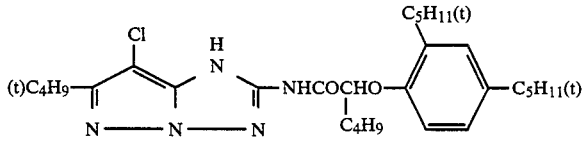
152
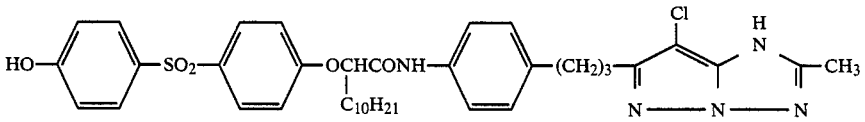
153
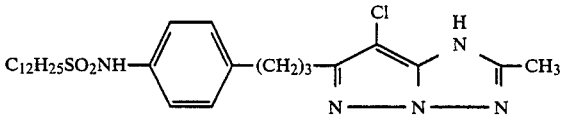
154
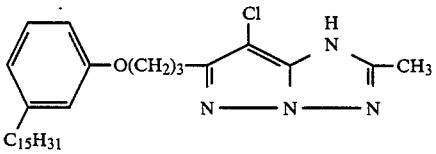
155
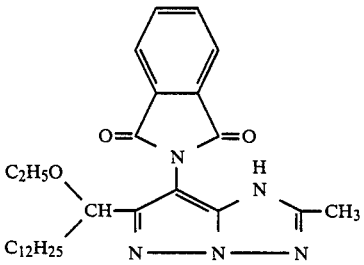

-continued
156
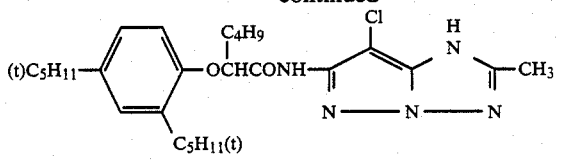
157
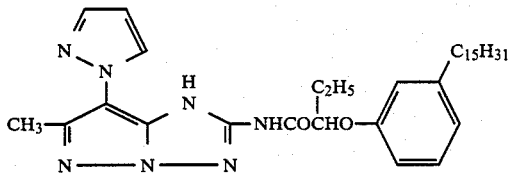
158
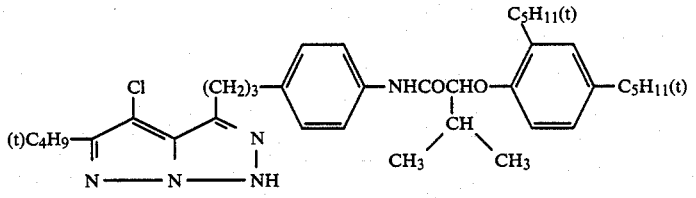
159
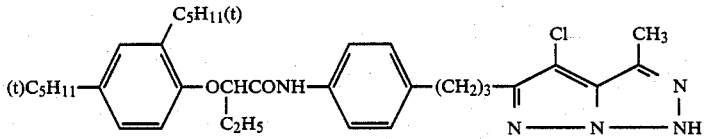
160
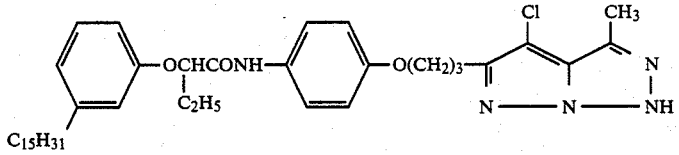
161
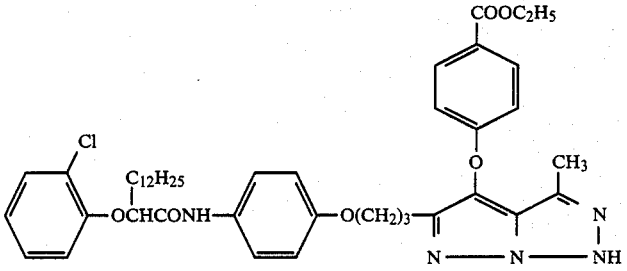
162
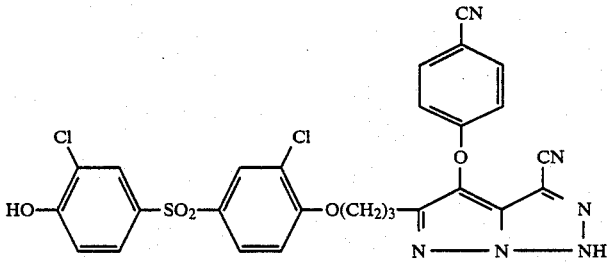
163
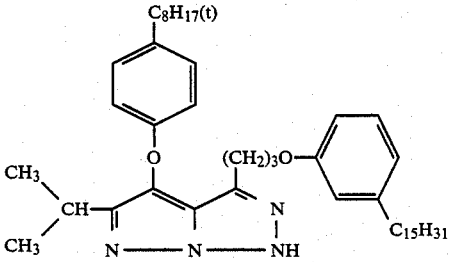

-continued
164
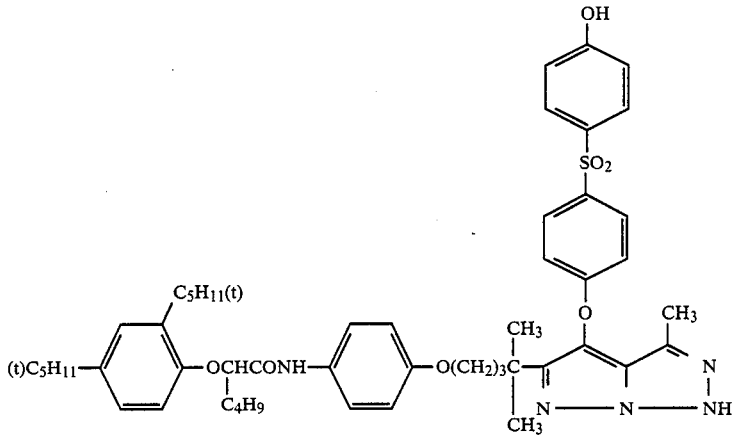
165
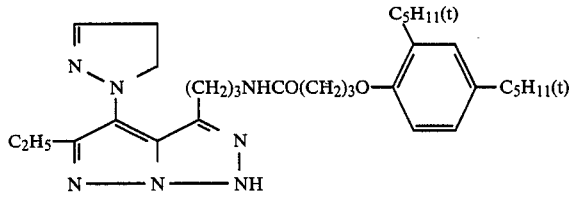
166
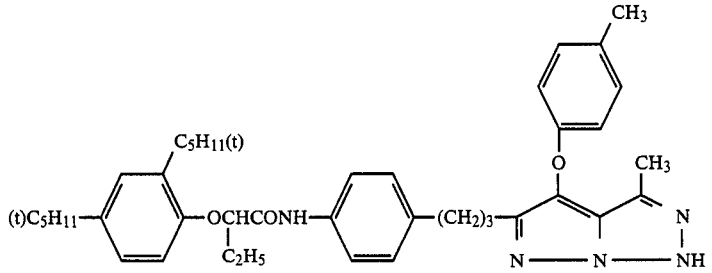
167
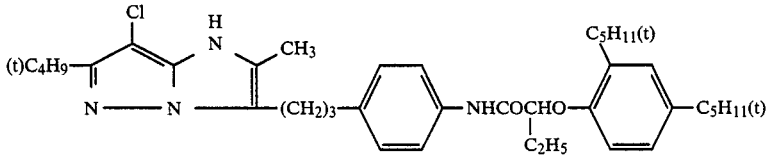
168
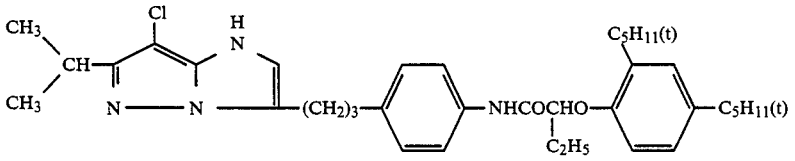
169
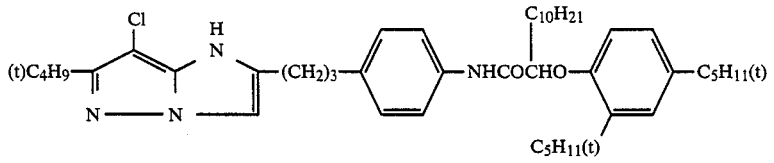
170
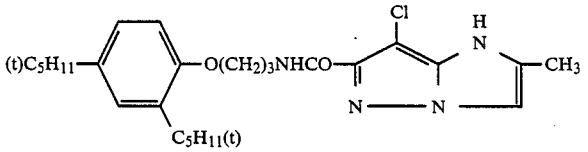

-continued
171
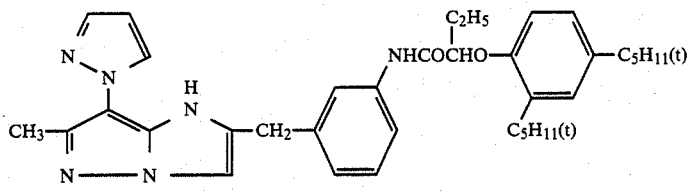
172
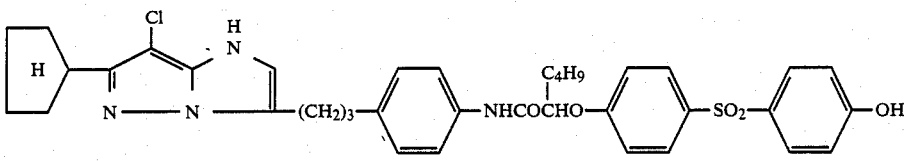
173
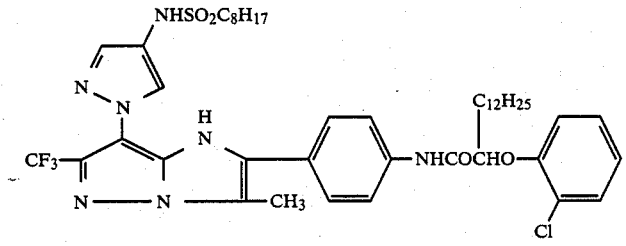
174
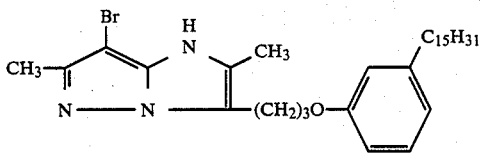
175
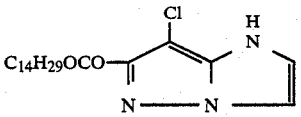
176
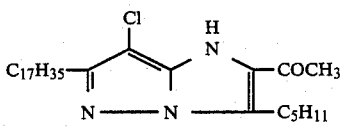
177
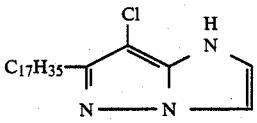
178
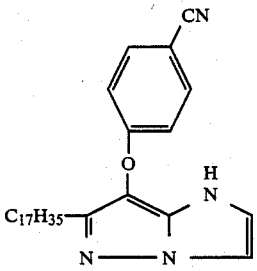
179
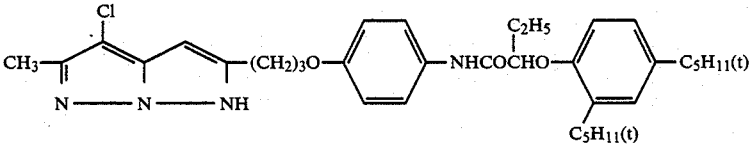

-continued
180
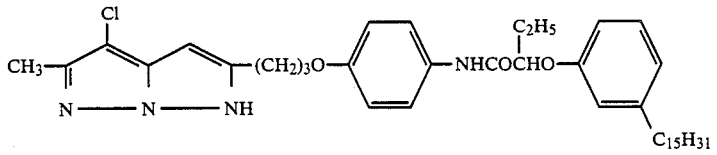
181
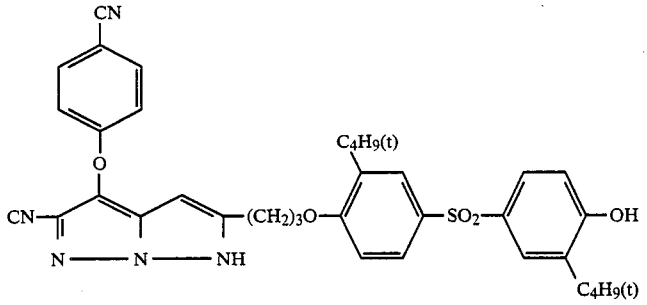
182
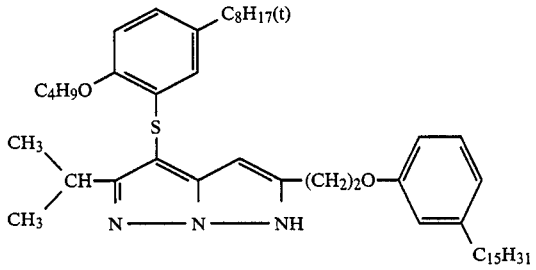
183
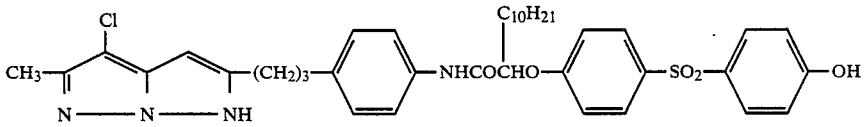
184
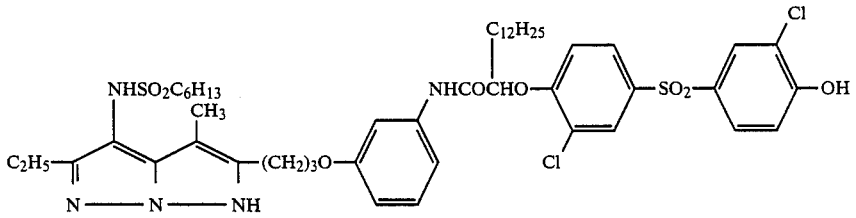
185
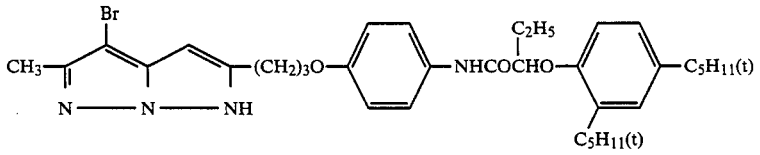
186
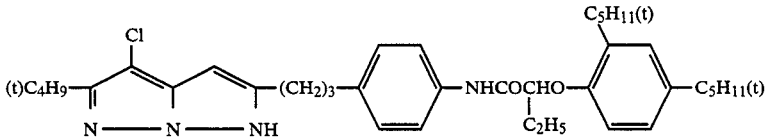
187
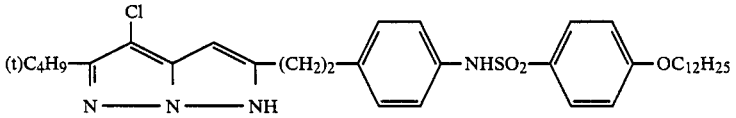

-continued
188
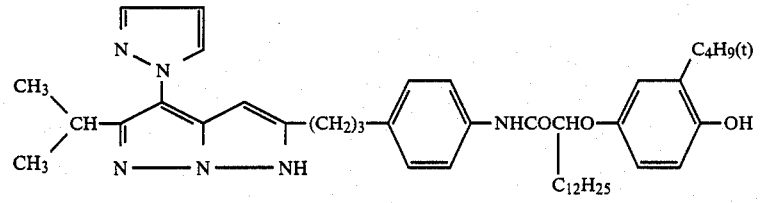
189
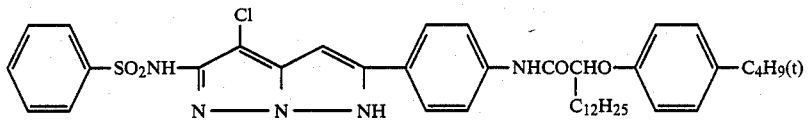
190
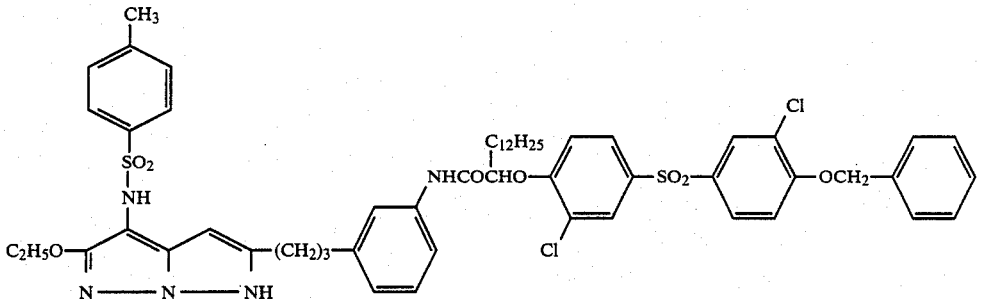
191
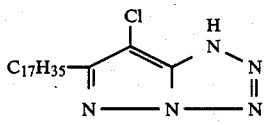
192
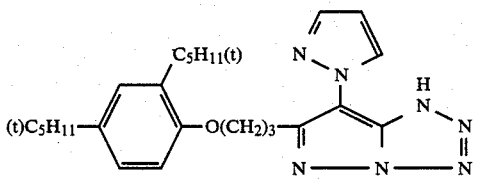
193
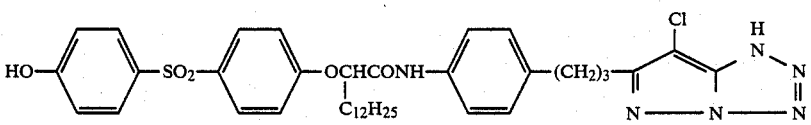
194
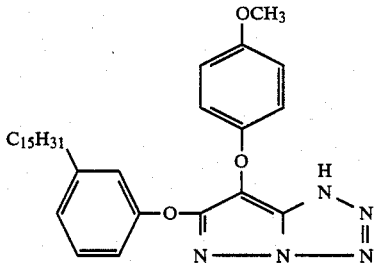
195
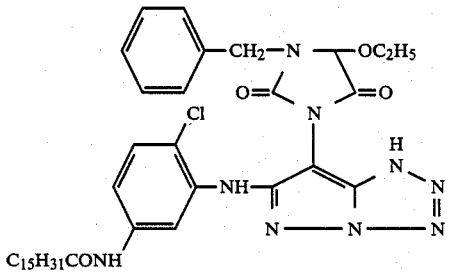

-continued

196

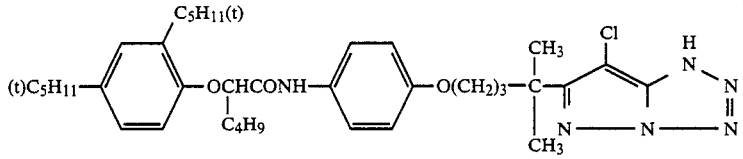

197

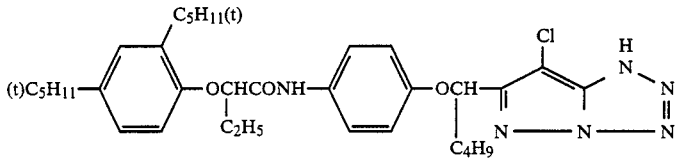

198

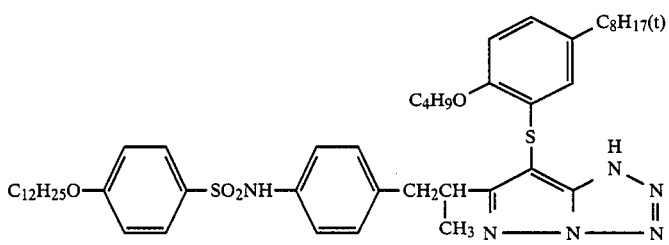

199

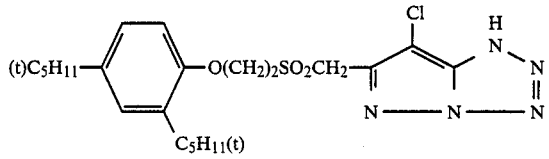

The synthesis of the above couplers was carried out with reference to Journal of the Chemical Society, Perkin, I.(1977), 2047–2052; U.S. Pat. No. 3,725,067; and Japanese Patent O.P.I. Puplication Nos. 99437/1984, 42025/1983, 162548/1984, 171956/1984, 33552/1985, and 43659/1985.

The couplers of the invention can usually be used within a range from $1\times10^3$ mol to 1 mol, preferably from $1\times10^2$ mol to $8\times10^1$ mol per mol of silver halide.

The couplers of the invention can be used also in combination with couplers of other types.

Each of the magenta couplers of the invention, which is represented by the general formula [I], can be contained in either a green-sensitive silver halide emulsion layer or a red-sensitive silver halide emulsion layer, but it is preferably contained in the green-sensitive silver halide emulsion layer.

In the emulsion layers of a silver halide color photographic light-sensitive material of the invention, there is used a dye-forming coupler which forms the dye by the coupling reaction with the oxidation product of a developing agent of aromatic primary amine type (for example, a derivative from p-phenylenediamine or aminophenol) in a color developing process. Such a dye-forming coupler is usually selected so that a dye which absorbs light-sensitive spectral light may be formed with respect to each of the emulsion layers; it is usual that a yellow dye-forming coupler is used into the blue-sensitive emulsion layer, a magenta dye-forming coupler into the green-sensitive emulsion layer, and a cyan dye-forming coupler into the red-sensitive emulsion layer.

As a yellow dye-forming coupler used in the invention, a compound represented by the following general formula [XII] is preferable:

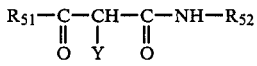

General formula [XII]

In the formula, $R_{51}$ is an alkyl group such as a methyl, ethyl, propyl or butyl group; or an aryl group such as a phenyl or p-methoxyphenyl group; RHD 52 is an aryl group; and Y is a hydrogen atom, or a group which is split off in the process of a color developing reaction.

As a yellow coupler which forms a dye image relating to the invention, a compound represented by the following general formula [XII'] is especially preferable:

General formula [XII']

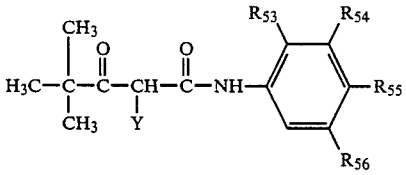

In the formula, $R_{53}$ is halogen atom, an alkoxy or an aryloxy group; each of $R_{54}$ $R_{55}$ and $R_{56}$ is a hydrogen or halogen atom, or an lakyl, alkenyl, alkoxy, aryl, aryloxy, carbonyl, sulfonyl, carboxyl, alkoxycarbonyl, carbamyl, sulfon, sulfamyl, sulfonamido, acidamido, ureido or amino group; and Y is a hydrogen atom, or a group which is split off in the process of the color developing reaction.

These compounds are described in, for example, the specification of U.S. Pat. Nos. 2,778,658, 2,875,057, 2,908,573, 3,227,155, 3,227,550, 3,253,924, 3,265,506, 3,277,155, 3,341,331, 3,369,895, 3,384,657, 3,408,194, 3,415,652, 3,447,928, 3,551,155, 3,582,322, 3,725,072, and 3,894,875; West German Patent O.P.I. Publication Nos. 1,547,868, 2,057,941, 2,162,899, 2,163,812, 2,213,461, 2,219,917, 2,261,361, and 2,263,875; Japanese Patent Examined Publication No. 13576/1974; and Japanese O.P.I. Publication Nos. 29432/1973, 66834/1973, 10736/1974, 122335/1974, 28834/1975 and 132926/1975.

As the cyan dye image-forming couplers used in the invention, phenolic or naphtholic cyan dye image-forming couplers of 4- or 2-equivalent type are typical, and they are substantially described in, for example, U.S. Pat. Nos. 2,306,410, 2,356,475, 2,362,598, 2,367,531, 2,369,929, 2,367,531, 2,369,929, 2,423,730, 2,474,293, 2,476,008, 2,498,466, 2,545,687, 2,728,660, 2,772,162, 2,895,826, 2,976,146, 3,002,836, 3,419,390, 3,446,622, 3,476,563, 3,737,316, 3,758,308, or 3,839,044; the British Pat. Nos. 478,991, 945,542, 1,084,480, 1,377,233, 1,388,024, or 1,543,040; or Japanese Patent O.P.I. Publication No. 37425/1972, 10135/1975, 25228/1975, 112038/1975, 117422/1975, 130441/1975, 6551/1976, 37647/1976, 52828/1976, 108841/1976, 109630/1978, 48237/1979, 66129/1979, 131931/1979 or 32071/1980.

As the cyan couplers used in the silver halide emulsions of the invention, the compounds represented by the following general formula [XIII] or [XIV] are preferable:

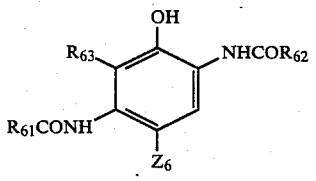

General formula [XIII]

In the formula, $R_{61}$ is an alkyl or aryl group; $R_{62}$ is an alkyl, cycloalkyl, aryl or heterocyclic group; $R_{63}$ is a hydrogen or halogen atom, or an alkyl or alkoxyl group, and $R_{63}$ may be linked with $R_{61}$ to form a ring; $Z_6$ is a hydrogen atom, or a group which can be split off with the reaction of the oxidation product of a color developing agent of aromatic primary amine type.

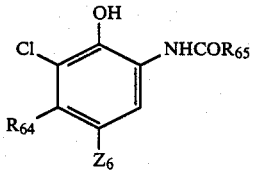

General formula [XIV]

In the formula, $R_{64}$ is a straight-chained or branched alkyl group with 1 to 4 carbon atoms; $R_{65}$ is a ballast group; and $Z_6$ is the same as $Z_6$ in the general formula [XIII]. $R_{64}$ is especially preferable to be a straight-chained or branched alkyl group with 2 to 4 carbon atoms.

In the invention, the alkyl groups represented by $R_{61}$ in the general formula [XIII] are straight-chained on branched, and those include, for example, a methyl, ethyl, iso-propyl, butyl, pentyl, octyl, nonyl or tridecyl group; and the aryl groups include, for example, a phenyl or naphthyl group. These groups represented by $R_{61}$ may alternatively have a single or plural number of substituent groups, for example, as a substituent group to be introduced into the phenyl group, a halogen atom (for example, a fluorine, chlorine or bromine atom), an alkyl group (for example, a methyl, ethyl, propyl, butyl or dodecyl group), a hydroxyl, cyano, nitro or alkoxy group (for example, methoxy or ethoxy group), an alkyosulfonamido group (for example, methylsulfonamido or octylsulfonamido group), an arylsulfonamido group (for example, phenylsulfonamido or naphtylsulfonamido group), an alkylsulfamoyl group (for example, phenylsulfamoyl group), an alkyloxycarbonyl group (for example, a methyloxycarbonyl group), an aryloxycarbonyl group (for example, a phenyoxycarbonyl group), an aminosulfonamido group (for example, a N,N-dimethylaminosulfonamido group), or an acylamino, carbamoyl, sulfonyl, sulfinyl, sulfoxy, sulfo, aryloxy, alkoxy, carboxyl, alkylcarbonyl or arylcarbonyl group.

These substituent groups may also be introduced into such a phenyl group by the different two or more types thereof.

The halogen atoms represented by $R_{63}$ are for example, a fluorine, chlorine or bromine atom; and the alkyl and alkoxy groups are respectively, for example, a methyl, ethyl, propyl, butyl on dodecyl group; and a methoxy, ethoxy, propyloxy or butoxy group. $R_{63}$ may be linked with $R_{62}$ to form a ring.

In the invention,, the alkyl groups represented by $R_{62}$ in the above general formula [XIII] are for example, a methyl, ethyl, butyl, hexyl, tridecyl, pentadecyl or heptadecyl group or the so called polyfluoroalkyl group substitued by a fluorine.

The aryl groups represented by $R_{62}$ are for example, a phenyl or naphtyl group, preferably a phenyl group; the heterocyclic groups represented by $R_{62}$ are for example, a pyridyl or furan group; and the cycloalkyl groups represented by $R_{62}$ are for example, a cyclopropyl or cyclohexyl group. These groups represented by $R_{62}$ may also have one or more substituent groups. For example, as substituent groups to be introduced into the phenyl groups, there are cited a halogen atom (for example, a fluorine, chlorine or bromine atom), an alkyl group (for example, a methyl, ethyl, propyl, butyl or dodecyl group), a cyano or nitro group, an alkoxy group (for example, a methoxy, or ethoxyl group), an alkylsulfonamido group (for example, a methylsulfonamido, or octylsulfonamido group), an arylsulfonamido group (for example, a phenylsulfonamido, or naphtylsulfonamido group), an alkylsulfonamoyl group (for example, a butylsulfamoyl group), an arylsulfamoyl group (for example, a phenylsulfamoyl group), an alkyloxycarbonyl group (for example, a methyloxycarbonyl group), an dryloxycarbonyl group (for example, a phenyloxycarbonyl group), an aminosulfonamido, acylamino, carbamoyl, sulfonyl, sulfinyl, salfoxy, sulfo, aryloxy, alkoxy, carboxyl, alkylcarbonyl, or arylcarbonyl group. These substituent groups may also be introduced into the phenyl group by different two or more types.

The group represented by $R_{62}$ is preferably a polyfluoroalkyl group, a phenyl group; or a phenyl group bearing one or more of a halogen atom or alkyl, alkoxy, alkylsulfonamido, arylsulfonamido, alkylsulsulfamoyl, arylsulfamoyl, alkylsulfonyl, arylsulfonyl, alkylcarbonyl or arylcarbonyl group as substituent groups.

In the invention, the straight-chained or branched alkyl group with 1 to 4 carbon atoms represented by $R_{64}$ in the above general formula (XIV) are, for example, an ethyl, propyl, butyl, iso-propyl, sec-butyl, or tert-butyl group, and they may also bear a substituent group, which may be an acylamino (for example, acetylamino) group, or an alkoxy (for example, methoxy) group.

$R_{64}$ is preferably unsubstituted.

The ballast groups represented by $R_{65}$ are an organic group which has a size and shape that gives the molecule of the coupler a bulk sufficient to substantially prevent the coupler from diffusing to other layers from the layer to which the coupler is applied.

As such ballast groups, there are cited typically alkyl or aryl groups each with 8 to 32 carbon atoms.

These alkyl or aryl groups may have substituent groups. As the substituent groups for the aryl groups, there are cited, for example, an alkyl, aryl, alkoxy, aryloxy, carboxy, acyl, ester, hydroxy, cyano, nitro carbamoyl, carbonamido, alkylthio, arylthio, sulfonyl, sulfonamido, or sulfamoyl group, and a halogen atom. As the substituent groups for the alkyl groups, there are cited the above substituent groups for the aryl groups, except the alkyl groups.

Substituent groups especially preferably for such a ballast group are those represented by the following general formula [XV]:

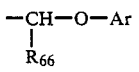

General formula [XV]

In the formula, $R_{66}$ is a hydrogen atom, or an alkyl group with 1 to 12 carbon atoms; and Ar is an aryl group such as a phenyl group. These aryl groups may have substituent groups. As such substituent groups, there are cited, for example, an alkyl, hydroxy, or alkylsulfonamido group, but the especially preferable ones are branched alkyl groups such as a tertbutyl group.

In the general formulas [XIII] and [XIV], the groups (represented by $Z_6$) which can be split off by the reaction with the oxidation product of a color developing agent of aromatic primary amine type, as well known in the art, and groups which exhibit advantageous functions of development and bleach inhibition, color compensation, etc., in the coated layers or other layers which contain the coupler in the silver halide photographic light-sensitive material by modifying the reactivity of the coupler, or by splitting off from the coupler. As such groups, there are cited, typically, a halogen atom represented by chlorine or fluorine, and a substituted or unsubstituted alkoxy, aryloxy, arylthio, carbamoyloxy, acyloxy, sulfonyloxy, sulfonamido, heteroylthio, or heteroyloxy group. The especially preferable groups represented by $Z_6$ are a hydrogen or chlorine atom.

Further substantially, these groups are described in Japanese Patent O.P.I. Publication No. 10135/1975, 120334/1975, 130441/1975, 48237/1979, 146828/1976, 14736/1976, 37425/1972, 123341/1975,or 95346/1983; Japanese Patent Examined Publication No. 36894/1973, or U.S. Pat. No. 3,476,563, 3,737,316 or 3,227,551.

Typical samples of the cyan couplers represented by general formula (XIII) are shown as follows, but the invention shall not be limited to them:

C-1

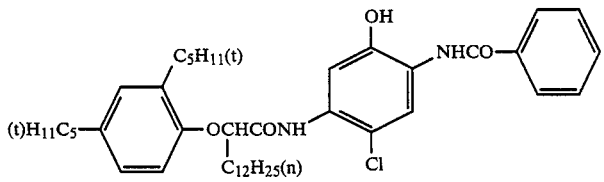

C-2

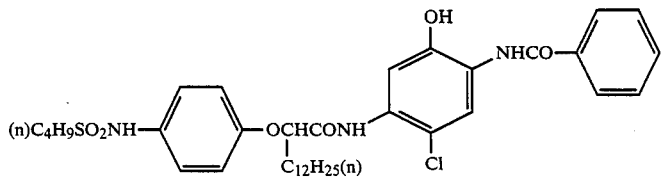

-continued
C-3
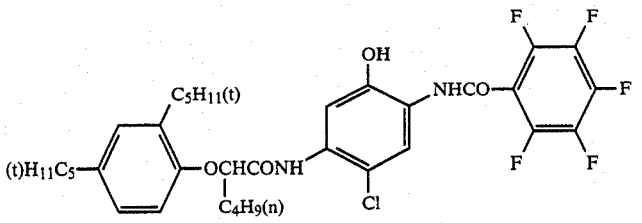
C-4
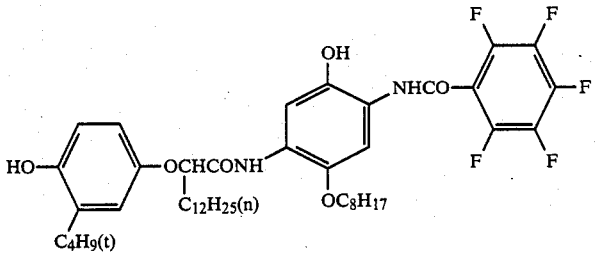
C-5
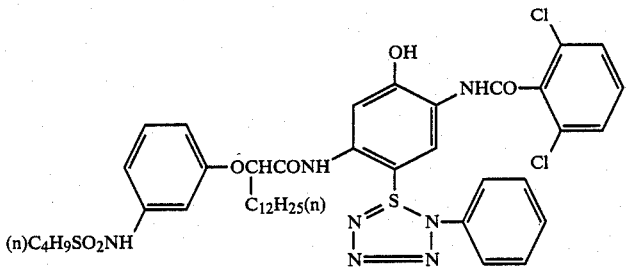
C-6
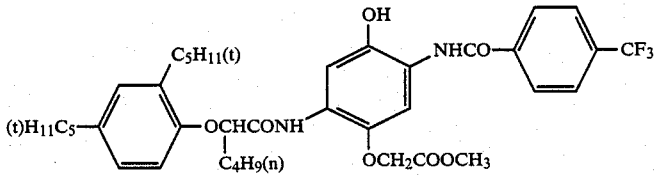
C-7
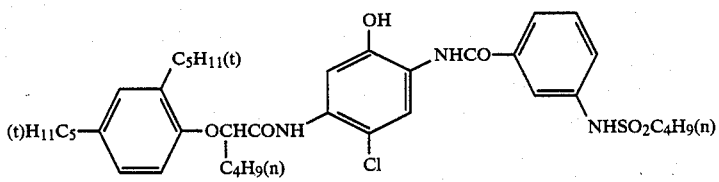
C-8
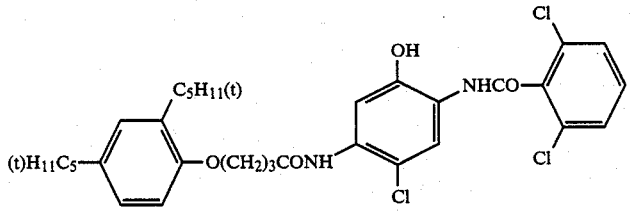
C-9
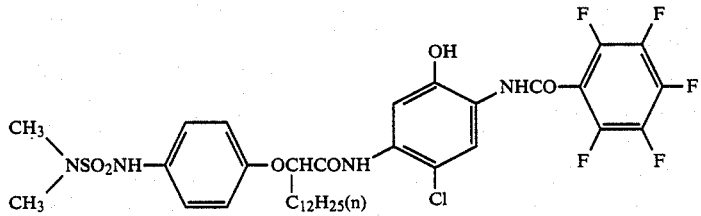

-continued
C-10
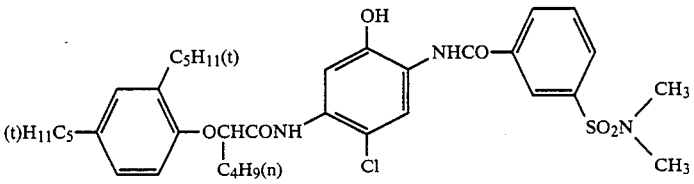
C-11
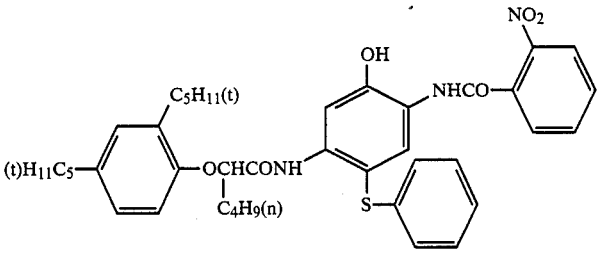
C-12
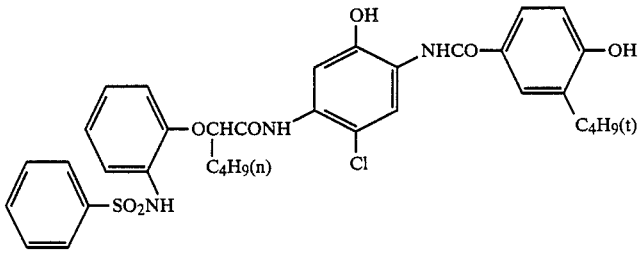
C-13
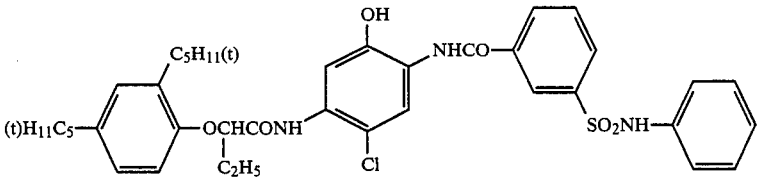
C-14
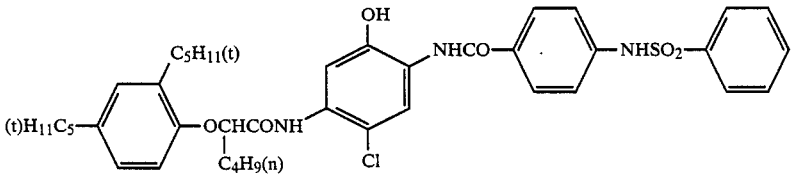
C-15
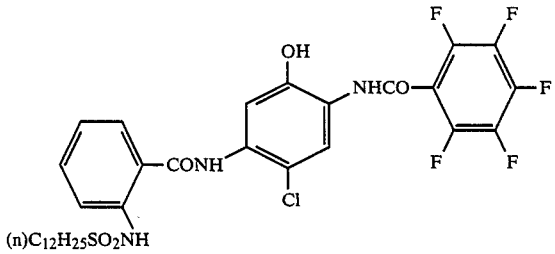
C-16
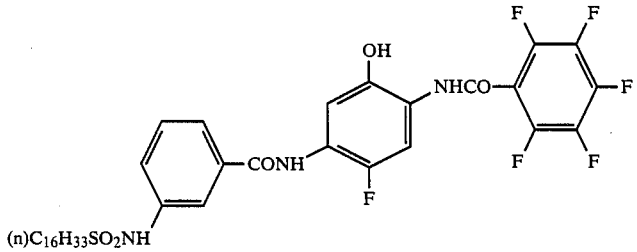

-continued
C-17
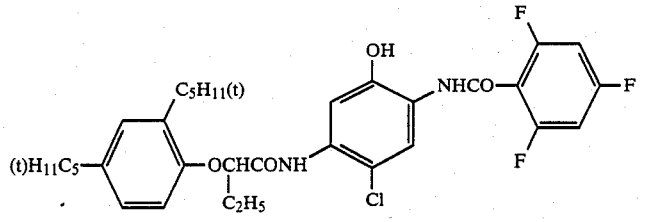
C-18
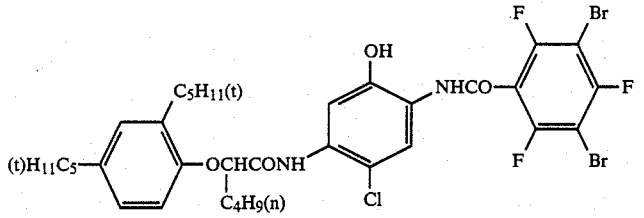
C-19
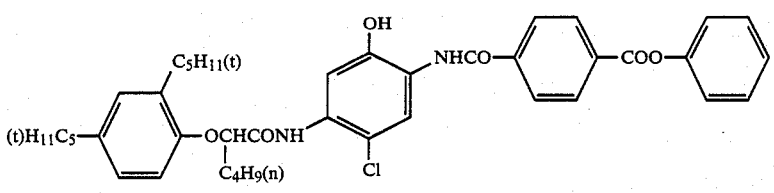
C-20
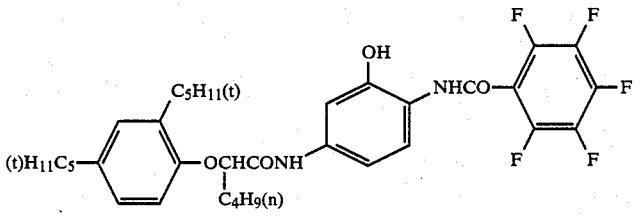
C-21
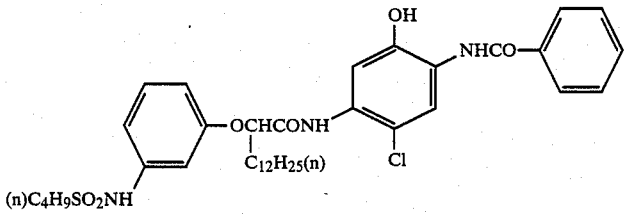
C-22
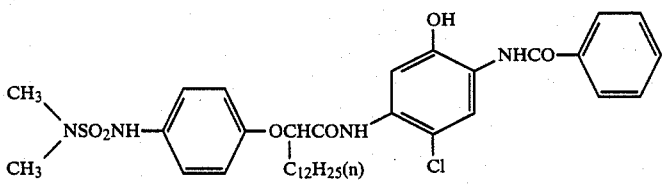
C-23
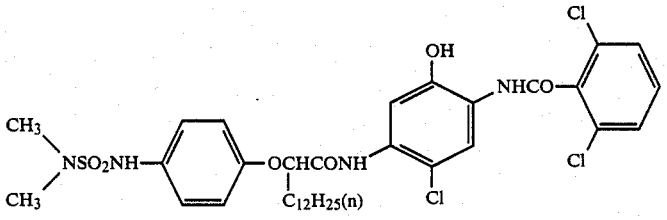

-continued
C-24
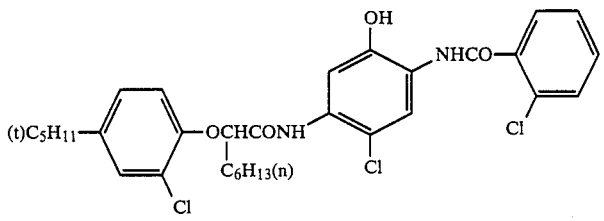
C-25
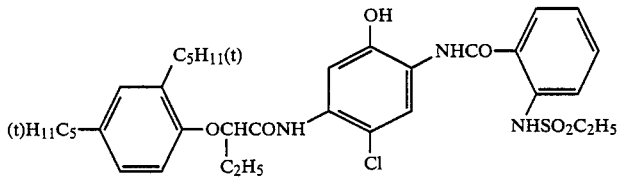
C-26
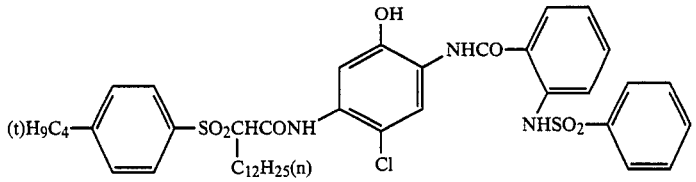
C-27
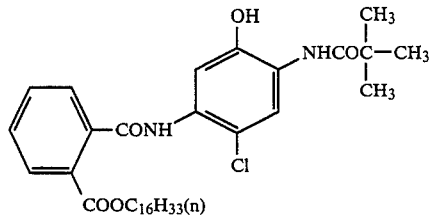
C-28
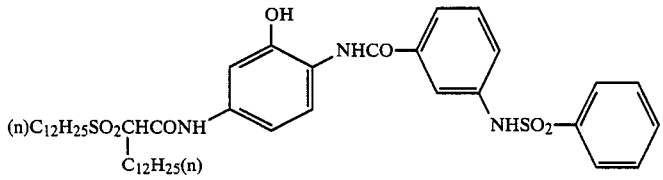
C-29
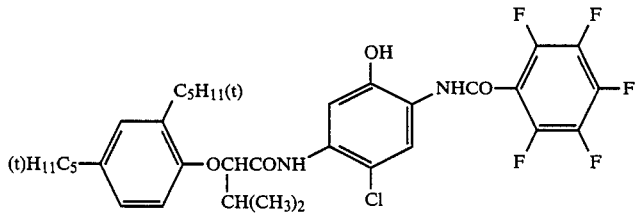
C-30
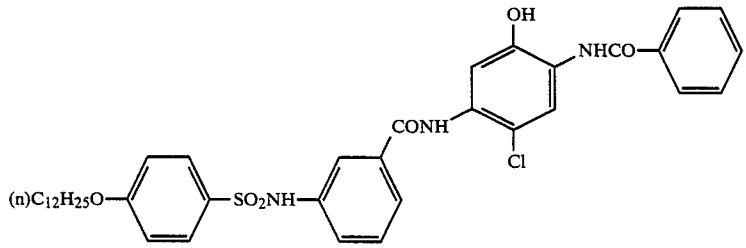

-continued
C-31
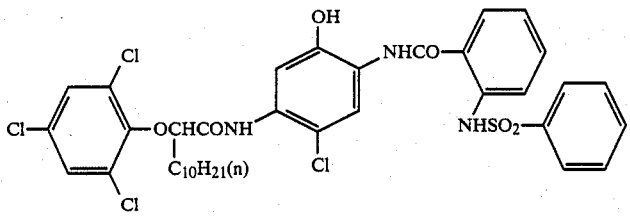
C-32
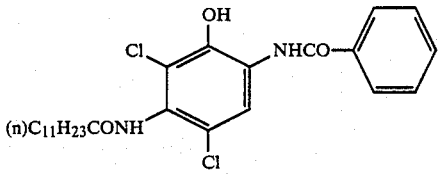
Typical samples of couplers represented by general formula (XIV) are shown as follows, but the invention is not limited to them:
General formula (XIV)
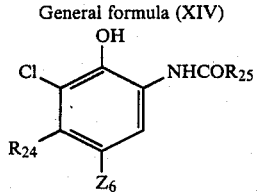
| Coupler No. | $R_{24}$ | $Z_6$ | $R_{25}$ |
|---|---|---|---|
| C-33 | $-C_2H_5$ | $-Cl$ | 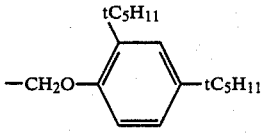 |
| C-34 | $-C_2H_5$ | 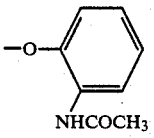 | 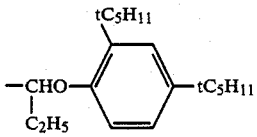 |
| C-35 | 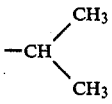 | $-Cl$ | 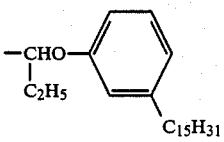 |
| C-36 | $-C_2H_5$ | $-Cl$ | 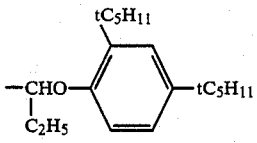 |
| C-37 | $-C_2H_5$ | $-Cl$ | 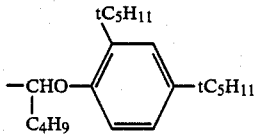 |

-continued
General formula (XIV)
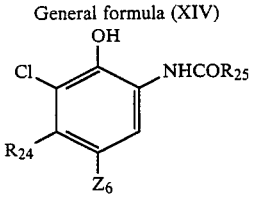
| Coupler No. | $R_{24}$ | $Z_6$ | $R_{25}$ |
|---|---|---|---|
| C-38 | $-C_4H_9$ | $-F$ | 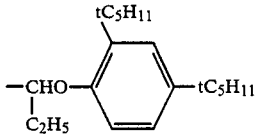 |
| C-39 | $-C_2H_5$ | $-F$ | 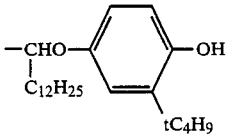 |
| C-40 | $-C_2H_5$ | $-Cl$ | 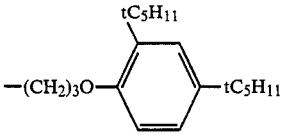 |
| C-41 | $-C_2H_5$ | $-F$ | 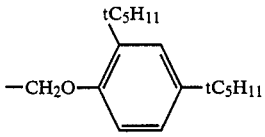 |
| C-42 | $-CH_3$ | $-Cl$ | 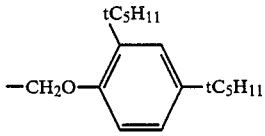 |
| C-43 | $-C_2H_5$ | $-Cl$ | 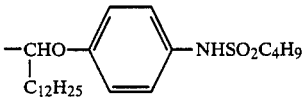 |
| C-44 | $-C_2H_5$ | $-Cl$ | 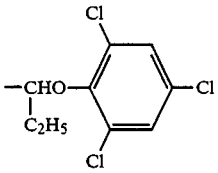 |
| C-45 | $-CH(CH_3)_2$ | $-Cl$ | $-C_{18}H_{37}$ |
| C-46 | $-C_2H_5$ | $-F$ | 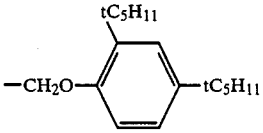 |
| C-47 | $-CH_3$ | $-Cl$ | 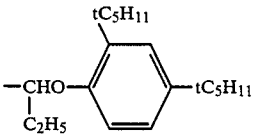 |

-continued

General formula (XIV)

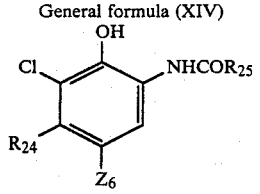

| Coupler No. | $R_{24}$ | $Z_6$ | $R_{25}$ |
|---|---|---|---|
| C-48 | $-C_2H_5$ | $-Cl$ | 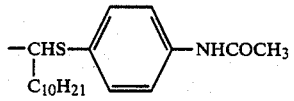 |
| C-49 | $-C_3H_7$ | $-Cl$ | 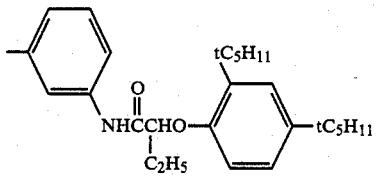 |
| C-50 | $-C_3H_7$ | $-Cl$ | 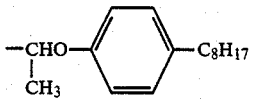 |
| C-51 | $-C_2H_4NHCCH_3$ ‖ O | $-Cl$ | 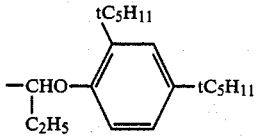 |
| C-52 | $-C_3H_6OCH_3$ | $-Cl$ | 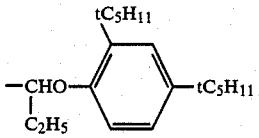 |

In order to make the magenta coupler of the invention, and the above-mentioned yellow coupler or cyan coupler contained in the emulsion, each of couplers of the invention is, singly or in the form of a mixture, dissoved into a single high-boiling organic solvent (for example, a phthalate ester such as dibutyl phthalate and dioctyl phthalate; a phosphate ester such as tricresyl phosphate, triphenyl phosphate, trioctyl phosphate; or a N,N-dialkyl-substituted amide such as N,N-diethyllauroylamide), a single low-boiling organic solvent (for example, ethyl acetate, butyl acetate, or buthyl propionate), or the mixture of them is necessary. The obtained solution is mixed with an aqueous gelatin solution containing a surface active agent, and emulsified and dispersed using a high speed rotary mixer, colloid mill, or ultrasonic dispersing machine, and added to a silver halide to prepare the silver halide emulsion.

The sensitizing dye which gives the silver halide emulsions of the invention a maximum value of color sensitized spectral sensitivity range of wave length not less than 450 nm and less than 500 nm, may be any spectral sensitizing dye, so long as it gives the maximum value to the range of wave length not less than 450 nm and less than 500 nm, but it is preferably a sensitizing dye represented by the following general formula [A] or [B]:

General Formula [A]

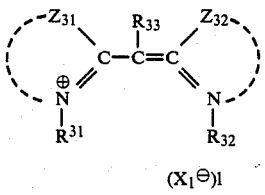

In the formula, each of $Z_{31}$ and $Z_{32}$ is a group of atoms which is necessary to form a benzoxazole, naphthoxazole, benzothiozole, naphthothiazole, benzoselenazole, naphthoselenazole, benzoimidazole, naphthoimidazole, pyridine, or quinoline nucleus. Each of $R_{31}$ and $R_{32}$ is an alkyl, alkenyl, or aryl group; $R_{33}$ is a hydrogen atom, or a methyl or ethyl group; $X_1\ominus$ is an anion; and l is 0 (zero) or 1.

General formula [B]

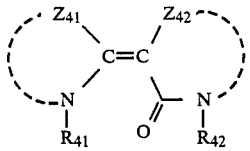

In the formula, $Z_{41}$ is a group of atoms which is necessary to form a benzoxazole, naphthoxazole, benzothiazole, naphthothiazole, benzoselenazole, naphthoselenazole, benzoimidazole, or naphthoimidazole nucleus. $Z_{42}$ is a group of atoms which is necessary to form a rhodanine, 2-thiohydantoin, or 2-thioselenazoline-2, 4-dione nucleus. Each of $R_{41}$ and $R_{42}$ is an alkyl, alkenyl, or aryl group.

In the general formula [A], each of $R_{31}$ and $R_{32}$ independently is an alkyl, alkenyl, or aryl group, but is preferably an alkyl group, and is further preferably an carboxyalkyl or sulfoalkyl group, especially a sulfoalkyl group with 1 to 4 carbon atoms. $R_{33}$ is a hydrogen atom, or a methyl or ethyl group.

While the above group of atoms represented by $Z_{31}$ or $Z_{32}$ may be substituted with a substituent group. Such a substituent group is preferably, for example, a halogen atom, or a hydroxyl, cyano, aryl, alkyl, alkoxy, or alkoxycarbonyl group. The further preferable substituent group is a halogen atom, or a cyano or aryl group, or an alkyl or alkoxy group with 1 to 6 carbon atoms; especially a halogen atom, or a cyano, methyl, ethyl, methoxy or ethoxy group.

In the general formula [B], the above group of atoms represented by $Z_{41}$ may be substituted with various substituent groups. Such a substituent group is preferably a halogen atom, or a hydroxyl, cyano, aryl, alkyl, alkoxy or alkoxycarbonyl group; and further preferably a halogen, a cyano or aryl group, or an alkyl (for example, a methyl or ethyl) or alkoxy (for example, a methoxy or ethoxy) group with 1 to 6 carbon atoms.

When $Z_{42}$ is a 2-thiohydantoine nucleus, the nitrogen atom of its 1-position may be substituted with a substituent group. Such a substituent group is preferably an alkyl, hydroxyalkyl, or alkoxycarbonyl group.

Each of $R_{41}$ and $R_{42}$ is a group selected from alkyl, alkenyl and aryl groups, and it may be substituted with a substituent group. Such substituent groups are preferably an alkyl or aryl group, and further preferably an alkyl group with 1 to 4 carbon atoms, or a sulfoalkyl, carboxyalkyl, phenylalkyl (for example, benzyl), alkoxyalkyl (for example, 2-methoxyethyl or 3-methoxypropyl), or alkoxycarbonylalkyl (for example, methoxycarbonylpropyl) group.

The sensitizing dyes used in the invention are further preferably the one represented by the general formula [A].

Embodied samples of the sensitizing dyes used in the invention are shown as follows, but the invention shall not be limited to them.

General formula [A]

-continued

A-1

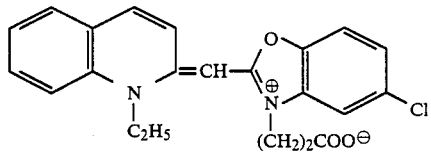

A-2

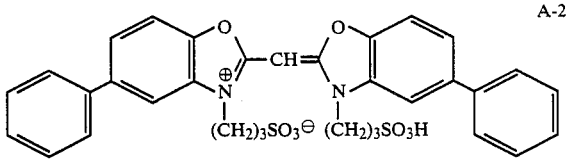

A-3

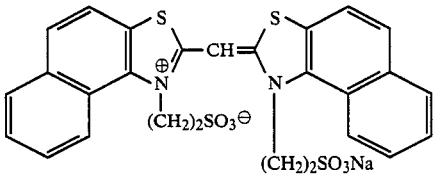

A-4

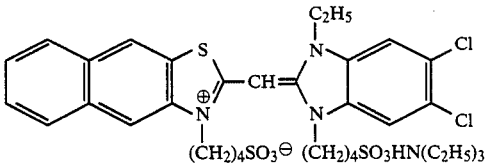

A-5

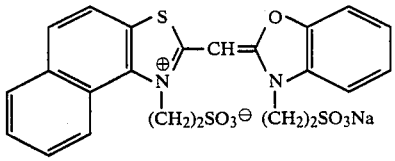

A-6

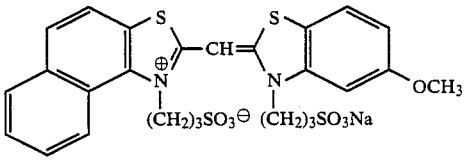

A-7

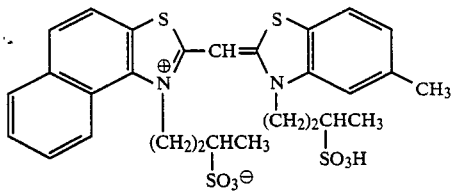

A-8

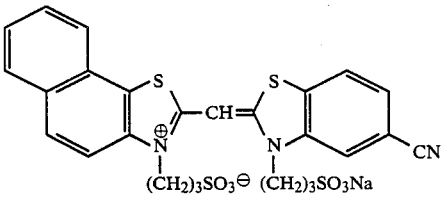

A-9

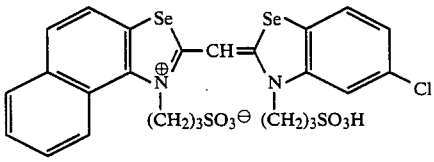

-continued
A-10
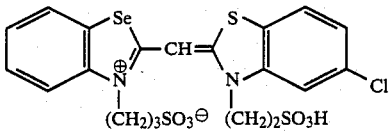
A-11
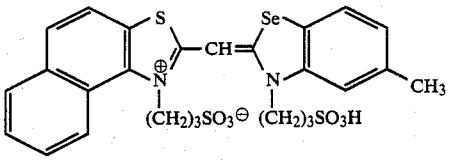
A-12
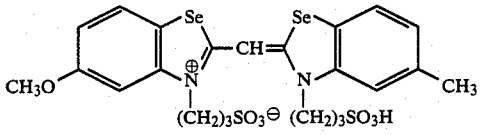
A-13
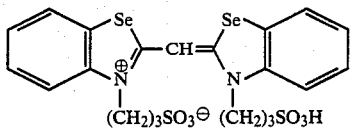
A-14
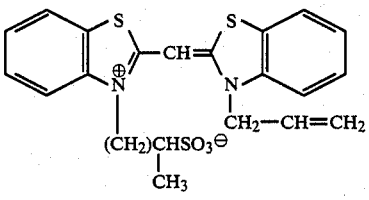
A-15
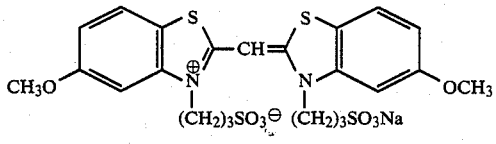
A-16
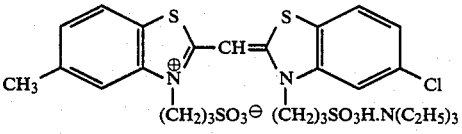
A-17
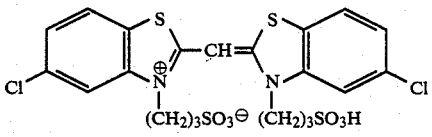
A-18
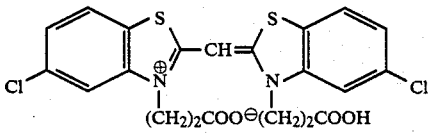
-continued
A-19
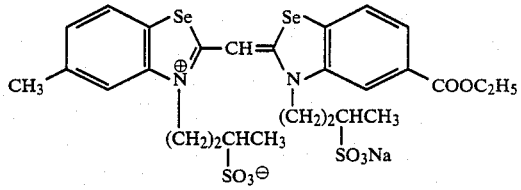
A-20
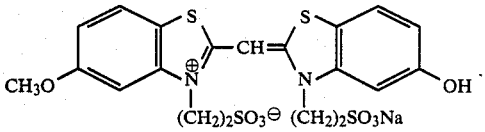
A-21
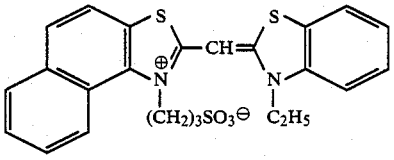
A-22
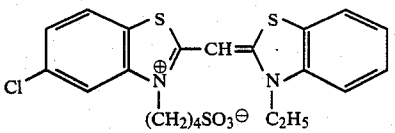
A-23
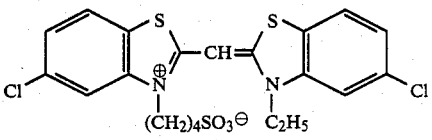
General formula [B]
B-1
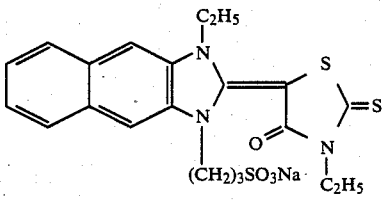
B-2
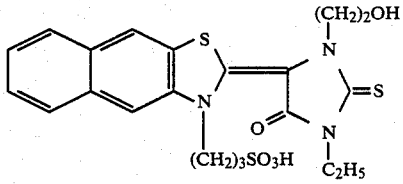
B-3
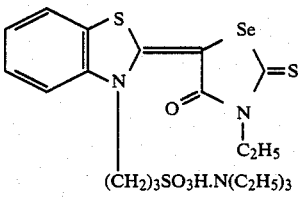

-continued

B-4

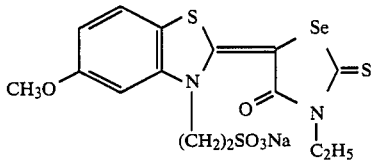

B-5

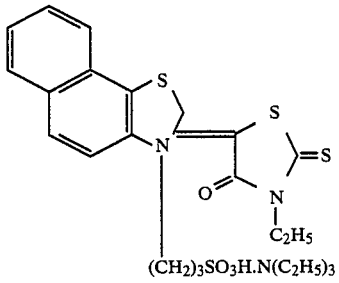

B-6

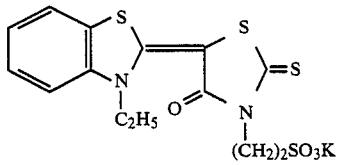

B-7

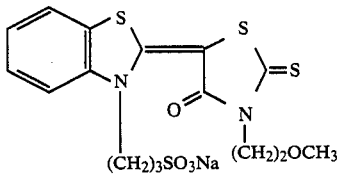

B-8

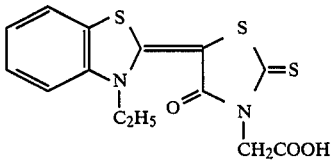

B-9

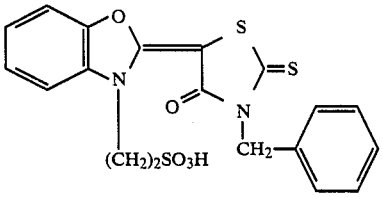

B-10

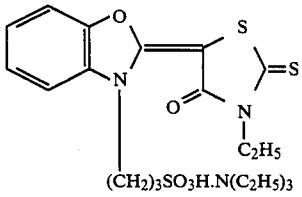

B-11

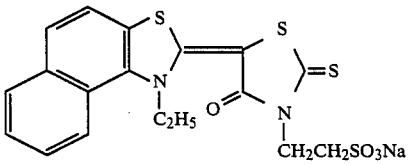

-continued

B-12

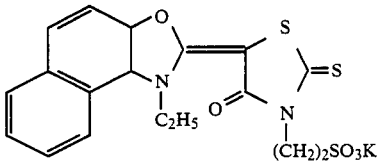

The sensitizing dyes of the invention, which are represented by the general formula [A] [B], are well known, and readily synthesized according to the methods described in, for example, F. M. Hamer: The Chemistry of Heterocyclic Compounds, Vol. 18, The Cyanine Dye and Related Compounds, published by A. Weissbergered Interscience, New York, 1964.

The adding amount of the sensitizing dyes used in the invention is not particularily limited, but preferably $5\times10^{-6}$ to $5\times10^{-3}$ mol per mol of a silver halide used.

The addition of the sensitizing dyes of the invention to the emulsion may be carried out in various ways well-known in the art.

For example, the sensitizing dye can be added to the emulsion by that it is dispersed directly into an emulsion; that its aqueous solution is added into the emulsion; or that it is dissolved into a water-soluble solvent such as pyridine, methyl alcohol, methyl cellosolve, and acetone, or their mixture, and diluted with water, and then added into an emulsion. Further, it is advantageous that it is dissolved using ultrasonic vibration. Furthermore, as described in, for example, U.S. Pat. No. 3,469,987, the sensitizing dye is added to an emulsion by that it is first dissolved into a volatile organic solvent, and the obtained solution is dispersed into a hydrophilic colloid, and then the obtained dispersion is added into the emulsion. The method described in, for example, Japanese Patent Examined Publication No. 24185/1971, is also useful that a water-insoluble sensitizing dye is not dissolved, but dispersed into a water-soluble solvent, and the obtained dispersion is added into an emulsion. The above-mentioned sensitizing dye can be also added to the emulsion in the form of dispersion that is prepared in an acid dissolving-dispersion process. In addition, methods described in, for example, U.S. Pat. Nos. 2,912,345, 3,342,605, 2,996,287, and 3,425,835 are also useful for the addition of the sensitizing dye into an emulsion.

The point of time when the sensitizing dye is to be added to an emulsion may be at any stage of the preparation process of the emulsion, but preferably during or after the chemical ripening. It may be added to a coating solution provided that its amount is so small that no residual color stain comes out problematical.

Each of the sensitizing dyes of the invention may be used singly or in combination of two or more of them. When two or more sensitizing dyes are used combinedly, they may be added either simultaneously or separately. In case of a separate addition, the adding order, times, and intervals can be optional according to the purpose.

While the grain size distribution of a silver halide may be of either poly or monodisperse system, the emulsion used is preferably a polydisperse emulsion. The polydisperse emulsion herein is referred to an emulsion in which the coefficient of variation of grain size of silver halide contained therein is not more than 22%, preferably not more than 15%. Such a coefficient of variation is a coefficient which indicates the extent of a grain size distribution, and is defined as follows:

$$\text{Coefficient of variation} = \frac{\text{S.D. of grain size distribution}}{\text{Average grain size}} \times 100(\%)$$

$$\text{S.D. of grain size distribution} = \sqrt{\frac{\Sigma(\bar{r} - r_i)^2 n_i}{\Sigma n_i}}$$

$$\text{Average grain size} = \frac{\Sigma n_i r_i}{\Sigma n_i} = r$$

where, $r_i$ is the grain size of an individual grain; and $n_i$ is the number of individual grains. The average grain size r is the mean value of the grain diameters when each silver halide grain is spherical, and that of the diameters of a circular image which has the same area as the projected image area of an individual grain when each silver halide grain is cubic or other than spherical, and it is indicated by the above formula, when the grain size of an individual grain is $r_i$, and the number of the individual grains is $n_i$.

The above grain size can be measured using various methods generally applied to the art for the above-mentioned purpose. Typical methods is described in Loveland. "Analytical Method for Particle Size", (A.S.T.M. Symposium on Light Microscopy), 1955, pp. 94–122; or Mees and Jmes., 'The Theory of The Photographic Process', 3rd Ed., McMillan, 1966, Chapter 2.

The above grain size can be determined according to the method described in the article by Trivelli and Smith in The Photographic Journal, Vol. IXXIX, 1949, pp. 330–338.

The composition of the silver halide grains contained in the silver halide emulsions of the invention shall not particularly be limited, but is preferably low in silver iodide content and substantially composed of silver chlorobromide. The emulsion substantially containing silver chlorobromide is herein referred to an emulsion in which the silver halide is composed of less than 1 mol% of silver iodide and the rest, silver chloride and silver bromide, but preferably the emulsion in which a silver chloride content in the silver halide grains is not less than 5 mol%, and preferably not less than 15 mol%.

The crystal habit of the silver halide grain contained in a silver halide emulsion of the invention is allowed to be in any form, but especially preferably in an octahedron mainly with a [111] face.

The crystal face of the silver halide grain is defined, according to the powder X-ray diffraction analysis described in Japanese Patent O.P.I. Publication No. 20243/1984, by a diffraction intensity ratio of a [200] face correspondent to a [100] face, to a [222] face correspondent to a [111] face, that is, $$K = \frac{\text{Intensity of diffraction ray attributed to a [200] face}}{\text{Intensity of diffraction ray attributed to a [222] face}}$$

As to the silver halide emulsion, it is desirable to contain silver halide grains ranging within $K < 3$, preferably $K \leqq 1.5$.

In the silver halide grains contained in the silver halide emulsion of the invention, a latent image may be formed mainly either on a grain surface or to the inside thereof.

However, to fully exhibit the effect of the invention, it is desirable to use silver halide grains of the type which mainly form a laent image on their surfaces, in the state before the chemical ripening after the formation of silver halide grains, or in the state of the final formation of silver halide grains when a chemical sensitization is carried out during the formation of silver halide grains.

Concretely, the silver halide grains can be evaluated according to the method described in Japanese Patent Examined Publication No. 34213/1977. That is, a silver halide emulsion containing silver halide grains to be evaluated is applied onto a polyethylene support at a rate of 40 mg per $dm^2$ to make a sample. The sample is exposed using a 500 watt tungsten lamp for a given time of $1 \times 10^{-2}$ to 1 second with a light-intensity scale. Then, the sample is tested according to the usual photographic testing technique by developing it for 5 minutes at 65° F. in the developer Y (an 'internal' type developer) described below. On the other hand, another sample similar to the above-mentioned one is exposed in the same way, and developed for 6 minutes at 65° F. in the developer X (a 'surface' type developer). Both samples are compared with each other in their maximum concentration. Thus, a silver halide emulsion containing silver halide grains that give the maximum concentration for the former is less than 5 times, preferably less than 2 times of that of the latter is adopted.

| | |
|---|---|
| (Developer X) | |
| N—methyl-p-aminophenol sulfate | 2.5 g |
| Ascorbic acid | 10.0 g |
| Potassium metaborate | 35.0 g |
| Potassium bromide | 1.0 g |
| Water | to make 1000 ml |
| | (PH = 9.6) |
| (Developer Y) | |
| N—methyl-p-aminophenol sulfate | 2.0 g |
| Sodium sulfite, dried | 90.0 g |
| Hydroquinone | 8.0 g |
| Sodium carbonate, monohydrous | 52.5 g |
| Potassium bromide | 5.0 g |
| Potassium iodide | 0.5 g |
| Water | to make 1000 ml |

The silver halide emulsion used in the invention can be chemically ripened in the usual ways employed in the art. For example, there can be used the method described in Mees, 'The Theory of The Photographic Process' or various other conventional methods. That is, each of the following compounds and methods can be used singly or in combination:

Sulfur-containing compounds which can react with silver ion (for example, thiosulfates or compounds described in U.S. Pat. Nos. 1,574,944, 2,278,947, 2,410,689, 3,189,458 and 3,501,313; and French Pat. No. 2,059,245);

Sulfur sensitizing methods;

Reducible substances (for example, stannous salts described in U.S. Pat. No. 2,487,850;

Amines desribed in U.S. Pat. Nos. 2,518,698, 2,521,925, 9,521,926, 2,419,973 and 2,419,975;

Iminoaminomethanesulfonic acid described in U.S. Pat. No. 2,983,610;

Silane compounds described in U.S. Pat. No. 2,694,637;

Reduction sensitizing method described by H. W. Wood in Journal of Photographic Science, Vol. 1, 1953, pp. 163-;

A gold sensitizing method using a gold complex salt or a gold thiosulfate complex describe in U.S. Pat. No. 2,399,083; and, A noble metal sensitizing method using alloys described in U.S. Pat. Nos. 2,448,060, 2,540,086, 2,566,245 and 2,566,263.

Instead of the sulfur sensitizing method described in U.S. Pat. No. 3,297,446, there can be used the selenium sensitizing method described in the same patent.

In the invention, there may be used the mixture of two or more silver halide emulsions which have been prepared separately. The mixing of such two or more emulsions may be carried out at any stage, but is to preferably be carried out after an optimum chemical sensitization is completed, respectively.

The silver halide emulsions of the invention may contain various compounds for the purpose of antifogging during the preparation and preservation thereof, and stabilizing the photographic characteristics thereof.

Thus, the silver halide emulsion of the invention can be added with various compounds known as a stabilizer or antifoggant including, for example, a tetrazaindene, an azole compound such as a benzothiazolium salt, a nitroindazole, a nitrobenzimidazole, a chlorobenzimidazole, a bromobenzimidazole, a mercaptothiazole, a mercaptobenzimidazole, an aminotriazole, a benzotriazole, a nitrobenzotriazole, a mercaptotetrazole (especially 1-phenyl-5-mercaptotetrazole), a mercaptopyrimidine, a mercaptotriazine (for example, such a thioketo compound as an oxazolythione), benzenethiosulfinic acid, a benzenesulfonamide, a hydroquinone derivative, an aminophenol derivative, a gallic acid derivative and an ascorbic acid derivative.

The silver halide grains used in the silver halide emulsions of the invention may be obtained in an acid, neutral or ammonia process. Such grains may be grown either at one time or after makig seed particles. Methods each for making and growing seed particles may be either the same or different.

T make a silver halide emulsion, a halide ion and a silver ion may be added together simultaneously; alternatively, first one counterpart and then the other may be added. Further, silver halide crystals may be grown by adding the halide and silver ions concurrently and continuously under controlling a pH vaslue and a pAg value in a mixing kettle, giving consideration to the critical growing rate of crystals. After growing, it may be allowed to modify the halogen composition of grains in a conversion method.

If a solvent for a silver halide is used as it needs when a silver halide emulsion is prepared, the size and shape of grains, and the grain size distribution as well as the growing rate thereof can be controlled.

As for the silver halide grains used in the silver halide emulsion of the invention, metallic ions can be contained in the inside and/or surface of the grains in the process of formation and/or growth of the grains by using cadmium, zinc, lead, thalium and iridium salts or complex salts, thodium salts or complex salts, or iron salts or complex salts; and reduction sensitizing nuclei can be given to the inside and/or surface of each grain by placing the grains in an appropriate reductive atmosphere.

As for the silver halide emulsions of the invention, an unnecessary soluble salt may be either removed or left as it is after completing the growth of the grains thereof. Such salts can be removed in the method described in Research Disclosure No. 17643.

As for a silver halide grain used in the silver halide emulsions of the invention, the inside and surface of the grain may be composed of either similar or different layers.

As a binder (or a protective colloid) for the silver halide emulsions of the invention, the use of gelating is advanageous and, besides, synthetic hydrophilic colloids of other substances such as gelatin derivatives, graft polymers of gelatin/ other polymer, protein, carbohydrate derivatives, cellulose derivatives, homopolymers or copolymers can also be used.

The photographic emulsion layers and other hydrophilic colloidal layers in the light-sensitive materials of the invention are hardened by cross-linking with the binder (or the protective colloid) molecules or by the single or combined use of hardeners. The hardener is desirable to be added, to the light-sensitive material, in such an amount as that any further addition of the hardener to the processing solutions may be unnecessary to sufficiently harden the layers; however, the addition of the hardener to the processing solutions may also be possible.

Certain plasticizers can be added thereto, for the purpose of increasing the flexibility of a silver halide emulsion layer and/or other hydrophilic colloidal layers in the light-sensitive materials of the invention.

A dispersion (latex) of a water-insoluble or hardly soluble synthetic polymer can be contained in a photographic emulsion layer and other hydrophilic colloidal layers for the purpose of stabilizing the dimension of the layer or the like.

A certain anti-color foggant is used for the purpose of preventing a color turbidity, poor sharpness or noticeably rough graininess due to the transfer of the oxidation products of a developing agent, or of an electron transfer agent between the emulsion layers (i.e., between the smilar and/or different light-sensitive layers)

of the color photographic light-sensitive materials of the invention.

Such an anti-color foggant may be used either in the emulsion layers themselves, or in an interlayer which is interposed between two adjacent emulsion layers.

A certain image stabilizer can be used in the color light-sensitive material to prevent the deterioration of a dye image.

As the image stabilizers preferably used in the invention, there are cited the compounds represented by the following general formulas [A] through [H], [J] and [K].

Formula [C]:

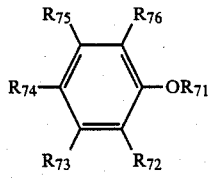

wherein $R_{71}$ represents hydrogen, an alkyl, alkenyl, aryl or heterocyclic group; $R_{72}$, $R_{73}$, $R_{75}$ and $R_{76}$ represent hydrogen, a halogen, a hydroxy, alkyl, alkenyl, aryl, alkoxy or acyamino group, respectively; and $R_{74}$ represents an alkyl, hydroxy, aryl or alkoxy group.

Further, $R_{71}$ and $R_{72}$ may close their rings to form a 5- or 6-membered ring, and when this is the case, $R_{74}$ represents a hydroxy or alkoxy group. Still further, $R_{73}$ and $R_{74}$ may close their rings to form a 5-membered hydrocarbon ring and when this is the case $R_{71}$ represents an alkyl, aryl or heterocyclic ring, provided that, however, $R_{71}$ is not hydrogen and $R_{74}$ is not a hydroxy group.

In the above-given Formula [C], $R_{71}$ represents hydrogen, an alkyl, alkenyl, aryl or heterocyclic group, however, among them, the alkyl groups are the normal chained or branch chained ones including, for example, a methyl, ethyl, propyl, n-octyl, tert-octyl, hexadecyl or the like group. The alkenyl groups represented by $R_{71}$ include, for example, an allyl, hexenyl, octenyl or the like group. Further, The aryl groups represented by $R_{71}$ include, for example, a phenyl or naphthyl group. Still further, the heterocyclic groups represented by $R_{71}$ typically include, for example, a tetrahydropyranyl, pyrimidyl or the like group. Each of the above-mentioned groups may be able to have a substituent. The alkyl groups having a substituent include, for example, a benzyl or ethoxymethyl group; the aryl groups having a substituent include, for example, a methoxyphenyl, chlorophenyl or 4-hydroxy-3,5-dibutylphenyl group, or the like groups.

In Formula [C], $R_{72}$, $R_{73}$, $R_{75}$ and $R_{76}$ represent hydrogen, a halogen, a hydroxy, alkyl, alkenyl, aryl, alkoxy or acylamino group and, among them, the alkyl, alkenyl and aryl groups include the same ones as those alkyl, alkenyl and aryl groups represented by $R_{71}$. The above-mentioned halogen include, for example, fluorine, chlorine, bromine and the like. Further, the above-mentioned alkoxy groups typically include, for example, a methoxy or ethoxy group, or the like group. Still further, the above-mentioned acylamino groups are represented by $R_{76}CONH$—, wherein $R_{76}$ represents an alkyl group such as a methyl, ethyl, n-propyl, n-butyl, n-octyl, tert-octyl or benzyl group, or the like groups; an alkenyl group such as an aryl, octynyl or oleyl group, or the like groups; an aryl group such as a phenyl, methoxyphenyl or nephthyl group, or the like groups; or a heterocyclic group such as a pyridyl or pyrimidyl group.

In Formula [C], $R_{74}$ represents an alkyl, hydroxy, aryl or alkoxy group and, among them, the alkyl and aryl groups typically include the same ones as those given for the alkyl and aryl groups represented by $R_{71}$; and the alkenyl groups represented by $R_{74}$ include the same ones as those given in the alkoxy groups represented by $R_{72}$, $R_{73}$, $R_{75}$ and $R_{76}$, respectively.

$R_{71}$ and $R_{72}$ may close the rings by each other to form a ring together with a benzene ring. Such rings include, for example, those of chroman, coumaran or methylenedioxybenzene.

$R_{73}$ and $R_{74}$ may close the rings by each other to form a ring together with a benzene ring. Such rings include, for example, those of indan. These rings may have such a substituent as that of an alkyl, alkoxy or aryl group.

$R_{71}$ and $R_{72}$ or $R_{73}$ and $R_{74}$ may close the ring to form a ring, and the atom in the formed ring may be a spiro atom to fproduce a spiro compound, or $R_{72}$, $R_{74}$ and the like may be a cross-coupling group to form a bis-substance.

The preferable phenol or phenylether compounds out of those represented by the afore-given Formula[C] are biindone compounds each having four $R_{77}$ O-groups in which $R_{77}$ represents an alkyl, alkenyl, aryl or heterocyclic group, and the particularly preferable ones are represented by the following Formula [C-1];

Formula [C-1]:

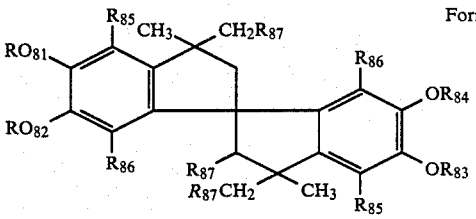

wherein $R_{81}$ to $R_{84}$ represents such an alkyl group as a methyl, ethyl, propyl, n-octyl, tert-octyl, benzyl or hexadecyl group; such an alkenyl group as an allyl, octenyl or oleyl group; such an aryl group as a phenyl or naphthyl group; or such a heterocyclic group as a tetrahydropyranyl or pyrimidyl group.

$R_9$ and $R_{86}$ represent hydrogen, such a halogen as fluorine, chloriine or bromine, such an alkyl group as a methyl, ethyl, n-butyl or benzyl group; such an alkoxy group as an allyl, hexenyl or octenyl group; or such an alkoxy group as a methoxy, ethoxy or benzyloxy group.

And, $R_{87}$ represents hydrogen, such as alkyl group as a methyl, ethyl, n-butyl or benzyl group; such an alkenyl group as a 2-propenyl, hexenyl or octenyl group; or such an aryl group as a phenyl, methoxyphenyl, chlorophenyl or naphthyl group.

The compounds represented by the aforegiven Formula [C] include those described in U.S. Pat. Nos. 3,935,016, 3,982,944 and 4,254,216; Japanese Patent O.P.I. Publication Nos. 21004/1980 and 145530/1979; British Pat. Nos. 2,077,455, and 2,062,888; U.S. Pat. Nos. 3,764,337, 3,432,330, 3,574,627 and 3,573,050; Japanese Patent O.P.I. Publication Nos. 152225/1977, 20327/1978, 17729/1978 and 6321/1977; British Pat. No. 1,347,556; British Patent Open to Public Inspection No. 2,066,975; Japanese Patent Examined Publication Nos. 12337/1979 and 31625/1973; U.S. Pat. No. 3,700,455; and the like.

An amount of the compounds represented by the Formula [C] to be used is preferably from 5 to 300 mol% and, more preferably, from 10 to 200 mol%, to an amount of magenta couplers to be used.

The typical examples of the compounds represented by Formula [C] will be given below:

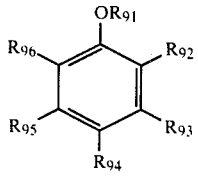

Type (1)

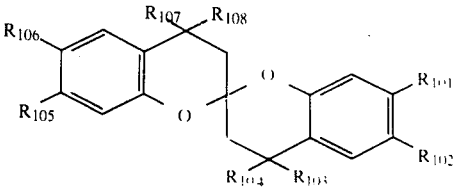

Type (2)

-continued

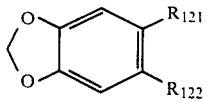

Type (4)

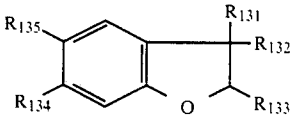

Type (5)

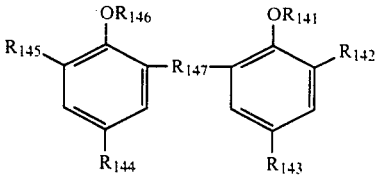

Type (6)

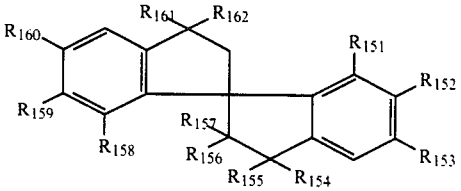

Type (7)

Type (1)

| Compound No. | $R_{91}$ | $R_{92}$ | $R_{93}$ | $R_{94}$ | $R_{95}$ | $R_{96}$ |
|---|---|---|---|---|---|---|
| c-1 | H | OH | $-C(CH_3)_2CH_2C(CH_3)_3$ | $CH_3O$ | H | $-C(CH_3)_2CH_2C(CH_3)_3$ |
| c-8 | $C_8H_{17}$ | $C(CH_3)_2C_2H_5$ | H | $C_8H_{17}O$ | $C(CH_3)_2C_2H_5$ | H |
| c-14 | H | H | OH | $C(CH_3)_2CH_2C(CH_3)_3$ | H | H |
| c-16 | H | $C(CH_3)_2C_3H_7$ | H | $CH_3O$ | $C(CH_3)_2C_3H_7$ | H |

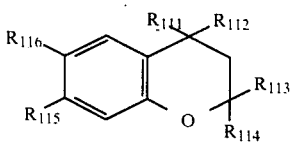

Type (3)

Type (20)

| Compound No. | $R_{101}$ | $R_{102}$ | $R_{103}$ | $R_{104}$ | $R_{105}$ | $R_{106}$ | $R_{107}$ | $R_{108}$ |
|---|---|---|---|---|---|---|---|---|
| c-2 | $CH_3$ | OH | $CH_3$ | $CH_3$ | $CH_3$ | OH | $CH_3$ | $CH_3$ |
| c-10 | $CH_3$ | $OCH_3$ | $CH_3$ | $CH_3$ | $CH_3$ | $CH_3O$ | $CH_3$ | $CH_3$ |

Type (3)

| Compound No. | $R_{111}$ | $R_{112}$ | $R_{113}$ | $R_{114}$ | $R_{115}$ | $R_{116}$ |
|---|---|---|---|---|---|---|
| c-3 | $CH_3$ | $CH_3$ | H | $CH_3$ | $(t)C_8H_{17}$ | OH |
| c-11 | $CH_3$ | $CH_3$ | H | $CH_3$ | $(t)C_8H_{17}$ | $C_8H_{17}O$ |
| c-12 | $CH_3$ | $CH_3$ | H | $CH_3$ | $CH_3$ | $O(CH_2)_2OC_{10}H_{21}$ |
| c-17 | H | $CH_3$ | $CH_3$ | $CH_3$ | $(t)C_8H_{17}$ | OH |
| c-18 | $CH_3$ | $CH_3$ | $CH_3$ | OH | $CH_3$ | OH |

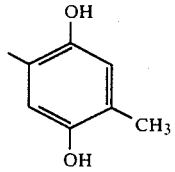

Type (4)

| Compound No. | $R_{121}$ | $R_{122}$ |
|---|---|---|
| c-4 | $C_3H_7$ | 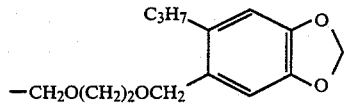 |
| c-9 | $C_3H_7$ | $-CH_2O(CH_2)_2OC_4H_9$ |

Type (5)

| Compound No. | $R_{131}$ | $R_{132}$ | $R_{133}$ | $R_{134}$ | $R_{135}$ |
|---|---|---|---|---|---|
| c-5 | $CH_3$ | $CH_3$ | $C_2H_5O$ | (t)$C_8H_{17}$ | OH |

Type (6)

| Compound No. | $R_{141}$ | $R_{142}$ | $R_{143}$ | $R_{144}$ | $R_{145}$ | $R_{146}$ | $R_{147}$ |
|---|---|---|---|---|---|---|---|
| c-6 | H | (t)$C_4H_9$ | $CH_3$ | $CH_3$ | (t)$C_4H_9$ | H | $CH_2$ |
| c-15 | $CH_3$ | (t)$C_4H_9$ | $CH_3$ | $CH_3$ | (t)$C_4H_9$ | $CH_3$ | $CH_2$ |

an alkyl, alkenyl, aryl, acyl, cycloalkyl or heterocyclic group; and $R_{173}$ represents hydrogen, a halogen, an alkyl, alkenyl, aryl, aryloxy, acyl, acyloxy, sulfonamido, cycloalkyl or alkoxycarbonyl group.

The above-given groups may be substituted by the other substituents, respectively. They include, for example, an alkyl, alkenyl, alkoxy, aryl, aryloxy, hydroxy, alkoxycarbonyl, aryloxycarbonyl, acylamino, acyloxy, carbamoyl, sulfonamido and sulfamoyl groups or the like.

Further, $R_{172}$ and $R_{173}$ may close the ring by each other to form a 5- or 6-membered ring. The rings formed together with the benzene ring closed by $R_{172}$ and $R_{173}$ include, for example, a chroman ring and a methylenedioxybenzene ring.

Y represents a group of atoms necessary for forming a chroman or couraman ring.

Such chroman or couraman ring may be substituted by a halogen, an alkyl, cycloalkyl, alkoxy, alkenyl, alkenyloxy, hydroxy, aryl or aryloxy group or a heterocyclic ring; and may further form a spiro ring.

Among the compounds represented by Formula [D], the compounds particularly useful in the invention include those represented by Formulas [D-171], [D-2], [D-3], [D-4] and [D-5]. Formula [D-1]:

Type (7)

| Compound No. | $R_{151}$ | $R_{152}$ | $R_{153}$ | $R_{154}$ | $R_{155}$ | $R_{156}$ | $R_{157}$ | $R_{158}$ | $R_{159}$ | $R_{160}$ | $R_{161}$ | $R_{162}$ |
|---|---|---|---|---|---|---|---|---|---|---|---|---|
| c-13 | H | $C_3H_7O$ | $C_3H_7O$ | $CH_3$ | $CH_3$ | H | H | H | $C_3H_7O$ | $C_3H_7O$ | $CH_3$ | $CH_3$ |
| c-19 | H | $CH_3O$ | $CH_3O$ | $CH_3$ | $CH_3$ | H | H | H | $CH_3O$ | $CH_3O$ | $CH_3$ | $CH_3$ |
| c-20 | $CH_3$ | $C_4H_9O$ | $C_4H_9O$ | $CH_3$ | $CH_3$ | H | H | $CH_3$ | $C_4H_9O$ | $C_4H_9O$ | $CH_3$ | $CH_3$ |
| c-21 | H | $C_2H_5O$ | $C_2H_5O$ | $CH_3$ | $CH_3$ | H | H | H | $C_2H_5O$ | $C_2H_5O$ | $CH_3$ | $CH_3$ |
| c-22 | H | $CH_3O$ | $CH_3O$ | $C_2H_5$ | $CH_3$ | H | $CH_3$ | H | $CH_3O$ | $CH_3O$ | $CH_3$ | $C_2H_5$ |
| c-23 | H | $C_7H_{15}COO$ | $C_7H_{15}COO$ | $CH_3$ | $CH_3$ | H | H | H | $C_7H_{15}COO$ | $C_7H_{15}COO$ | $CH_3$ | $CH_3$ |
| c-24 | H | $C_4H_9O$ | $C_4H_9O$ | $CH_3$ | $CH_3$ | H | H | H | $C_4H_9O$ | $C_4H_9O$ | $CH_3$ | $CH_3$ |
| c-25 | H | $CH_3O(CH_2)_2O$ | $CH_3O(CH_2)_2O$ | $CH_3$ | $CH_3$ | H | H | H | $CH_3O(CH_2)_2O$ | $CH_3O(CH_2)_2O$ | $CH_3$ | $CH_3$ |
| c-26 | H | $CH_2{=}CHCH_2O$ | $CH_2{=}CHCH_2O$ | $CH_3$ | $CH_3$ | H | H | H | $CH_2{=}CHCH_2O$ | $CH_2{=}CHCH_2O$ | $CH_3$ | $CH_3$ |
| c-27 | H | $C_3H_7O$ | $C_3H_7O$ | $C_6H_5CH_2$ | $CH_3$ | $C_6H_5$ | H | H | $C_3H_7O$ | $C_3H_7O$ | $C_6H_5O$ | $CH_3$ |
| c-28 | $CH_3O$ | $C_4H_9O$ | $C_4H_9O$ | $CH_3$ | $CH_3$ | H | H | $CH_3$ | $C_4H_9O$ | $C_4H_9O$ | $CH_3$ | $CH_3$ |
| c-29 | H | (s)$C_5H_{11}O$ | (s)$C_5H_{11}O$ | $CH_3$ | $CH_3$ | H | H | H | (s)$C_5H_{11}O$ | (s)$C_5H_{11}O$ | $CH_3$ | $CH_3$ |
| c-30 | H | $C_4H_9O$ | $C_4H_9O$ | (i)$C_3H_7$ | $CH_3$ | $CH_3$ | $CH_3$ | H | $C_4H_9O$ | $C_4H_9O$ | (i)$C_3H_7$ | $CH_3$ |
| c-31 | H | $C_{18}H_{37}O$ | $C_{18}H_{37}O$ | $CH_3$ | $CH_3$ | H | H | H | $C_{18}H_{37}O$ | $C_{18}H_{37}O$ | $CH_3$ | $CH_3$ |
| c-32 | H | $C_6H_5CH_2O$ | $C_6H_5CH_2O$ | $CH_3$ | $CH_3$ | H | H | H | $C_6H_5CH_2O$ | $C_6H_5CH_2O$ | $CH_3$ | $CH_3$ |

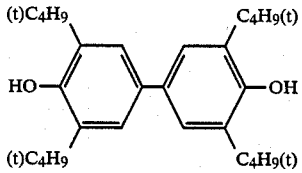

C-7

Formula [D]:

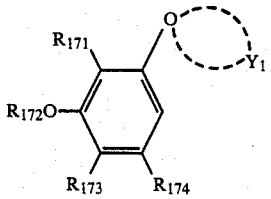

Wherein $R_{171}$ and $R_{174}$ represent hydrogen, a halogen, an alkyl, alkenyl, alkoxy, alkenyloxy, hydroxy, aryl, aryloxy, acyl, acylamino, acyloxy, sufonamido, cycloalkyl or alkoxycarbonyl grup; $R_{172}$ represents hydrogen, Formula [D-1]:

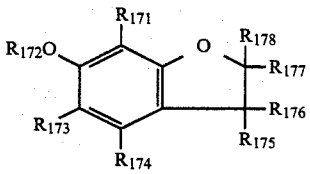

Formula [D-2]:

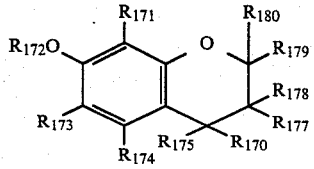

-continued

Formula [D-3]:

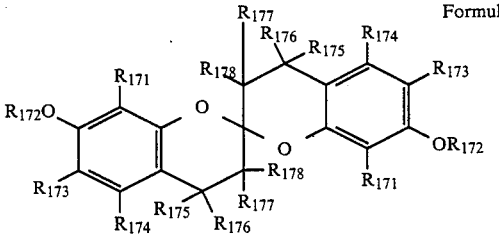

Formula [D-5]:

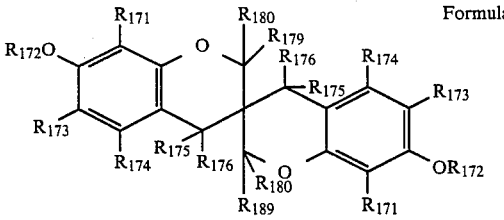

Formula [D-5]:

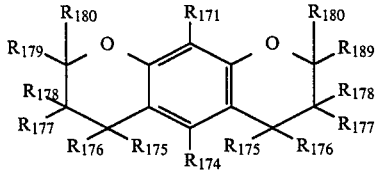

In the above Formulas [D-1] through [D-5], $R_{171}$, $R_{172}$, $R_{173}$ and $R_{174}$ are synonymous with those denoted on the aforegiven Formula [D]; and $R_{175}$, $R_{176}$, $R_{177}$, $R_{178}$, $R_{179}$ and $R_{180}$ represent hydrogen, a halogen, an alkyl, alkoxy, hydroxy, alkenyl, alkenyloxy, aryl, aryloxy or heterocyclic group.

Further, $R_{175}$ and $R_{176}$, $R_{176}$ and $R_{177}$, $R_{177}$ and $R_{178}$, $R_{178}$ and $R_{179}$, and $R_{179}$ and $R_{180}$ may be cyclized to form the respective carbon rings, and the carbon rings may also be substituted by alkyl groups, respectively.

In the aforegiven Formulas [D-1] through [D-5], the particularly useful compounds are those in which $R_{171}$ and $R_{174}$ are hydrogen, an alkyl, hydroxy or cycloalkyl group and $R_{175}$, $R_{176}$, $R_{177}$, $R_{178}$, $R_{179}$ and $R_{180}$ are hydrogen, an alkyl or cycloalkyl group, respectively.

The compounds represented by the Formula [D] represent and include the compounds described in 'Tetrahedron', 1970, vol. 126, pp. 4743–4751; 'Journal of The Chemical Society of Japan', 1972, No. 10, pp. 0987–1990; 'Chemical Letter', 1972, No. 4, pp. 315–316; and Japanese Patent O.P.I. Publication No. 139383/1980; and those compounds may be synthesized in the processes described therein.

The amount of the compounds represented by the Formula [D] to be used is preferably from 5 to 300 mol% and, more preferably, from 10 to 200 mol%, to the magenta couplers relating to the invention.

The typical examples of the above-mentioned compounds will be given below:

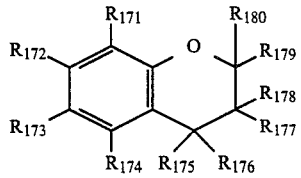

| Compound No. | $R_{171}$ | $R_{172}$ | $R_{173}$ | $R_{174}$ | $R_{175}$ | $R_{176}$ | $R_{177}$ | $R_{178}$ | $R_{179}$ | $R_{180}$ |
|---|---|---|---|---|---|---|---|---|---|---|
| D-1 | H | H | H | H | H | $CH_3$ | H | H | $CH_3$ | $CH_3$ |
| D-2 | H | H | $CH_3$ | H | H | $CH_3$ | H | H | $CH_3$ | $CH_3$ |
| D-3 | H | H | $C_{12}H_{25}$ | H | H | $CH_3$ | H | H | $CH_3$ | $CH_3$ |
| D-4 | H | H | 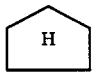 | H | H | $CH_3$ | H | H | $CH_3$ | $CH_3$ |
| D-5 | H | $CH_3$ | H | H | H | $CH_3$ | H | H | $CH_3$ | $CH_3$ |
| D-9 | $CH_3$ | H | $CH_3$ | H | H | H | H | 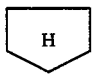 (Condensation) | | H |
| D-10 | H | $CH_3CO$ | H | H | H | (i)$C_3H_7$ | H | H | $CH_3$ | $CH_3$ |
| D-11 | H | $C_3H_7$ | (t)$C_8H_{17}$ | H | H | $CH_3$ | H | $CH_3$ | $CH_3$ | $CH_3$ |
| D-12 | Br | H | Br | H | H | H | H | $CH_3$ | $CH_3$ | $CH_3$ |
| D-13 | H | 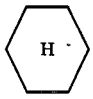 | H | H | $CH_3$ | $CH_3$ | H | H | $CH_2OH$ | $CH_3$ |
| D-14 | H | 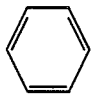 | H | H | $CH_3$ | $CH_3$ | H | H | $CH_3$ | $CH_3$ |

-continued

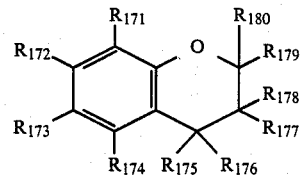

| Compound No. | $R_{171}$ | $R_{172}$ | $R_{173}$ | $R_{174}$ | $R_{175}$ | $R_{176}$ | $R_{177}$ | $R_{178}$ | $R_{179}$ | $R_{180}$ |
|---|---|---|---|---|---|---|---|---|---|---|
| D-15 | H | H | $CH_2{=}CHCH_2CO$ | | $CH_3$ | $CH_3$ | H | H | OH 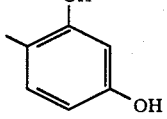 | $CH_3$ |
| D-16 | H | H | H | $CH_3SO_2NH$ | $CH_3$ | $CH_3$ | H | H | OH 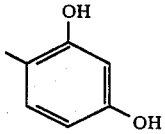 | $CH_3$ |
| D-17 | H | 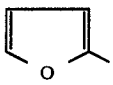 | $CH_3$ | H | C-5 | H | C-5 | H | $CH_3$ | $CH_3$ |
| D-18 | H | 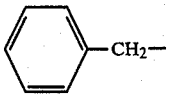 | $CH_3CONH$ | H | H | H | H | H | 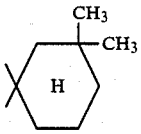 (Spiro) | |
| D-54 | $CH_3O$ | $CH_3O$ | H | H | H | H | H | H | $CH_3$ | $CH_3$ |
| D-55 | H | 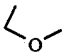 (methylenedioxy) | | H | H | H | H | H | $CH_3$ | $CH_3$ |

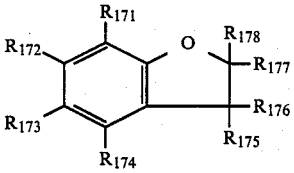

| Compound No. | $R_{171}$ | $R_{172}$ | $R_{173}$ | $R_{174}$ | $R_{175}$ | $R_{176}$ | $R_{177}$ | $R_{178}$ |
|---|---|---|---|---|---|---|---|---|
| D-6 | H | H | H | H | H | 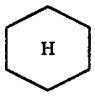 (Condensation) | | H |
| D-7 | H | H | (i)$C_3H_7$ | H | H | H | $CH_3$ | $CH_3$ |
| D-8 | H | $CH_3$ | C-5 | H | H | H | $CH_3$ | $CH_3$ |
| D-19 | H | H | 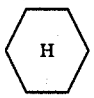 | H | $CH_3$ | $CH_3$ | $CH_3$ | $CH_3$ |
| D-20 | H | $CH_2{=}CHCH_2$ | $CH_3$ | H | $CH_3$ | $CH_3$ | $CH_3$ | H |

-continued

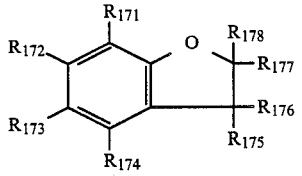

| Compound No. | $R_{171}$ | $R_{172}$ | $R_{173}$ | $R_{174}$ | $R_{175}$ | $R_{176}$ | $R_{177}$ | $R_{178}$ |
|---|---|---|---|---|---|---|---|---|
| D-21 | H | $C_3H_7$ | $C_3H_7$ | H | $CH_3$ | $CH_3$ | 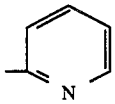 | H |
| D-22 | $CH_3$ | H | $CH_3$ | H | 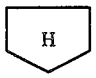 (Spiro) | | H | H |
| D-23 | $CH_3$ | H | 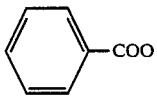 | H | $CH_3$ | $CH_3$ | $CH_3$ | $CH_3$ |

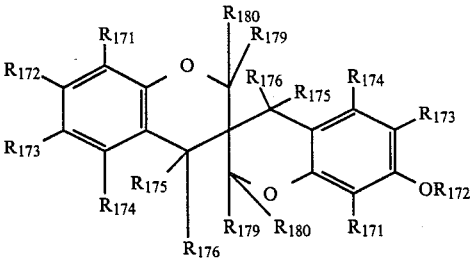

| Compound No. | $R_{171}$ | $R_{172}$ | $R_{173}$ | $R_{174}$ | $R_{175}$ | $R_{176}$ | $R_{179}$ | $R_{180}$ |
|---|---|---|---|---|---|---|---|---|
| D-24 | H | H | H | H | $CH_3$ | $CH_3$ | H | H |
| D-25 | H | H | $CH_3$ | H | $CH_3$ | $CH_3$ | H | H |
| D-26 | H | H | (t)$C_4H_9$ | H | H | H | H | H |
| D-27 | H | $CH_3$ | H | H | $CH_3$ | $CH_3$ | H | H |
| D-28 | H | H | 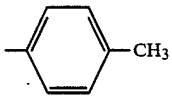 | H | $CH_3$ | $CH_3$ | H | H |
| D-29 | H | H | $C_2H_5COOCH_2$ | H | $CH_3$ | $CH_3$ | H | H |
| D-30 | $CH_3$ | 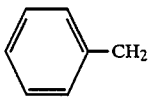 | H | $CH_3$ | $CH_3$ | $CH_3$ | H | H |
| D-31 | C-5 | H | H | H | 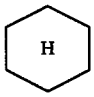 (Spiro) | | H | H |
| D-32 | H | H | $CH_3CONH$ | H | $CH_3$ | $CH_3$ | H | H |
| D-33 | $CH_3$ | 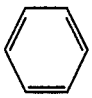 | (t)$C_8H_{17}$ | H | $CH_3$ | $CH_3$ | H | H |

-continued
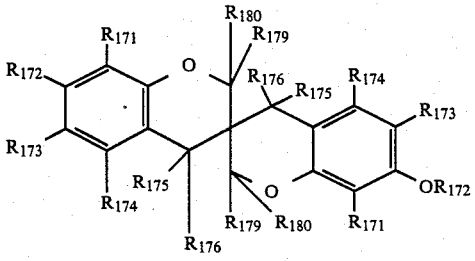
| Compound No. | $R_{171}$ | $R_{172}$ | $R_{173}$ | $R_{174}$ | $R_{175}$ | $R_{176}$ | $R_{179}$ | $R_{180}$ |
|---|---|---|---|---|---|---|---|---|
| D-34 | H | H | 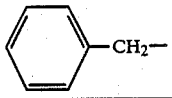 | H | $CH_3$ | $CH_3$ | H | H |
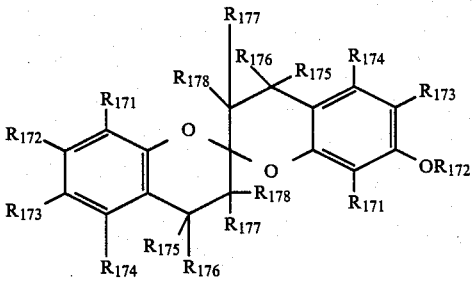
| Compound No. | $R_{171}$ | $R_{172}$ | $R_{173}$ | $R_{174}$ | $R_{175}$ | $R_{176}$ | $R_{177}$ | $R_{178}$ |
|---|---|---|---|---|---|---|---|---|
| D-35 | H | H | H | H | $CH_3$ | $CH_3$ | H | H |
| D-36 | H | $C_3H_7$ | H | H | $CH_3$ | $CH_3$ | H | H |
| D-37 | H | $CH_3$ | $CH_3$ | H | $CH_3$ | $CH_3$ | H | H |
| D-38 | H | H | (t)$C_4H_9$ | H | $CH_3$ | $CH_3$ | H | H |
| D-39 | H | H | 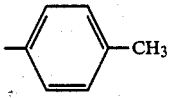 | H | $CH_3$ | $CH_3$ | H | H |
| D-40 | H | H | $CH_3SO_2NH$ | H | H | H | H | H |
| D-41 | $CH_3$ | 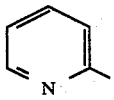 | H | $CH_3$ | $CH_3$ | $CH_3$ | H | H |
| D-42 | C-5 | (t)$C_4H_9$ | H | H | 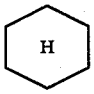 (Spiro) | | H | H |
| D-43 | H | $C_{12}H_{25}$ | $CH_3CONH$ | H | $CH_3$ | $CH_3$ | H | H |
| D-44 | H | H | (t)$C_8H_{17}$ | H | $CH_3$ | $CH_3$ | H | H |
| D-45 | H | H | 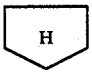 | H | $CH_3$ | $CH_3$ | H | H |

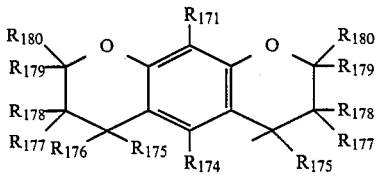

| Compound No. | $R_{171}$ | $R_{174}$ | $R_{175}$ | $R_{176}$ | $R_{177}$ | $R_{178}$ | $R_{179}$ | $R_{180}$ |
|---|---|---|---|---|---|---|---|---|
| D-46 | H | H | H | H | H | H | $CH_3$ | $CH_3$ |
| D-47 | OH | H | H | H | H | H | $CH_3$ | $CH_3$ |
| D-48 | H | H | H | H | H | H | $CH_3$ | $C_2H_5$ |
| D-49 | H | H | H | H | H | H | 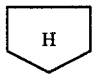 (Spiro) | |
| D-50 | $C_3H_7O$ | H | $CH_3$ | H | H | H | $CH_3$ | $CH_3$ |
| D-51 | H | H | H | H | $C_3H_7$ | H | $C_3H_7$ | H |
| D-52 | H | OH | H | H | H | H | $CH_3$ | $CH_3$ |
| D-53 | H | $C_3H_7O$ | H | H | H | H | $CH_3$ | $CH_3$ |

Formula [E]:

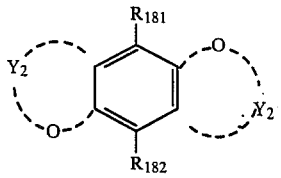

Formula [F]:

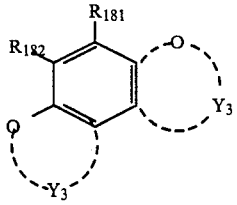

wherein $R_{181}$ and $R_{182}$ represent hydrogen, a halogen, an alkyl, alkenyl, alkoxy, alkenyloxy, hydroxy, aryl, aryloxy, acyl, acylamino, acyloxy, sulfonamido or alkoxycarbonyl group.

The above-given groups may be substituted by the other substituents, respectively. They include, for example, a halogen, an alkyl, alkenyl, alkoxy, aryloxy, hydroxy, alkoxycarbonyl, aryloxycarbonyl, acylamino, carbamoyl, sulfonamido and sulfamoyl groups and the like.

$Y_2$, $Y_3$ represents a group of atoms necessary for forming a dichroman or dicoumaran ring together with a benzene ring.

Such a chroman or coumaran ring may be substituted by a halogen, an alkyl, cycloalkyl, alkoxy, alkenyl, alkenyloxy, hydroxy, aryl, aryloxy or heterocyclic group; and may also form a spiro ring.

Among the compounds represented by the Formulas [E] and [F], those particularly useful in the invention include, for example, the compounds represented by the following Formulas [E-1], [E-2], [F-1] and [F-2]:

Formula [E-1]:

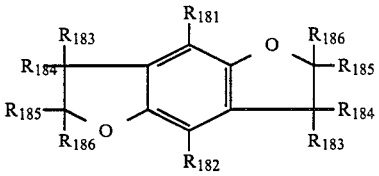

Formula [E-2]:

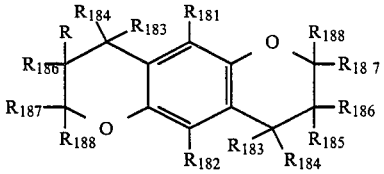

Formula [F-1]:

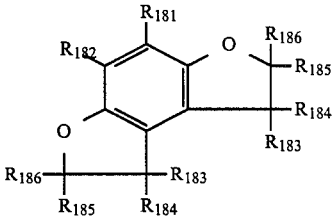

Formula [F-2]:

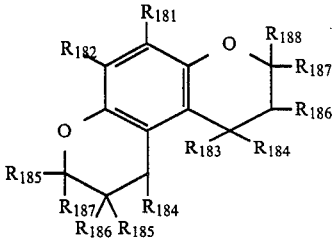

In the above-given Formulas [E-1], [E-2], [F-1] and [F-2], $R_{181}$ and $R_{182}$ are synonymous with those denoted in the aforegiven Formulas [E] and [F]; and $R_{183}$, $R_{184}$, $R_{185}$, $R_{186}$, $R_{187}$ and $R_{188}$ represent hydrogen, a halogen, an alkyl, alkoxy, hydroxy, alkenyl, alkenyloxy, aryl, aryloxy or heterocyclic group. Further, $R_{183}$ and $R_{184}$, $R_{184}$ and $R_{185}$, $R_{185}$ and $R_{186}$, $R_{186}$ and $R_{187}$ and $R_{187}$ and $R_{188}$ may be cyclized each other to form a carbon ring; and still further, such a carbon ring may also be substituted by an alkyl group.

In the above-given Formulas [E-1], [E-2], [F-1] and [F-2], the particularly useful compounds are those in which $R_{181}$ and $R_{182}$ represent hydrogen, an alkyl, alkoxy, hydroxy or cycloalkyl group, and $R_{183}$, $R_{184}$, $R_{185}$, $R_{186}$, $R_{187}$ and $R_{188}$ represent hydrogen, an alkyl or cycloalkyl group.

The compounds represented by the Formulas [E] and [F] include those described in 'Journal of The Chemical Society of Japan', Part C, 1968, (14), pp. 1937–18; 'Journal of The Society of Synthetic Organic Chemistry, Japan', 1970, 28(1), pp. 60–65; and 'Tetrahedron Letters', 1973, (29), pp. 2707–2710; and they may be synthesized in the processes described therein.

An amount of the compounds represented by the aforegiven Formulas [E] and [F] to be used is preferably from 5 to 300 mol% and, more preferably, from 10 to 200 mol%, to the magenta couplers used in the invention.

The typical examples of the above-mentioned compounds will be given below:

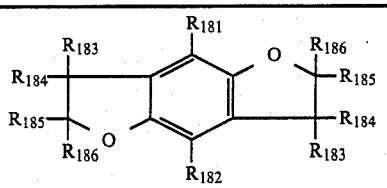

| Compound No. | $R_{181}$ | $R_{182}$ | $R_{183}$ | $R_{184}$ | $R_{185}$ | $R_{186}$ |
|---|---|---|---|---|---|---|
| E-11 | H | H | H | H | $CH_3$ | $CH_3$ |
| E-12 | H | H | H | H | | |
| E-13 | H | H | H |  (Spiro) | H | 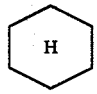 (Condensation) |

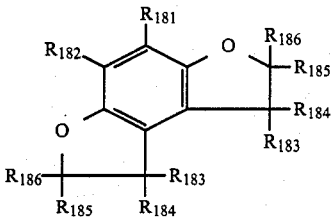

| Compound No. | $R_{181}$ | $R_{182}$ | $R_{183}$ | $R_{184}$ | $R_{185}$ | $R_{186}$ |
|---|---|---|---|---|---|---|
| F-1 | $CH_3$ | $CH_3$ | H | H | H | H |
| F-2 | H | H | H | H | $CH_3$ | $CH_3$ |

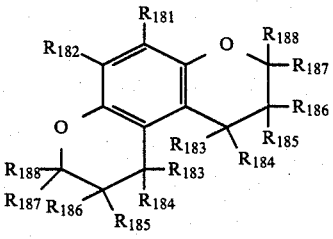

| Compound No. | $R_{181}$ | $R_{182}$ | $R_{183}$ | $R_{184}$ | $R_{185}$ | $R_{186}$ | $R_{187}$ | $R_{188}$ |
|---|---|---|---|---|---|---|---|---|
| F-3 | H | H | H | H | H | H | H | H |
| F-4 | H | H | H | H | H | H | $CH_3$ | $CH_3$ |
| F-5 | $CH_3$ | $CH_3$ | H | H | H | H | $CH_3$ | $CH_3$ |
| F-6 | $(CH_3)_2C(C\text{-}5)CH_2CH_2$ | $(CH_3)_2C(C\text{-}5)CH_2CH_2$ | H | H | H | H | $CH_3$ | $CH_3$ |
| E-7 | H | H | C-5 | H | C-5 | H | H | H |
| F-8 | H | H | H | H | H | H | 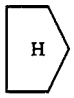 (Spiro) | |
| F-9 | $CH_3O$ | H | H | H | H | H | 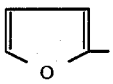 | H |
| F-10 | H | H | H | H | H | H | $CH_2OH$ | $CH_3$ |
| F-11 | 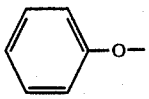 | H | H | H | H | H | $CH_3$ | $CH_3$ |

Formula [G]:

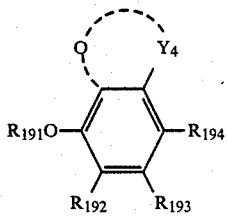

wherein $R_{191}$ represents hydrogen, an alkyl, alkenyl, aryl, acyl, cycloalkyl or heterocyclic group; and $R_{193}$ represents hydrogen, a halogen, an alkyl, alkenyl, aryl, aryloxy, acyl, acylamino, acyloxy, sulfonamido, cycloalkyl or alkoxycarbonyl group.

$R_{192}$ and $R_{194}$ represent hydrogen, a halogen, an alkyl, alkenyl, aryl, acyl, acylamino, sulfonamido, cycloalkyl or alkoxycarbonyl group.

The above-mentioned groups may be substituted by the other substituents, respectively. They include, for example, an alkyl, alkenyl, alkoxy, aryl, aryloxy, hydroxy, alkoxycarbonyl, aryloxycarbonyl, acylamino, carbamoyl, sulfonamido, sulfamoyl or like group.

Further, $R_{191}$ and $R_{192}$ may close a ring each other to form a 5- or 6-membered ring, provided that, in this case, $R_{193}$ and $R_{194}$ represent hydrogen, a halogen, an alkyl, alkenyl, alkoxy, alkenyloxy, hydroxy, aryl, aryloxy, acyl, acyloxy, sulfonamido or alkoxycarbonyl group.

$Y_4$ represents a group of atoms necessary for forming a chroman or couraman ring.

Such a chroman or couraman ring may be substituted by a halogen, an alkyl, cycloalkyl, alkoxy, alkenyl, alkenyloxy, hydroxy, aryl, aryloxy or heterocyclic group; and may further form a spiro ring.

Among the compounds represented by the Formula [G] include, for example, those represented by the following Formulas [G-1], [G-2], [G-4] and [G-5]:

Formula [G-1]:

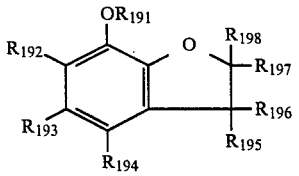

Formula [G-2]:

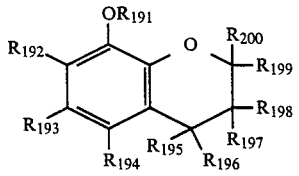

Formula [G-3]:

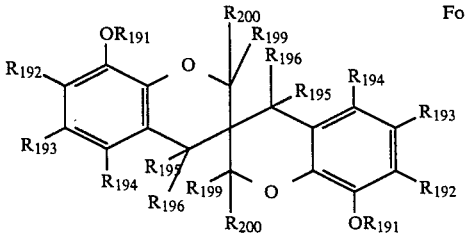

-continued

Formula [G-4]:

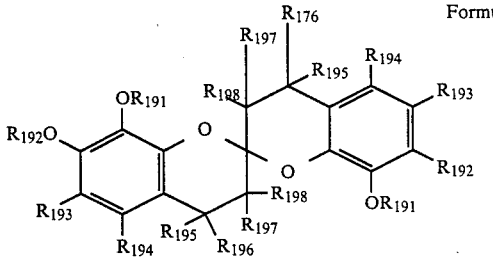

Formula [G-5]:

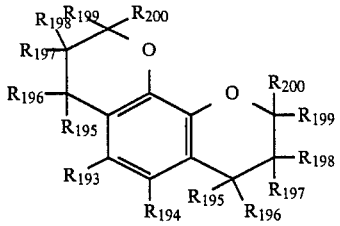

In the above-given Formulas [G-1] through [G-5], $R_{191}$, $R_{192}$, $R_{193}$ and $R_{194}$ are synonymous with those denoted in the aforegiven Formula [G]; and $R_{195}$, $R_{196}$, $R_{197}$, $R_{198}$, $R_{199}$ and $R_{200}$ represent hydrogen, a halogen, an alkyl, alkoxy, hydroxy, alkenyl, alkenyloxy, aryl, aryloxy or heterocyclic group. Further, $R_{195}$ and $R_{196}$, $R_{196}$ and $R_{197}$, $R_{197}$ and $R_{198}$, $R_{198}$ and $R_{199}$, and $R_{199}$ and $R_{200}$ may be cyclized each other to form a carbon ring; and still further, the carbon ring may also be substituted by an alkyl group.

The compounds particularly useful include those in which $R_{191}$, $R_{192}$, $R_{192}$, $R_{193}$ and $R_{194}$ represent hydrogen, an alkyl or cycloalkyl group in the Formulas [G-1] through [G-5]; $R_{193}$ and $R_{194}$ represent hydrogen, an alkyl, alkoxy, hydroxy or cycloalkyl group in the Formula [G-5]; and $R_{195}$, $R_{196}$, $R_{197}$, $R_{198}$, $R_{199}$ and $R_{200}$ represent hydrogen, an alkyl or cycloalkyl group in the Formulas [G-1] through [G-5].

The compounds represented by the Formula [G] include those described in 'Tetrahedron Letters', 1965, (8), pp. 457–460; 'Journal of The Chemical Society of Japan', Part C, 1966, (22), pp. 2013–2016; and 'Zh. Org. Khim.', 1870, (6), pp. 1230–1237; and they may be synthesized in the processes described therein.

An amount of the compounds represented by the Formula [G-1] to be used in preferably from 5 to 300 mol% and more preferably from 10 to 200 mol%, to the magent couplers relating to the invention.

The typical examples of the above-mentioned compounds will be given below:

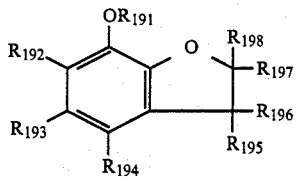

| Compound No | $R_{191}$ | $R_{192}$ | $R_{193}$ | $R_{194}$ | $R_{195}$ | $R_{196}$ | $R_{197}$ | $R_{198}$ |
|---|---|---|---|---|---|---|---|---|
| G-19 | H | H | H | H | H | 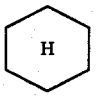 (Condensation) | | H |
| G-20 | $C_3H_7$ | H | H | H | H | 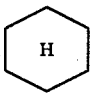 (Condensation) | | H |
| G-21 | H | H | H | H | H | H | 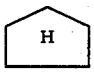 (Spiro) | |
| G-22 | $CH_3$ | H | H | H | H | H | 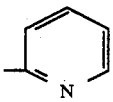 | H |
| G-23 | H | H | H | H | H | H | $CH_3$ | $CH_3$ |
| G-24 | $CH_3$ | H | 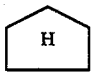 | H | H | H | $CH_3$ | $CH_3$ |
| G-25 | 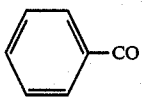 | H | H | H | H | H | $CH_3$ | $CH_3$ |
| G-26 | $C_{12}H_{25}$ | H | H | H | $CH_3$ | $CH_3$ | $CH_3$ | $CH_2OH$ |

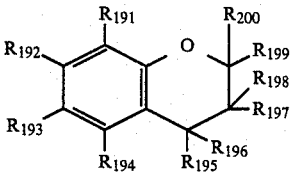

| Compound No | $R_{191}$ | $R_{192}$ | $R_{193}$ | $R_{194}$ | $R_{195}$ | $R_{196}$ | $R_{197}$ | $R_{198}$ | $R_{199}$ | $R_{200}$ |
|---|---|---|---|---|---|---|---|---|---|---|
| G-1 | H | H | H | H | H | H | H | H | H | H |
| G-2 | H | H | H | H | H | H | H | H | $CH_3$ | $CH_3$ |
| G-3 | H | H | H | H | $CH_3$ | H | H | H | $CH_3$ | $CH_3$ |
| G-4 | H | H | $CH_2{=}CHCH_2$ | H | H | H | H | H | $CH_3$ | $CH_3$ |
| G-5 | $CH_3$ | H | H | H | H | H | H | H | $CH_3$ | $CH_3$ |
| G-6 | $C_3H_7$ | H | H | H | H | H | H | H | $CH_3$ | $CH_3$ |
| G-7 | $C_{12}H_{25}$ | H | H | H | $CH_3$ | H | H | H | $CH_3$ | $CH_3$ |
| G-8 | 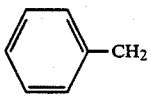 | H | H | H | H | H | H | H | H | H |

-continued

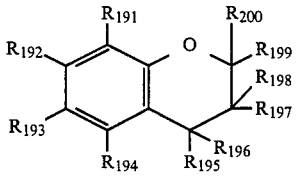

| Compound No | $R_{191}$ | $R_{192}$ | $R_{193}$ | $R_{194}$ | $R_{195}$ | $R_{196}$ | $R_{197}$ | $R_{198}$ | $R_{199}$ | $R_{200}$ |
|---|---|---|---|---|---|---|---|---|---|---|
| G-9 | 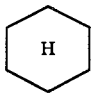 | H | H | H | H | H | H | H | $CH_3$ | $CH_3$ |
| G-10 | 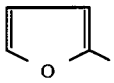 | H | H | H | H | H | H | H | $CH_3$ | $CH_3$ |
| G-11 | H | H | H | H | H | H | H | H | $CH_3$ | $C_{16}H_{33}$ |
| G-12 | H | H | 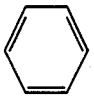 | H | H | H | H | H | $CH_3$ | $CH_3$ |
| G-13 | $CH_3$ | H | $CH_3CO$ | H | H | H | H | H | $CH_3$ | $CH_3$ |
| G-14 | $CH_3$ | H | H | H | H | Br | Br | H | H | H |
| G-15 | $CH_3$ | H | H | H | H | C— | C— | H | H | H |
| G-16 | $CH_3$ | H | H | H | H | $CH_3O$ | Br | H | H | H |
| G-17 | $CH_3$ | H | H | H | H | OH | Br | H | $CH_3$ | $CH_3$ |
| G-18 | $CH_3$ | H | H | H | H | $C_2H_5O$ | OH | H | $CH_3$ | $CH_3$ |

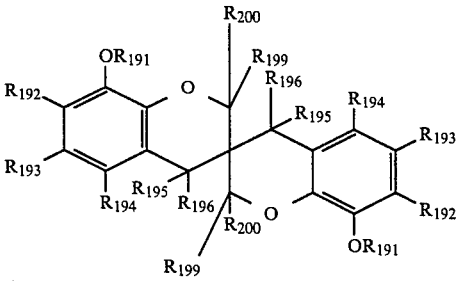

| Compound No | $R_{191}$ | $R_{192}$ | $R_{193}$ | $R_{194}$ | $R_{195}$ | $R_{196}$ | $R_{199}$ | $R_{200}$ |
|---|---|---|---|---|---|---|---|---|
| G-27 | H | H | H | H | H | H | H | H |
| G-28 | $CH_3$ | H | H | H | H | H | H | H |
| G-29 | 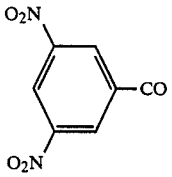 | H | H | H | H | H | H | H |
| G-30 | H | H | $CH_3$ | H | H | H | $CH_3$ | $CH_3$ |
| G-31 | $C_3H_7$ | H | H | H | H | H | H | H |
| G-32 | $C_3H_7$ | H | H | H | $CH_3$ | $CH_3$ | H | H |
| G-37 | H | H | H | $CH_3CONH$ | H | H | H | H |
| G-38 | CO | H | H | H | H | H | H | H |

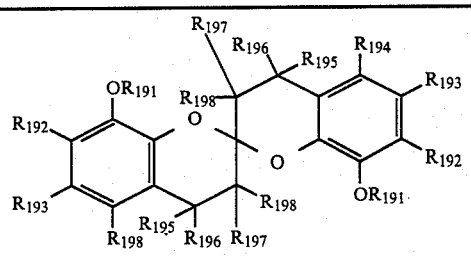

| Compound No | $R_{191}$ | $R_{192}$ | $R_{193}$ | $R_{194}$ | $R_{195}$ | $R_{196}$ | $R_{197}$ | $R_{198}$ |
|---|---|---|---|---|---|---|---|---|
| G-33 | H | H | H | H | H | H | H | H |
| G-34 | H | H | H | H | $CH_3$ | $CH_3$ | H | H |
| G-35 | $C_{12}H_{25}$ | H | H | H | $CH_3$ | $CH_3$ | H | H |
| G-36 | $CH_3$ | H | $CH_3$ | H | $CH_3$ | $CH_3$ | H | H |

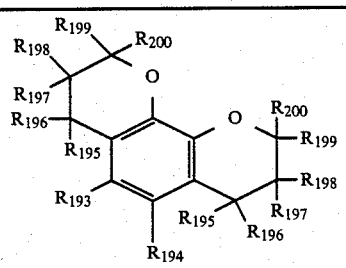

| Compound No | $R_{193}$ | $R_{194}$ | $R_{195}$ | $R_{196}$ | $R_{197}$ | $R_{198}$ | $R_{199}$ | $R_{200}$ |
|---|---|---|---|---|---|---|---|---|
| G-39 | H | H | H | H | H | H | H | H |
| G-40 | H | H | H | H | H | H | $CH_3$ | $CH_3$ |
| G-41 | OH | H | H | H | H | H | $CH_3$ | $CH_3$ |
| G-42 | $C_3H_7O$ | H | $CH_3$ | $CH_3$ | H | H | H | H |

Formula [H]:

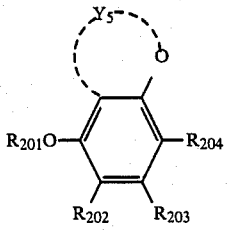

wherein $R_{201}$ represents hydrogen, an alkyl, alkenyl, aryl, acyl, cycloalkyl or heterocyclic group; $R_{202}$ represents hydrogen, a halogen, an alkyl, alkenyl, aryl, aryloxy, acyl, acylamino, acyloxy, sulfonamido, cycloalkyl or alkoxycarbonyl group; $R_{203}$ represents hydrogen, a halogen, an alkyl, alkenyl, aryl, acyl, acylamino, sulfonamido, cycloalkyl or alkoxycarbonyl group; and $R_{204}$ represents hydrogen, a halogen, an alkyl, alkenyl, alkoxy, alkenyloxy, hydroxy, aryl, aryloxy, acyl, acylamino, acyloxy, sulfonamido or alkoxycarbonyl group.

The above-mentioned groups may be substituted by the other substituents, respectively. They include, for example, an alkyl, alkenyl, alkoxy, aryl, aryloxy, hydroxy, alkoxycarbonyl, aryloxycarbonyl, acylamino, carbamoyl, sulfonamido, sulfamoyl or like group.

Further, $R_{201}$ abd $R_{202}$ may close a ring with each other to form a 5- or 6-membered ring, provided that, in this case, $R_{203}$ and $R_{204}$ represnt hydrogen, a halogen, an alkyl, alkenyl, alkoxy, alkenyloxy, hydroxy, aryl, aryloxy, acyl, acylamino, acyloxy, sulfonamido or alkoxycarbonyl group.

$Y_5$ represents a group of atoms necessary for forming a chroman or coumaran ring.

Such a chroman or coumaran ring may be substituted by a halogen, an alkyl, cycloalkyl, alkoxy, alkenyl, alkenyloxy, hydroxy, aryl, aryloxy or heterocyclic group; and may further form a spiro ring.

Among the compounds represented by the Formula [H], the compounds particularly preferable in the invention include those represented by the following Formulas [H-1], [H-2], [H-3], [H-4] and [H-5];

Formula [H-2]:

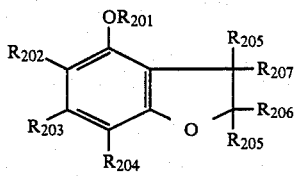

Formula [H-2]:

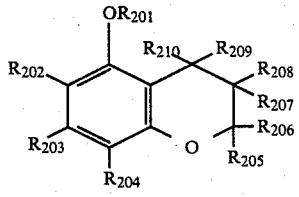

Formula [H-3]:

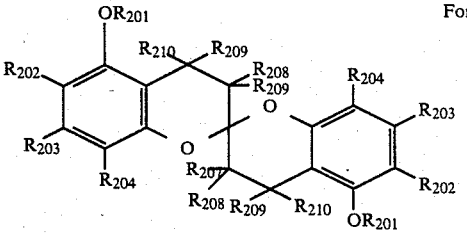

Formula [H-4]:

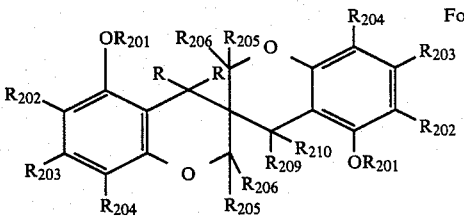

Formula [H-5]:

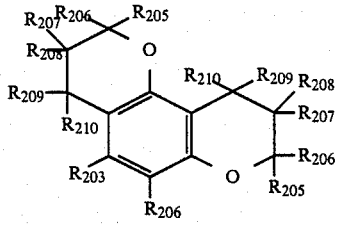

In the above-given Formulas [H-1] through [H-5], $R_{201}$, $R_{202}$, $R_{203}$ and $R_{204}$ are synonymous with those denoted in the Formula [H]; and $R_{205}$, $R_{206}$, $R_{207}$, $R_{208}$, $R_{209}$ and $R_{210}$ represent hydrogen, a halogen, an alkyl, alkoxy, hydroxy, alkenyl, alkenyloxy, aryl, aryloxy or heterocyclic group.

Further, $R_{205}$ and $R_{206}$, $R_{206}$ and $R_{207}$, $R_{207}$ and $R_{208}$, $R_{208}$ and $R_{209}$, and $R_{209}$ and $R_{210}$ may be cyclized each other to form a carbon ring; and the carbon ring may also be substituted by an alkyl group.

Still further, in the above-given Formulas [H-3], [H-4] and [H-5], two each of from $R_{201}$ through $R_{210}$ may be the same or different from each other.

In the formulas [H-1] through [H-5], the particularly preferable compounds are those in which $R_{201}$, $R_{202}$ and $R_{203}$ represent hydrogen, and alkyl or cycloalkyl group; $R_{204}$ represents hydrogen, an alkyl, alkoxy, hydroxy or cycloalkyl group; and $R_{205}$, $R_{206}$, $R_{207}$, $R_{208}$, $R_{209}$ and $R_{210}$ represent hydrogen, an alkyl or cycloalkyl group.

The compounds represented by the Formula [H] include those described in 'Tetrahedron Letters', 1970, vol. 26, pp. 4743–4751; 'Journal of The Chemical Society of Japan', 1972, No. 10, pp. 1987–1990; 'Synthesis', 1975, vol. 6, pp. 392–393; and 'Bul. Soc. Chem. Belg.', 1975, vol. 84(7),, pp. 747–759; and they may be synthesized in the processes described therein.

An amount of the compounds represented by the Formula [H] to be used is preferably from 5 to 300 mol% and, more preferably, from 10 to 200 mol%, to the magenta couplers relating to the invention.

The typical examples of the componds represented by the Formula [H] will be given below:

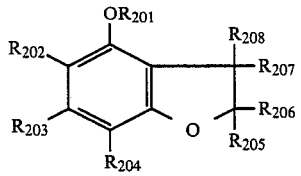

| Compound No | $R_{201}$ | $R_{202}$ | $R_{203}$ | $R_{204}$ | $R_{205}$ | $R_{206}$ | $R_{207}$ | $R_{208}$ |
|---|---|---|---|---|---|---|---|---|
| H-11 | H | H | H | H | H | 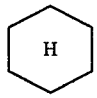 (Condensation) | | H |
| H-12 | $C_3H_7$ | H | H | H | H | 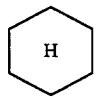 (Condensation) | | H |
| H-13 | H | H | H | H | H | H | H | H |
| H-14 | H | H | H | H | H | H | $CH_3$ | H |
| H-15 | H | H | $CH_3$ | H | H | H | $CH_3$ | H |
| H-16 | H | H | 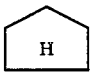 | H | H | H | $CH_3$ | H |
| H-17 | H | H | 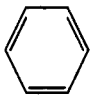 | H | H | H | $CH_3$ | H |
| H-18 | $C_3H_{17}$ | H | $CH_3$ | H | H | H | $CH_3$ | H |
| H-19 | 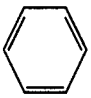 | H | H | H | 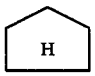 (Spiro) | | H | H |
| H-24 | $CH_2{=}CHCH_2$ | $CH_3$ | $CH_3$ | H | H | $C_2H_5O$ | $CH_3$ | $CH_3$ |
| H-25 | $C_3H_7$ | H | H | H | H | 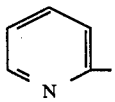 | $CH_3$ | $CH_3$ |
| H-26 | H | $CH_3$ | $CH_3$ | H | H | H | 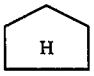 (Spiro) | |

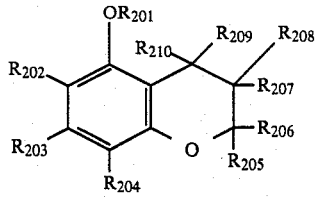

| Compound No | $R_{201}$ | $R_{202}$ | $R_{203}$ | $R_{204}$ | $R_{205}$ | $R_{206}$ | $R_{207}$ | $R_{208}$ | $R_{209}$ | $R_{210}$ |
|---|---|---|---|---|---|---|---|---|---|---|
| H-1 | H | H | H | H | H | H | H | H | H | H |
| H-2 | H | H | H | H | $CH_3$ | $CH_3$ | H | H | $CH_3$ | H |
| H-3 | H | H | H | H | $CH_3$ | $CH_3$ | H | H | H | H |
| H-4 | H | $(CH_3)_2C{=}CCHCH_2$ | H | H | $CH_3$ | $CH_3$ | H | H | H | H |
| H-5 | $CH_3$ | H | H | H | $CH_3$ | $CH_3$ | H | H | H | H |
| H-6 | $C_3H_7$ | H | H | H | $CH_3$ | $CH_3$ | H | H | H | H |
| H-7 | $C_{12}H_{25}$ | H | H | H | $CH_3$ | $CH_3$ | H | H | H | H |
| H-8 | 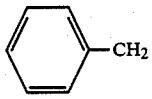 | H | H | H | $CH_3$ | $CH_3$ | H | H | H | H |
| H-9 | 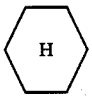 | H | H | H | $CH_3$ | $CH_3$ | H | H | H | H |
| H-10 | 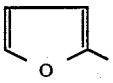 | H | H | H | $CH_3$ | $CH_3$ | H | H | H | H |
| H-20 | H | C— | H | H | H | 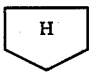 (Condensation) | | H | H | H |
| H-21 | H | H | H | H | $CH_3$ | $CH_2OH$ | H | H | $CH_3$ | $CH_3$ |
| H-22 | $C_3H_7$ | (t)$C_8H_{17}$ | H | H | $C_2H_5$ | $CH_3$ | H | H | H | H |
| H-23 | $CH_3CO$ | H | H | H | $CH_3$ | $CH_3$ | H | H | $CH_3$ | H |

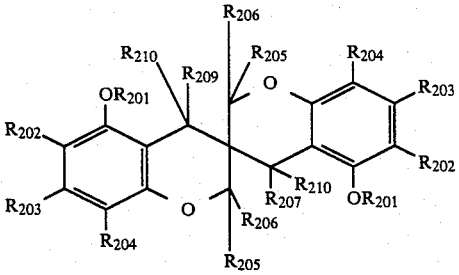

| Compound No | $R_{201}$ | $R_{202}$ | $R_{203}$ | $R_{204}$ | $R_{205}$ | $R_{206}$ | $R_{207}$ | $R_{208}$ |
|---|---|---|---|---|---|---|---|---|
| H-27 | H | H | H | H | H | H | $CH_3$ | $CH_3$ |
| H-28 | $C_3H_7$ | H | H | H | H | H | $CH_3$ | $CH_3$ |
| H-29 | H | H | H | (t)$C_8H_{17}$ | H | H | H | H |
| H-30 | H | C— | H | H | H | H | 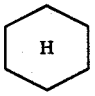 (Spiro) | |
| H-31 | 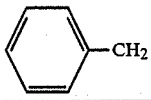 | H | H | H | H | H | $CH_3$ | $CH_3$ |

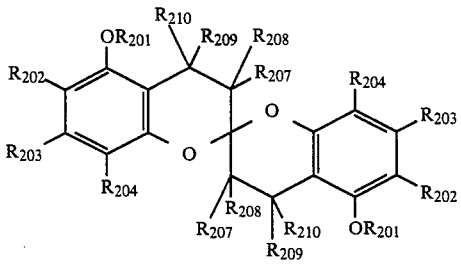

| Compound No | $R_{201}$ | $R_{202}$ | $R_{203}$ | $R_{204}$ | $R_{207}$ | $R_{208}$ | $R_{209}$ | $R_{210}$ |
|---|---|---|---|---|---|---|---|---|
| H-32 | H | H | H | H | H | H | $CH_3$ | $CH_3$ |
| H-33 | $CH_3$ | H | H | H | H | H | $CH_3$ | $CH_3$ |
| H-34 | H | $CH_3$ | H | H | H | H | H | H |
| H-35 | H | H | H | (t)$C_4H_9$ | H | H | $CH_3$ | $CH_3$ |
| H-36 | H | 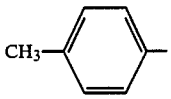 | H | H | H | H | $CH_3$ | $CH_3$ |
| H-37 | H | H | H | $CH_3SO_2NH$ | H | H | H | H |
| H-38 | 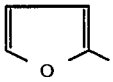 | H | H | H | H | H | $CH_3$ | $CH_3$ |
| H-39 | $C_{12}H_{25}$ | H | H | H | H | H | $CH_3$ | $CH_3$ |
| H-40 | 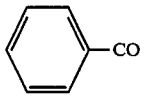 | H | H | H | H | H | 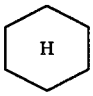 (Spiro) | |
| H-41 | H | H | 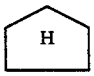 | H | H | H | $CH_3$ | $CH_3$ |

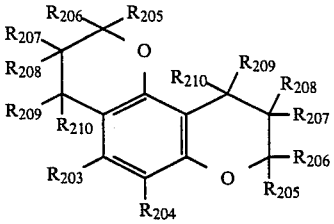

| Compound No | $R_{203}$ | $R_{204}$ | $R_{205}$ | $R_{206}$ | $R_{207}$ | $R_{208}$ | $R_{209}$ | $R_{210}$ |
|---|---|---|---|---|---|---|---|---|
| H-42 | H | H | $CH_3$ | $CH_3$ | H | H | H | H |
| H-43 | H | H | 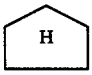 (Spiro) | | H | H | H | H |
| H-44 | H | OH | $CH_3$ | $CH_3$ | H | H | $CH_3$ | H |
| H-45 | H | $C_3H_7O$ | H | H | H | H | $CH_3$ | $CH_2OH$ |
| H-46 | OH | H | $CH_3$ | $CH_3$ | H | H | H | H |
| H-47 | $C_3H_7O$ | H | $CH_3$ | $CH_3$ | H | H | H | H |

Formula[J]

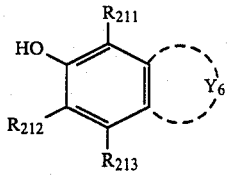

wherein $R_{211}$ and $R_{213}$ represent hydrogen, a halogen, an alkyl, alkenyl, alkoxy, hydroxy, aryl, aryloxy, acyl, acylamino, acyloxy, sulfonamido, cycloalkyl or alkoxycarbonyl group; and $R_{212}$ represents hydrogen, a halogen, an alkyl, alkenyl, hydroxy, aryl, acyl, acylamino, acyloxy, sulfonamido, cycloalkyl or alkoxycarbonyl group.

The above-mentioned groups may be substituted by the other substituents including, for example, an alkyl, alkenyl, alkoxy, aryl, aryloxy, hydroxy, alkoxycarbonyl, aryloxycarbonyl, acylamino, carbamoyl, sulfonamido, sulfamoyl or like group.

$R_{212}$ and $R_{213}$ may close a ring with each other to form a 5- or 6-membered hydrocarbon ring which may also be substituted by a halogen, an alkyl, cycloalkyl, alkoxy, alkenyl, hydroxy, aryl, aryloxy, heterocyclic or like group.

$Y_6$ represents a group of atoms necessary for forming an indan ring which may also be substituted by a halogen, an alkyl, alkenyl, alkoxy, cycloalkyl, hydroxy, aryl, aryloxy, heterocyclic or like group; and may further form a spiro ring.

Among the compounds represented by the Formula [J], those particularly preferred include the compounds represented by the following Formulas [J-1] through [J-3]:

Formula [J-1]

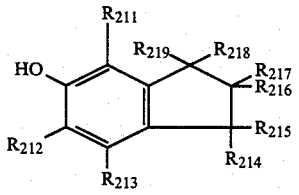

-continued

Formula [J-2]

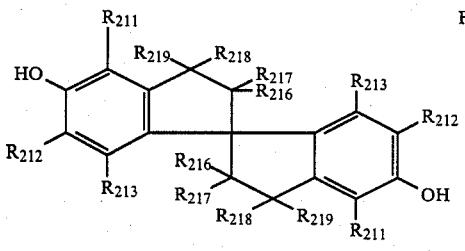

Formula [J-3]

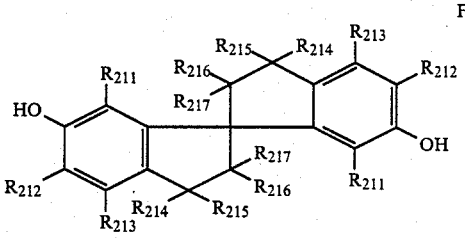

In the above-given Formulas [J-1] through [J-3], $R_{211}$, $R_{212}$ and $R_{213}$ are synonymous with those denoted in the Formula [J]; and $R_{214}$, $R_{215}$, $R_{216}$, $R_{217}$, $R_{218}$ and $R_{219}$ represent hydrogen, a halogen, an alkyl, alkoxy, alkenyl, hydroxy, aryl, aryloxy or heterocyclic group.

$R_{214}$ and $R_{215}$, $R_{215}$ and $R_{216}$, $R_{216}$ and $R_{217}$, $R_{217}$ and $R_{218}$, and $R_{218}$ and $R_{219}$ may close a ring with each other to form a hydrocarbon ring which may further be substituted by an alkyl group.

In the above-given Formulas [J-1] through [J-3], the particularly useful compounds are those in which $R_{211}$ and $R_{213}$ represent hydrogen, an alkyl, alkoxy, hydroxy or cycloalkyl group; $R_{212}$ represent hydrogen, an alkyl, hydroxy or cycloalkyl group; and $R_{214}$, $R_{215}$, $R_{216}$, $R_{217}$, $R_{218}$ and $R_{219}$ represent hydrogen, an alkyl or cycloalkyl group.

An amount of the compounds represented by the above-given Formula [J] to be used is preferably from 5 to 300 mol% and, more preferably, from 10 to 200 mol%, to the magenta couplers.

The typical examples of the compounds represented by the Formula [J] will be given below:

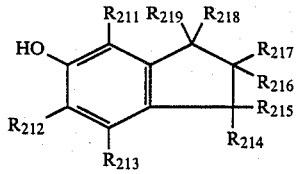

| Compound No. | $R_{211}$ | $R_{212}$ | $R_{213}$ | $R_{214}$ | $R_{215}$ | $R_{216}$ | $R_{217}$ | $R_{218}$ | $R_{219}$ |
|---|---|---|---|---|---|---|---|---|---|
| J-1 | H | H | H | H | H | H | H | H | H |
| J-2 | H | H | H | H | H | H | H | $CH_3$ | $CH_3$ |
| J-3 | H | H | H | H | H | H | H | $CH_3$ | $CH_3$ |
| J-4 | H | OH | H | H | H | H | H | $CH_3$ | $C_{16}H_{33}$ |
| J-5 | H | H | H | $CH_3$ | $CH_3$ | H | H | $CH_3$ | $CH_3$ |
| J-6 | H | C— | H | $CH_3$ | $CH_3$ | H | H | $CH_3$ | $CH_3$ |
| J-7 | C— | C— | H | $CH_3$ | $CH_3$ | H | H | $CH_3$ | $CH_3$ |
| J-8 | H | H | $CH_3$ | $CH_3$ | $CH_3$ | H | H | $CH_3$ | $CH_3$ |

-continued

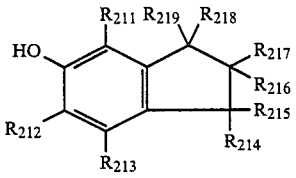

| Compound No. | $R_{211}$ | $R_{212}$ | $R_{213}$ | $R_{214}$ | $R_{215}$ | $R_{216}$ | $R_{217}$ | $R_{218}$ | $R_{219}$ |
|---|---|---|---|---|---|---|---|---|---|
| J-9 | H | H | H | H | 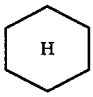 (Condensation) | | H | H | H |
| J-10 | H | H | H | H | H | H | H | 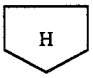 (Spiro) | |
| J-11 | H | $C_3H_7$ | H | $CH_3$ | $CH_3$ | H | H | $CH_3$ | $CH_3$ |
| J-12 | H | (t)$C_8H_{17}$ | H | $CH_3$ | $CH_3$ | H | H | $CH_3$ | $CH_3$ |
| J-13 | H | 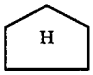 | H | $CH_3$ | $CH_3$ | H | H | $CH_3$ | $CH_3$ |
| J-14 | H | H | H | 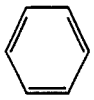 | $CH_3$ | H | H | $CH_3$ | $CH_3$ |
| J-15 | H | H | $CH_3O$ | $CH_3$ | $CH_3$ | H | H | $CH_3$ | $CH_3$ |
| J-16 | $CH_3H$ | H | H | H | 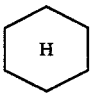 (Condensation) | | H | H | H |
| J-17 | H | $CH_3SO_2NH$ | H | $CH_3$ | $CH_3$ | H | H | $CH_3$ | $CH_3$ |
| J-18 | H | $CH_3CO$ | H | $CH_3$ | $CH_3$ | H | H | $CH_3$ | $CH_3$ |
| J-19 | H | 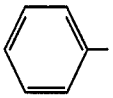 | H | $CH_3$ | $CH_3$ | H | H | $CH_3$ | $CH_3$ |
| J-20 | H | 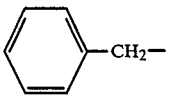 | H | $CH_3$ | $CH_3$ | H | H | $CH_3$ | $CH_3$ |
| J-21 | H | 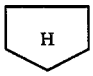 (Condensation) | | H | H | H | H | H | H |
| J-22 | H | 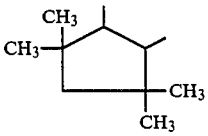 | | $CH_3$ | $CH_3$ | H | H | $CH_3$ | $CH_3$ |
| J-23 | H | 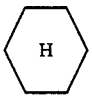 (Condensation) | | $CH_3$ | $CH_3$ | H | H | $CH_3$ | $CH_3$ |

-continued

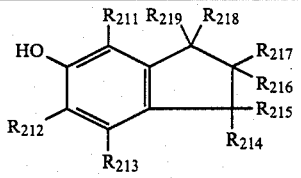

| Compound No. | $R_{211}$ | $R_{212}$ | $R_{213}$ | $R_{214}$ | $R_{215}$ | $R_{216}$ | $R_{217}$ | $R_{218}$ | $R_{219}$ |
|---|---|---|---|---|---|---|---|---|---|
| J-24 | $CH_3$ | 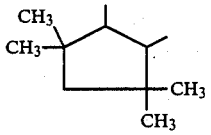 (Condensation) | | $CH_3$ | $CH_3$ | H | H | $CH_3$ | $CH_3$ |

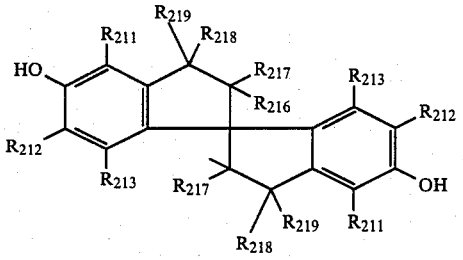

| Compound No. | $R_{211}$ | $R_{212}$ | $R_{213}$ | $R_{216}$ | $R_{217}$ | $R_{218}$ | $R_{219}$ |
|---|---|---|---|---|---|---|---|
| J-29 | H | H | H | H | H | $CH_3$ | $CH_3$ |

-continued

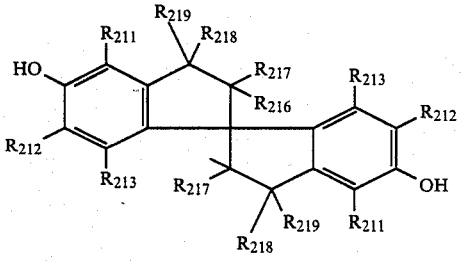

| Compound No. | $R_{211}$ | $R_{212}$ | $R_{213}$ | $R_{216}$ | $R_{217}$ | $R_{218}$ | $R_{219}$ |
|---|---|---|---|---|---|---|---|
| J-32 | $CH_3$ | H | H | H | H | $CH_3$ | $CH_3$ |

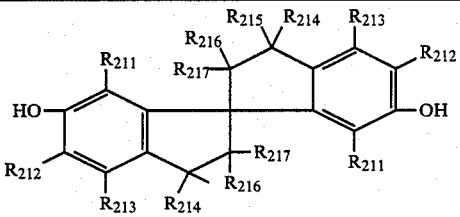

| Compound No. | $R_{211}$ | $R_{212}$ | $R_{213}$ | $R_{214}$ | $R_{215}$ | $R_{216}$ | $R_{217}$ |
|---|---|---|---|---|---|---|---|
| H-25 | H | $CH_3$ | H | $CH_3$ | $C_6H_5$ | H | H |
| H-26 | C— | C— | H | $CH_3$ | $CH_3$ | H | H |
| H-27 | H | OH | H | $CH_3$ | $CH_3$ | H | H |
| H-28 | H | $C_3H_7$ | H | $CH_3$ | $CH_3$ | H | H |
| H-30 | H | C— | H | $CH_3$ | $CH_3$ | H | H |
| H-31 | H | $C_2H_5$ | H | $CH_3$ | $CH_3$ | H | H |
| H-33 | $CH_3$ | $CH_3$ | H | $CH_3$ | $CH_3$ | H | H |
| H-34 | H | 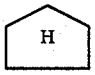 | H | $CH_3$ | $CH_3$ | H | H |
| H-35 | H | $CH_3$ | H | H | H | H | H |
| H-36 | H | H | H | 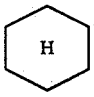 (Spiro) | | H | H |
| H-37 | $CH_3$ | H | H | $CH_3$ | $CH_3$ | H | H |
| H-38 | H | $CH_3$ | H | $CH_3$ | $C_6H_5$ | H | H |

-continued

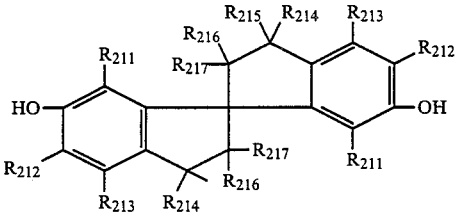

| Compound No. | $R_{211}$ | $R_{212}$ | $R_{213}$ | $R_{214}$ | $R_{215}$ | $R_{216}$ | $R_{217}$ |
|---|---|---|---|---|---|---|---|
| H-39 | 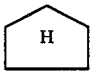 | H | H | $CH_3$ | $CH_3$ | H | H |
| H-40 | $CH_3$ | $CH_3$ | H | $C_2H_5$ | $C_2H_5$ | H | H |
| H-41 | H | H | H | H | H | $CH_3$ | $CH_3$ |
| H-42 | H | OH | H | 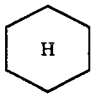 (Spiro) | | H | H |
| H-43 | H | 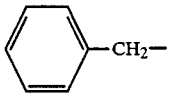 | H | H | H | H | H |
| H-44 | H | (t)$C_4H_9$ | H | $CH_3$ | $CH_3$ | H | H |
| H-45 | H | (t)$C_8H_{17}$ | H | $CH_3$ | $CH_3$ | H | H |

Formula [K]

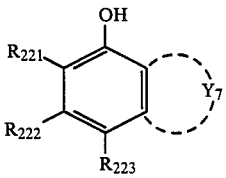

wherein $R_{221}$ and $R_{222}$ represent hydrogen, a halogen, an alkyl, alkenyl, aryl, acyl, acylamino, acyloxy, sulfonamido, cycloalkyl or alkoxycarbonyl group, respectively;

$R_{223}$ represents hydrogen, a halogen, an alkyl, alkenyl, alkoxy, hydroxy, aryl, aryloxy, acyl, acylamino, acyloxy, sulfonamido, cycloalkyl or alkoxycarbonyl group;

The above-mentioned groups may be substituted by the other substituents including, for example, an alkyl, alkenyl, alkoxy, aryl, aryloxy, hydroxy, alkoxycarbonyl, aryloxycarbonyl, acylamino, carbamoyl, sulfonamido, sulfamoyl or like group;

Further, $R_{221}$ and $R_{222}$, and $R_{222}$ and $R_{223}$ may close a ring with each other to form a 5- or 6-membered hydrocarbon ring which may further be substituted by a halogen, an alkyl, cycloalkyl, alkoxy, alkenyl, hydroxy, aryl, aryloxy, heterocyclic or like group; and $Y_7$ represents a group of atoms necessary for forming an indan ring which may also be substituted by a substituent capable of substituting the above-mentioned hydrocarbon ring; and may further form a spiro ring.

Among the compounds represented by the above-given Formula [K], the compounds particularly useful in the invention include those represented by the following Formulas [K-1] and [K-2]:

Formula [K-1]

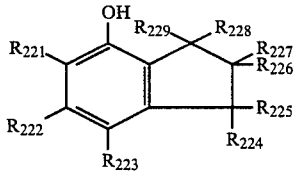

Formula [K-2]

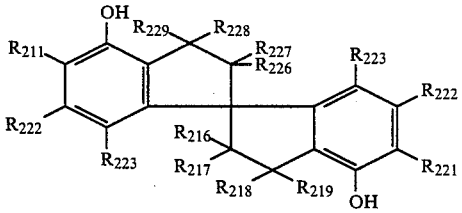

Formula [K-3]

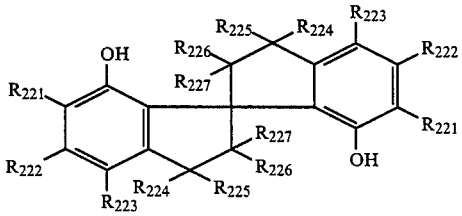

In the above-given Formulas [K-1] through [K-3], $R_{221}$, $R_{222}$ and $R_{223}$ ;*I are synonymous with those denoted in the Formula* [*K*]; *R*224, $R_{225}$, $R_{226}$, $E_{227}$, $R_{228}$ and $R_{229}$ represent hydrogen, a halogen, an alkyl, alkoxy, hydroxy, alkenyl, aryl, aryloxy or heterocyclic group; and, $R_{224}$ and $R_{225}$, $R_{225}$ and $R_{226}$, $R_{226}$ and $E_{227}$, $E_{227}$ and $R_{228}$, and $R_{228}$ and $R_{229}$ may close a ring with each other to form a hydrocarbon ring which may further be substituted by an alkyl group.

In the above-given Formulas [K-1] through [K-3], the particularly preferable compounds are those in which $R_{221}$ and $R_{222}$ represent hydrogen, an alkyl or cycloalkyl group; $R_{223}$ represent hydrogen, an alkyl, alkoxy, hydroxy or cycloalkyl group; and $R_{224}$, $R_{225}$, $R_{226}$, $E_{227}$, $R_{228}$ and $R_{229}$ represent hydrogen, an alkyl or cycloalkyl group.

The synthesizing processes of the compounds represented by the Formula [K] are already known. The compounds represented thereby may be prepared in accordance with the processes described in U.S. Pat. No. 3,057,929; 'Chem Ber.', 1972, 95(5), pp. 1673–1674; and 'Chemistry Letters', 1980, pp. 739–742.

The compounds represented by the Formula [K] are used in an amount of preferably from 5 to 300 mol% and more preferably from 10 to 200 mol%, to the magenta couplers used.

The typical examples of the compounds represented by the Formula [K] will be given below:

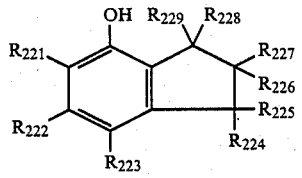

| Compound No. | $R_{221}$ | $R_{222}$ | $R_{223}$ | $R_{224}$ | $R_{225}$ | $R_{226}$ | $R_{227}$ | $R_{228}$ | $R_{229}$ |
|---|---|---|---|---|---|---|---|---|---|
| K-1 | H | H | H | H | H | H | H | H | H |
| K-2 | $CH_3$ | H | H | H | H | H | H | H | H |
| K-3 | H | H | H | H | H | H | H | $CH_3$ | $C_{16}H_{33}$ |
| K-4 | H | H | OH | H | H | H | H | H | H |
| K-5 | $CH_2{=}CHCH_2$ | H | C— | H | H | H | H | H | H |
| K-6 | H | H | H | H | H | H | H | $CH_3$ | $CH_3$ |
| K-7 | H | H | H | $CH_3$ | $CH_3$ | H | H | H | H |
| K-8 | H | H | H | $CH_3$ | $CH_3$ | $CH_3$ | H | H | H |
| K-9 | $CH_2{=}CHCH_2$ | H | $CH_3O$ | H | H | H | H | H | H |
| K-10 | H | H | H | $CH_3$ | $CH_3$ | H | H | $CH_3$ | $CH_3$ |
| K-11 | H | $C_3H_7$ | H | $CH_3$ | $CH_3$ | H | H | $CH_3$ | $CH_3$ |
| K-12 | C— | H | C— | H | H | H | H | $CH_3$ | $CH_3$ |
| K-13 | H | H | H | H | 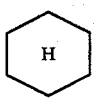 (Condensation) | | H | H | H |
| K-14 | H | H | H | H | H | H | H | 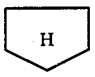 (Spiro) | |
| K-15 | H | 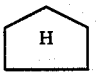 | H | $CH_3$ | $CH_3$ | H | H | $CH_3$ | $CH_3$ |
| K-16 | H | $CH_3SO_2NH$ | H | $CH_3$ | $CH_3$ | H | H | $CH_3$ | $CH_3$ |
| K-17 | H | $CH_3CO$ | H | H | H | H | H | $CH_3$ | $CH_3$ |
| K-18 | H | 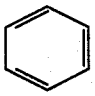 | H | $CH_3$ | $CH_3$ | H | H | $CH_3$ | $CH_3$ |
| K-19 | H | 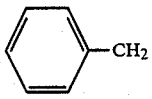 | H | $CH_3$ | $CH_3$ | H | H | $CH_3$ | $CH_3$ |

-continued

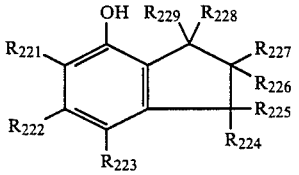

| Compound No. | $R_{221}$ | $R_{222}$ | $R_{223}$ | $R_{224}$ | $R_{225}$ | $R_{226}$ | $R_{227}$ | $R_{228}$ | $R_{229}$ |
|---|---|---|---|---|---|---|---|---|---|
| K-21 | 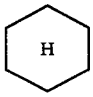 (Condensation) | | $CH_3$ | H | H | H | H | $CH_3$ | $CH_3$ |
| K-22 | H | H | H | $CH_3$ | 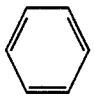 | H | H | $CH_3$ | $CH_3$ |

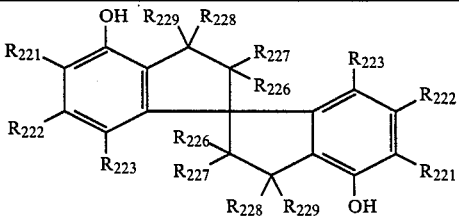

| Compound No | $R_{221}$ | $R_{222}$ | $R_{223}$ | $R_{226}$ | $R_{227}$ | $R_{228}$ | $R_{229}$ |
|---|---|---|---|---|---|---|---|
| K-23 | H | H | H | H | H | H | H |
| K-24 | H | H | OH | H | H | H | H |
| K-25 | $CH_3$ | H | $CH_3$ | H | H | H | H |
| K-26 | H | H | $CH_3$ | H | H | H | H |
| K-27 | C— | H | C— | H | H | $CH_3$ | $CH_3$ |
| K-28 | H | H | H | H | H | H | 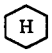 (Spiro) |
| K-29 | H | H | H | H | H | $CH_3$ | 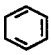 |
| K-30 | H | H | 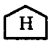 | H | H | H | H |
| K-31 | H | H | 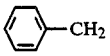 | H | H | $CH_3$ | $CH_3$ |
| K-36 | H | H | $(t)C_4H_9$ | H | H | $CH_3$ | $CH_3$ |

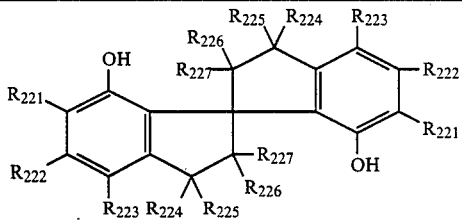

| Compound No. | $R_{221}$ | $R_{222}$ | $R_{223}$ | $R_{224}$ | $R_{225}$ | $R_{226}$ | $R_{227}$ |
|---|---|---|---|---|---|---|---|
| K-32 | H | H | H | H | H | H | H |
| K-33 | H | H | H | $CH_3$ | $CH_3$ | H | H |
| K-34 | H | H | $(t)C_4H_9$ | $CH_3$ | $CH_3$ | H | H |
| K-35 | H | H | $(t)C_8H_{17}$ | $CH_3$ | $CH_3$ | H | H |

Others:
K-20

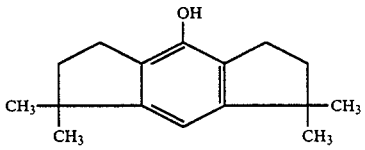

Formula [L]

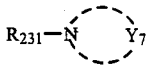

wherein $R_{231}$ represents an aliphatic group, a cycloalkyl group or an aryl group; and Y represents a group of non-metal atoms necessary for forming a 5-, 6- or 7-membered heterocyclic ring together with nitrogen; provided that, when there are two or more hetero atoms in a non-metal atom containing nitrogen atom forming the heterocyclic ring, at least two hetero atoms are not adjacent to each other.

The aliphatic groups represented by R include, for example, a saturated alkyl group which may have a substituent, and an unsaturated alkyl group which may have a substituent. Such saturated alkyl groups include, for example, a methyl, ethyl, butyl, octyl, dodecyl, tetradecyl, hexadecyl or like group; and such unsaturated alkyl groups include, for example, an ethenyl, propenyl or like group.

The cycloalkyl groups represented by $R_{231}$ are 5-, 6- or 7-membered cycloalkyl groups including, for example, a cyclopentyl, cyclohexyl or like group.

The aryl groups represented by $R_{231}$ include, for example, a phenyl group and a naphthyl group which are allowed to have a substituent.

The substituents of the aliphatic, cycloalkyl or aryl group represented by $R_{231}$ include, for example, an alkyl, aryl, alkoxy, carbonyl, carbamoyl, acylamino, sulfamoyl, sulfonamido, carbonyloxy, alkylsulfonyl, arylsulfonyl, hydroxy, heterocyclic, alkylthio, arylthio or like group; and each of these substituents may have a further substituent.

In the above-given Formula [L], $Y_7$ represents a group of non-metal atoms necessary for forming a 5-, 6- or 7-membered heterocyclic ring together with nitrogen, however, at least two of the non-metal atom groups each containing nitrogen forming the heterocyclic ring are to be hitherto atoms and, at the same time, the two hetero atoms are not to be adjacent to each other. In the heterocyclic ring of the compounds represented by the Formula [L], it is undesirable that all the hetero atoms are adjacent to each other, because it is unable to display the function of a magenta dye image stabilizer.

The 5-, 6- or 7-membered heterocyclic rings of the compounds represented by the Formula [L] are allowed to have such a substituent as an alkyl, aryl, acyl, carbamoyl, alkoxycarbonyl, sulfonyl or sulfamoyl group which may have a further substituent. In addition to the above, the 5-, 6- or 7-membered heterocyclic ring may also be saturated and a saturated heterocyclic ring is desired. It is further allowed that a benzene ring or the like may be condensed together with the heterocyclic ring or a spiro ring may be formed.

The compounds represented by the Formula [L] relating to the invention are to be used in an amount of preferably from 5 to 300 mol% and, more preferably, from 10 to 200 mol%, to the amount of the magenta couplers used.

The typical examples of the compounds represented by the Formula [L] will be given below:

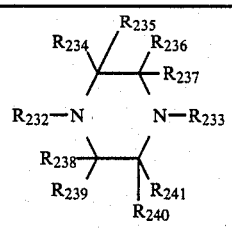

| | $R_{232}$ | $R_{233}$ | $R_{234}$ | $R_{235}$ | $R_{236}$ | $R_{237}$ | $R_{238}$ | $R_{239}$ | $R_{240}$ | $R_{241}$ |
|---|---|---|---|---|---|---|---|---|---|---|
| L-1 | $C_{12}H_{25}$ | $C_{12}H_{25}$ | H | H | H | H | H | H | H | H |
| L-2 | $C_{14}H_{29}$ | $C_{14}H_{29}$ | H | H | H | H | H | H | H | H |
| L-3 | $C_{14}H_{29}$ | H | H | H | H | H | H | H | H | H |
| L-4 | $C_{14}H_{29}$ | $CH_3CO$ | H | H | H | H | H | H | H | H |
| L-5 | $C_{16}H_{33}$ | $C_{16}H_{33}$ | H | H | H | H | H | H | H | H |
| L-6 | $C_{14}H_{29}$ | $CH_3$ | H | H | H | H | H | H | H | H |
| L-7 | 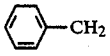 | 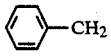 | H | H | H | H | H | H | H | H |
| L-8 | 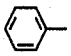 | 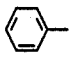 | H | H | H | H | H | H | H | H |
| L-11 | $CH_3$ | 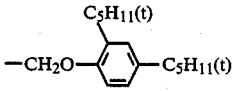 | H | H | H | H | H | H | H | H |
| L-13 | $C_{14}H_{29}$ | $C_4H_9NHCO$ | H | H | H | H | H | H | H | H |
| L-14 | $(t)C_8H_{17}$ | 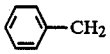 | H | H | H | H | H | H | H | H |
| L-15 | $C_{14}H_{29}$ | $CF_3CO$ | H | H | H | H | H | H | H | H |
| L-16 | $C_{14}H_{29}$ | $C_2H_5OCO$ | H | H | H | H | H | H | H | H |
| L-17 | $CH_3$ | 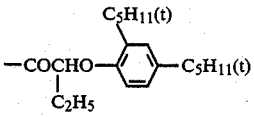 | H | H | H | H | H | H | H | H |
| L-18 | $C_{14}H_{29}$ | $C_{14}H_{29}$ | $CH_3$ | H | H | H | H | H | H | H |
| L-19 | $C_{14}H_{29}$ | $C_{14}H_{29}$ | $CH_3$ | H | H | H | H | H | $CH_3$ | H |
| L-20 | $C_{14}H_{29}$ | $C_{14}H_{29}$ | $CH_3$ | $CH_3$ | $CH_3$ | $CH_3$ | $CH_3$ | $CH_3$ | $CH_3$ | $CH_3$ |

-continued

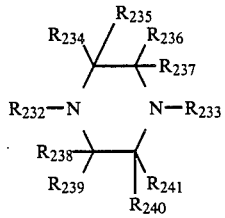

| | $R_{232}$ | $R_{233}$ | $R_{234}$ | $R_{235}$ | $R_{236}$ | $R_{237}$ | $R_{238}$ | $R_{239}$ | $R_{240}$ | $R_{241}$ |
|---|---|---|---|---|---|---|---|---|---|---|
| L-21 | $CH_3$ | 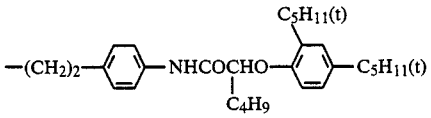 | H | H | H | H | H | H | H | H |
| L-22 | $C_{12}H_{25}$ | $CH_3$ | $CH_3$ | H | H | H | $CH_3$ | H | H | H |
| L-23 | $C_{12}H_{25}$ | $C_{12}H_{25}$ | $CH_3$ | H | H | H | H | H | $CH_3$ | H |
| L-24 | $C_{16}H_{33}$ | $C_{16}H_{33}$ | $CH_3$ | H | H | H | H | H | $CH_3$ | H |
| L-25 | $C_6H_5CH{=}CH{-}CH_2{-}$ | $C_{12}H_{25}$ | H | H | H | H | H | H | H | H |
| L-26 | $C_{12}H_{25}$ | $C_2H_5$ | $CH_3$ | H | H | H | H | H | H | H |
| L-27 | $C_{16}H_{33}$ | H | $C_2H_5$ | H | H | H | H | H | H | H |
| L-29 | $C_{14}H_{29}$ | $CH_2BrCH_2$ | H | H | H | H | H | H | H | H |
| L-30 | $CH_3O(CH_2)_4{-}$ | $CH_3O(CH_2)_4$ | H | H | H | H | H | H | H | H |

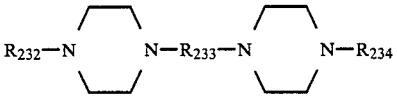

| | $R_{232}$ | $R_{233}$ | $R_{234}$ |
|---|---|---|---|
| L-9 | $C_{14}H_{29}$ | $(CH_2)_2$ | $C_{14}H_{29}$ |
| L-10 | $(t)C_8H_{17}$ | $(CH_2)_6$ | $(t)C_8H_{17}$ |
| L-12 | $C_{14}H_{29}$ | $CH_2$ | $C_{14}H_{29}$ |

-continued

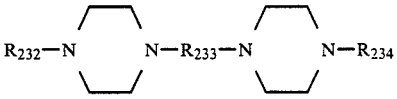

| | $R_{232}$ | $R_{233}$ | $R_{234}$ |
|---|---|---|---|
| L-28 | $C_{12}H_{25}$ | 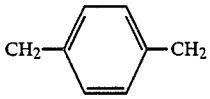 | $C_{12}H_{25}$ |

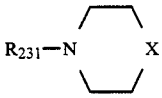

| | X | $R_{231}$ |
|---|---|---|
| L-31 | O | $C_{12}H_{25}$ |
| L-32 | O | $C_{14}H_{29}$ |
| L-33 | O | $C_6H_5CH{=}CH{-}$ |
| L-34 | O | 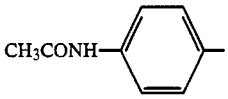 |
| L-35 | O | α-naphthyl |
| L-36 | O | 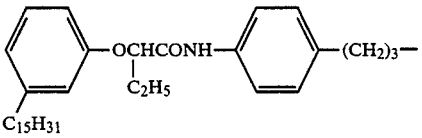 |
| L-37 | O | 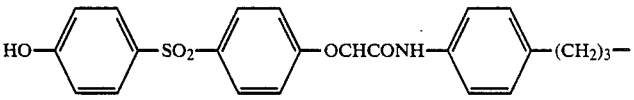 |

-continued
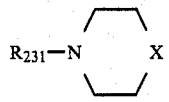
| | X | $R_{231}$ |
|---|---|---|
| L-38 | O | 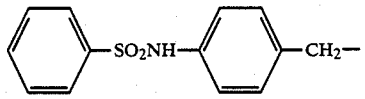 |
| L-39 | O | 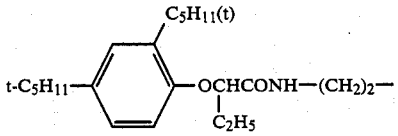 |
| L-40 | O | 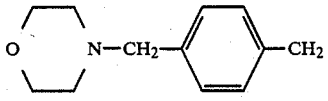 |
| L-41 | S | $C_{14}H_{29}$ |
| L-42 | S | 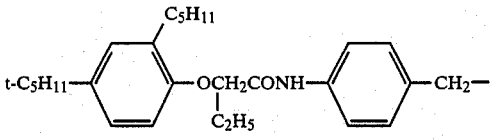 |
| L-43 | S | 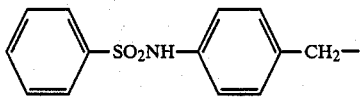 |
| L-44 | S | 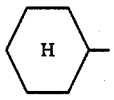 |
| L-45 | S | 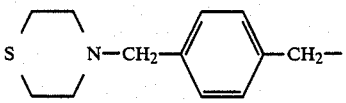 |
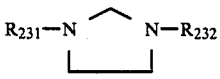
| | $R_{231}$ | $R_{232}$ |
|---|---|---|
| L-46 | $C_{12}H_{25}$ | $C_{12}H_{25}$ |
| L-47 | $C_{14}H_{29}$ | $C_{14}H_{29}$ |
| L-48 | $C_6H_5CH_2$ | $C_6H_5CH_2$ |
| L-49 | $C_{16}H_{33}$ | H |
| L-50 | $C_{16}H_{33}$ | $CH_3CO$ |
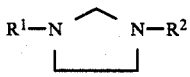
| | | |
|---|---|---|
| L-51 | $C_{16}H_{33}$ | $C_{16}H_{33}$ |
| L-52 | $C_{14}H_{29}$ | $C_{14}H_{29}$ |
| L-53 | $C_{12}H_{25}$ | $C_{12}H_{25}$ |
| L-54 | $C_{14}H_{29}$ | $CH_3CO$ |
| L-55 | $C_{14}H_{29}$ | $CF_3CO$ |

-continued
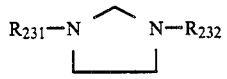
| | $R_{231}$ | $R_{232}$ |
|---|---|---|
| L-56 | $C_2H_5$ | 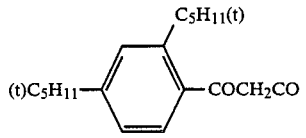 |
| L-57 | $C_{14}H_{29}$ | $C_2H_5OCO$ |
| L-58 | $C_{14}H_{29}$ | $CH_3NHCO$ |
| L-59 | $C_{14}H_{29}$ | $C_4H_9SO_2$ |
| L-60 | $C_{14}H_{29}$ | $(CH_3)_2NSO_2$ |
| L-61 | $C_{12}H_{25}$ | 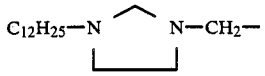 |
| L-62 | H | 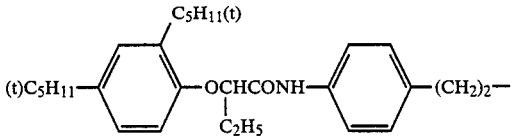 |
| L-63 | | 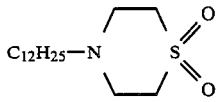 |
| L-64 | | 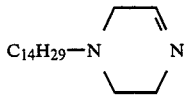 |
| L-65 | | 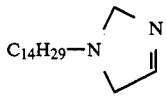 |
| L-66 | | 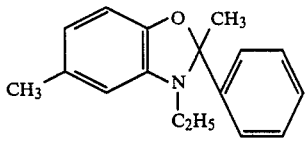 |
| L-67 | | 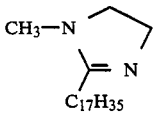 |
| L-68 | | 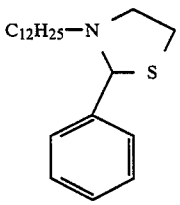 |

-continued

| $R_{231}$ | $R_{232}$ |
|---|---|
| L-69 | 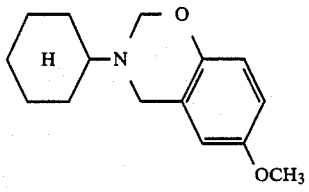 |
| L-70 | 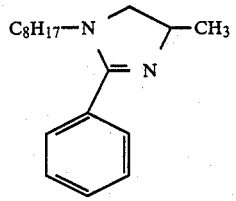 |
| L-71 | 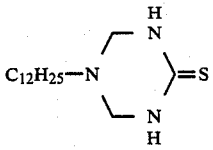 |
| L-72 | 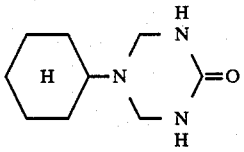 |
| L-73 | 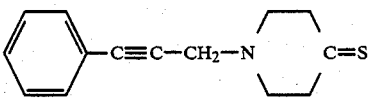 |
| L-74 | 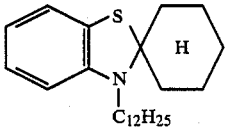 |

Among the compounds represented by the Formula [L], the piperazine compounds and the homopiperazine compounds are particularly preferred, and the compounds represented by the following Formula [L-1] or [L2] are further particularly preferred to use:

Formula [L-1]

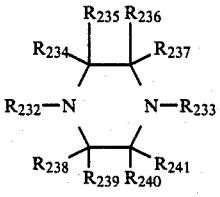

-continued

Formula [L-2]

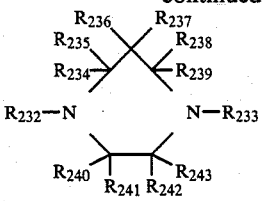

In the above-given Formulas [L-1] and [L-2], $R_{232}$ and $R_{233}$ represent hydrogen, an alkyl or aryl group, provided that $R_{232}$ and $R_{233}$ are not hydrogen at the same time; and $R_{234}$ through $R_{243}$ represent hydrogen, an alkyl or aryl group, respectively.

In the Formulas [L-1] and [L-2], $R_{232}$ and $R_{233}$ represent hydrogen, an alkyl or aryl group. The alkyl groups represented thereby include, for example, a methyl, ethyl, butyl, octyl, dodecyl, tetradecyl, hexadecyl, octadecyl or like group. The aryl groups represented thereby include, for example, a phenyl or like group. The alkyl groups and the aryl groups represented thereby may have substituents including, for example, a halogen, an alkyl, aryl, alkoxy, aryloxy and heterocyclic groups and the like.

A total number of the carbon atoms of $R_{232}$ and $R_{233}$ including the substituents thereof is preferably from 6 to 40.

In the above-given Formula [L-1] or [L-2], $R_{234}$ through $R_{243}$ represent hydrogen, an alkyl or aryl group. The alkyl groups represented thereby include, for example, a methyl, ethyl or like group, and the aryl groups represented thereby include, for example, a phenyl or like group.

The typical examples of the compounds represented by the Formula [L-1] or [L-2] are the same as those given in the exemplified piperazine compounds [L-1] through [L-30] and the exemplified homopiperazine compounds [L-51] through [L-62].

Next, the synthesis wexamples of the magenta dye image stabilizers represented by the aforegiven Formula [L], which are typically used in the invention, will be given below:

<Synthesis Example-1 (Synthesis of Compound L-2)>:

Nine (9) grams of piperazine and 55 g of myristyl bromide were dissolved in 100 ml of acetone and 15 g of anhydrous potassium carbonate were then added thereto. The resulted matter was boiled and refluxed for 10 hours so as to undergo a reaction. After the reaction, the resulted reactant solution was poured into 500 ml of water and an extraction was then tried with 500 ml of ethyl acetate. After the resulted ethyl acetate layer was dried with magnesium sulfate, the ethyl acetate was distilled off. Then, the white crystallized objective matter was obtained. The recrystallization thereof was made with 300 ml of acetone and, then, 34 g of white-flaky crystals were obtained (yield: 70%).

Melting point: 55° to 58° C.

<Synthesis Example-2 (Synthesis of Compound L-34)>:

Eighteen (18) grams of 4-morpholinaniline were dissolved in 100 ml of ethyl acetate and 12 ml of acetic anhydride were added thereto little by little while stirring and keeping the reactant solution at 20° C. After then, the resulted solution was ice-cooled and the resultantly deposited crystals were filtrated. The filtrated crystals were recrystallized with ethyl acetate and, then, 16.5 g of white powder-like crystals were obtained (yield: 75%).

Melting point: 207° to 210° C.

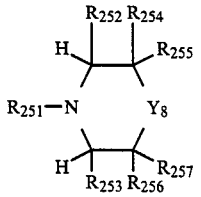

Formula [M]

wherein $R_{251}$ represents an aliphatic, cycloalkyl or aryl group; $Y_8$ represents a simple link or divalent hydrocarbon group which is necessary to form a 5- to 7-membered heterocyclic ring together with nitrogen; and $R_{252}$, $R_{253}$, $R_{254}$, $R_{255}$, $R_{256}$ and $R_{257}$ represent hydrogen, an aliphatic cycloalkyl or aryl group, provided that $R_{252}$ and $R_{254}$, and $R_{253}$ and $R_{256}$ may couple to each other to form a simple link so that an unsaturated 5- to 7-membered heterocyclic ring may be formed together with nitrogen and $Y_8$ and, when $Y_8$ is a simple link, $R_{255}$ and $R_{257}$ may couple to each other to form a simple link so that an unsaturated 5-membered heterocyclic ring may be formed together with nitrogen and $Y_8$ and further, when $Y_8$ is not a simple link, $R_{255}$ and $Y_8$, $R_{257}$ and $Y_8$, or $Y_8$ itself may form an unsaturated link so that an unsaturated 6- or 7-membered heterocyclic ring together with nitrogen and $Y_8$.

The aliphatic groups represented by $R_{251}$ include, for example, a saturated alkyl group which may have a substituent and an unsaturated alkyl group which may have a substituent. The saturated alkyl groups include, for example, a methyl, ethyl, butyl, octyl, dodecyl, tetradecyl, hexadecyl or like group. The unsaturated alkyl groups include, for example, an ethenyl, propenyl or like group.

The cycloalkyl groups represented by $R_{251}$ include, for example, such a 5- to 7-membered cycloalkyl group which may have a substituent as a cyclopentyl, cyclohexyl or like group.

The aryl groups represented by $R_{251}$ include, for example, a phenyl or naphthyl group which may have a substituent.

The substituents of the aliphatic, cycloalkyl and aryl groups each represented by $R_{251}$ include, for example, an alkyl, aryl, alkoxy, carbonyl, carbamoyl, acylamino, sulfamoyl, sulfonamido, carbonyloxy, alkylsulfonyl, hydroxy, heterocyclic, alkylthio and arylthio groups and the like; and these substituents each may have a further substotuent.

In the above-given Formula [M], $Y_8$ represents a simple link or divalent hydrocarbon group which is necessary to form a 5- to 7-membered heterocyclic ring together with nitrogen, however, when $Y_8$ is a simple link, $R_{255}$ and $R_{257}$ may couple to each other to form a simple link so that an unsaturated 5-membered heterocyclic ring may be formed and, when $Y_8$ is a divalent hydrocarbon group, i.e., a methylene group, $R_{255}$ and $Y_8$ or $R_{257}$ and $Y_8$ may form an unsaturated link so that an unsaturated 6-membered heterocyclic ring may be formed, and further, when $Y_8$ is an ethylene group, $R_{255}$ and $Y_8$, $R_{257}$ and $Y_8$ or $Y_8$ itself may form an unsaturated link so that an unsaturated 7-membered heterocyclic ring may be formed. In addition to the above, the divalent hydrocarbon groups represented by $Y_8$ may have substituents, respectively. Such substituents include, for example, an alkyl, carbamoyl, alkyloxycarbonyl, acylamino, sulfonamido, sulfamoyl, aryl, heterocyclic and like groups.

In the above-given Formula [M], $R_{252}$, $R_{253}$, $R_{254}$, $R_{255}$, $R_{256}$ and $R_{257}$ represent hydrogen, an aliphatic, cycloalkyl or aryl group. The aliphatic groups represented by $R_{252}$ through $R_{257}$ include, for example, a saturated alkyl group which may have a substituent and an unsaturated alkyl group which may have a substituent. The saturated alkyl groups include, for example, a methyl, ethyl, butyl, octyl, dodecyl, tetradecyl, hexadecyl and like groups; and the unsaturated alkyl groups include, for example, an ethenyl, propenyl and like groups.

The cycloalkyl groups represented by $R_{252}$ through $R_{257}$ include, for example, such a 5- to 7-membered cycloalkyl group which may have a substituent as a cyclopentyl, cyclohexyl or like group.

The aryl groups represented by $R_{252}$ through $R_{257}$ include, for example, a phenyl, a naaphthyl or like group which may have a substituet.

The substituents of the aliphatic, cycloalkyl and aryl groups represented by the above-denoted $R_{252}$ through $R_{257}$ include, for example, an alkyl, aryl, alkoxy, carbonyl, carbamoyl, acylamino, sulfamoyl, sulfonamido, cabonyloxy, alkylsulfonyl, arylsulfonyl, hydroxy, heterocyclic, alkylthio and like groups.

Among the compounds represented by the aforegiven Formula [M], those each having a 5- to 7-membered saturated heterocyclic ring are more preferable than those each having an unsaturated ring.

An amount of the compounds represented by the aforegiven Formula [M] to be used is preferably from 5 to 300 mol% and more preferably from 10 to 200 mol%, to the magenta couplers of the invention represented by the aforegiven Formula [I].

The typical examples of the compounds represented by the aforegiven Formula [M] will be give below:

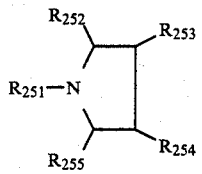

| | $R_{251}$ | $R_{252}$ | $R_{253}$ | $R_{254}$ | $R_{255}$ |
|---|---|---|---|---|---|
| M-1 | $C_8H_{17}$ | H | H | H | H |
| M-2 | 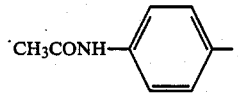 | H | H | H | H |
| M-3 | 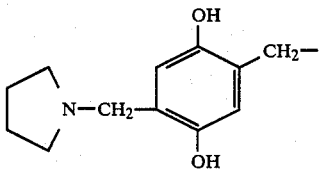 | H | H | H | H |
| M-4 | $C_{12}H_{25}$ | H | H | H | H |
| M-5 | $C_{14}H_{29}$ | H | H | H | H |
| M-6 | $C_{16}H_{33}$ | H | H | H | H |
| M-7 | $C_{14}H_{29}$ | H | 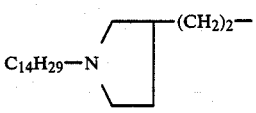 | H | H |
| M-8 | 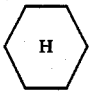 | $CH_3$ | $CH_3$ | H | H |
| M-9 | $C_5H_5CH{=}CHCH_2$— | H | H | H | H |
| M-10 | 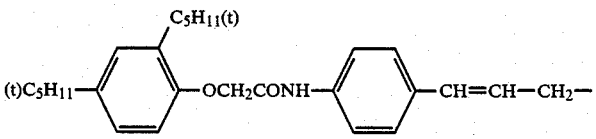 | H | H | H | H |

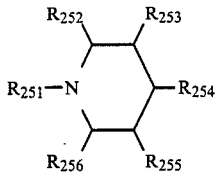
| | $R_{251}$ | $R_{252}$ | $R_{253}$ | $R_{254}$ | $R_{255}$ | $R_{256}$ |
|---|---|---|---|---|---|---|
| M-11 | (t)$C_8H_{17}$ | H | H | H | H | H |
| M-12 | 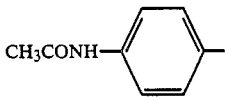 | H | H | H | H | H |
| M-13 | $C_{12}H_{25}$ | H | H | H | H | H |
| M-14 | $C_{14}H_{29}$ | H | H | H | H | H |
| M-15 | $C_{16}H_{33}$ | H | H | H | H | H |
| M-16 | $C_{14}H_{29}$ | $CH_3$ | H | H | H | H |
| M-17 | 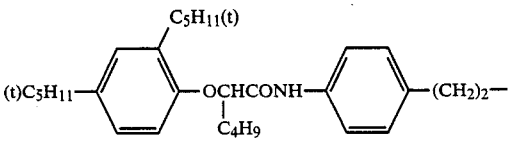 | | | H | H | H |
| M-18 | $C_8H_{17}$ | $CH_3$ | $CH_3$ | H | $CH_3$ | $CH_3$ |
| M-19 | 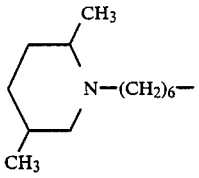 | $CH_3$ | H | H | $CH_3$ | H |
| M-20 | $CH_3$ | H | H | $C_{12}H_{25}OCOCH_2$— | H | H |
| M-21 | $CH_3$ | $CH_3$ | H | $C_{16}H_{33}OCOCH_2$— | H | $CH_3$ |
| M-22 | $CH_3$ | $C_{16}H_{33}$ | H | H | H | H |
| M-23 | $C_6H_5$ | H | H | $C_{12}H_{25}OCO$— | H | H |
| M-24 | $CH_3$ | $C_6H_5$ | H | H | H | H |
| M-25 | 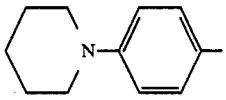 | H | H | H | H | H |
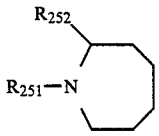
| | $R_{251}$ | $R_{252}$ |
|---|---|---|
| M-26 | $C_8H_{17}$ | H |
| M-27 | 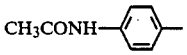 | H |
| M-28 | 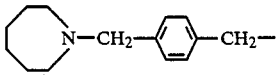 | H |
| M-29 | $C_{14}H_{29}$ | H |
-continued
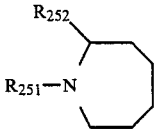
| | $R_{251}$ | $R_{252}$ |
|---|---|---|
| M-30 | 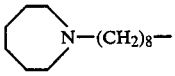 | H |
| M-31 | $C_{16}H_{33}$ | $CH_3$ |
| M-32 | 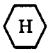 | H |
| M-33 | 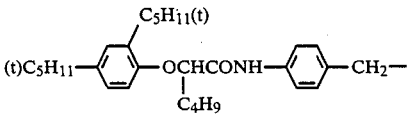 | H |

-continued

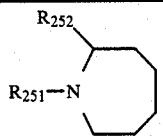

| | $R_{251}$ | $R_{252}$ |
|---|---|---|
| M-34 | 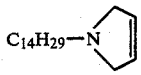 | |
| M-35 | 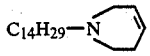 | |
| M-36 | 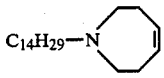 | |
| M-37 | 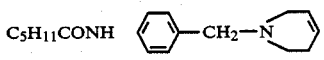 | |
| M-38 | 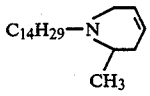 | |
| M-39 | 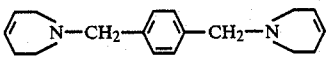 | |
| M-40 | 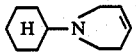 | |
| M-41 | 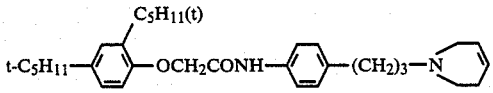 | |

Next, the typical synthesis examples of the compounds represented by the Formula [K] will be given below:

<Synthesis Example-1 (Synthesis of Compound K-14)>:

Nine (9) grams of piperazine and 28 g of myristyl bromide were dissolved in 60 ml of acetone and 6.0 g of anhydrous potassium carbonate were then added thereto. The resulted matter was boiled and refluxed for 20 hours so as to undergo a reaction. After the reaction, the resulted reactant solution was poured into 300 ml of water and an extraction was then tried with 300 ml of ethyl acetate. After the resulted ethyl acetate layer was dried with magnesium sulfate, the ethyl acetate was distilled off. Then, the white crystallized objective matter was obtained. The recrystallization thereof was made with 100 ml of acetone and, then, 12 g of white-flaky crystals were obtained (yield: 43%).

Melting point: 175° to 180° C.

The hydrophilic colloidal layers such as a protective layer, an interlayer and the like of the color photographic light-sensitive materials of the invention are allowed to contain an ultraviolet absorving agent with the purposes of preventing a fog caused by a static discharge generated by rubbing the light-sensitive materials and avoiding the deterioration of an image caused by exposing the light-sensitive materials to ultraviolet rays.

To the color photographic light-sensitive materials of the invention, there may be provided with the supplementary layers such as a filter layer, an antihalation layer and/or an antiirradiation layer. These layers and/or emulsion layers may also contain such a dyestuff as is capable of flowing out from the light-sensitive materials or being bleached, in a developing process.

To the silver halide emulsion layers and/or the other hydrophilic colloidal layers of the silver halide color photographic light-sensitive materials of the invention, there may be added with a matting agent with the purposes of reducing the gross of the light-sensitive materials and improving the retouchability and further avoiding the adhesion of the light-sensitive materials to each other.

To the silver halide color photographic light-sensitive materials of the invention, there may be added with a sliding agent with the purpose of reducing a sliding friction.

To the silver halide color photographic light-sensitive materials of the invention, there may be added with an antistatic agent with the purpose of preventing a static charge. Such an antistatic agent is sometimes provided to an antistatic layer arranged to the side of the support of the light-sensitive material whereon no emulsion is coated, or the antistatic agent may also be provided, in other cases, to a protective layer other than the emulsion layers, which is arranged to the side of the emulsion layer and/or the support whereon the emulsion is coated.

To the photographic emulsion layers and/or the other hydrophilic colloidal layers of the silver halide color photographic light-sensitive materials of the invention, various surface active agents may be applied with the purposes of improving the coating behavior, preventing the static charge, improving the slidability, improving the emulsification-dispersion property, preventing the adhesion, improving the photographic characteristics such as a development acceleration, hardening, sensitization, and the like.

In the light-sensitive materials using the silver halide emulsions of the invention, the supports thereof on which the photographic emulsion layers and other layers are coated include, for example, such a reflection type flexible support as a baryta paper or an α-olefin polymer coated paper, a synthetic paper and the like; such a semisynthetic or synthesized polymeric film as those of cellulose acetate, cellulose nitrate, polystyrene, polyvinyl chloride, polyethyleneterephthalate, polycarbonate, polyamide or the like; such a solid matter as a glass, metal, ceramic or like plate; and the like.

The silver halide color photographic light-sensitive materials of the invention may be coated to the surface of the support thereof directly or with the interposition of one or not less than two subbing layers between them for improving the surface of the support on its adhesion property, antistatic property, dimensional stability, abrasion resistance, hardness, antihalation property, friction property and/or other properties, after applying a corona discharge, an ultraviolet ray irradiation, a flame treatment or the like to the surface of the support, if required.

In coating the color photographic light-sensitive materials of the invention, a thickening agent may be used to improve the coatability. An extrusion coating method and a curtain coating method are particularly useful for this purpose, because two or more layers may be coated at the same time in these methods.

The color photographic light-sensitive materials of the invention can be exposed to the electromagnetic waves within a certain spectral region to which an emulsion layer forming the light-sensitive material is sensitive. There may be used any one of the well-known light sources for this purpose, including, for example, the rays of light emitted from a phosphor excited by natural light (i.e., daylight), a tungsten lamp, a fluorescent lamp, a mercury lamp, a xenon arc lamp, a carbon arc lamp, a xenon flash lamp, a cathode-ray tube (CRT) flying spot, various laser-beams, a light-emitting diode (LED) light, an electron beam, an X-ray beam, a $\gamma$-ray beam, an $\alpha$-ray beam and the like.

It is allowed to apply not only an exposure time from one millisecond to one second that is for the normal shutter speeds of a popular type camera, but also such an exposure time faster than one microsecond as those from 100 microseconds to one microsecond made with a CRT or a xenon flash lamp, and besides the above, a longer exposure not shorter than one second may also be made. Such exposures may further be made continuously or intermittently, either.

The silver halide color photographic light-sensitive materials of the invention are particularly suitable for direct appreciation type color prints, and it is desired that the reflection type supports to be used in the invention are to be in white visually. There is a whiteness provided for the characteristics representing a degree of white color, such as (L*, a* and b*), i.e., the values of whiteness measured in the methods each specified in Japanese Industrial Standards, Z-8722 and Z-8730. According to the above-mentioned methods, L* is preferably not less than 80 and, more preferably, not less than 90, and a* is preferably within the range of from $-1.0$ to $+1.0$ and b* is preferably within the range of from $-2.0$ to $-5.0$. Further, among the typical layer arrangements of the silver halide color photographic light-sensitive materials of the invention, the particularly preferable ones are those arranged on the support, in order from the support side, with a yellow-dye image forming layer, an interlayer, a magent-dye image forming layer of the invention, an interlayer containing a UV absorbing agent, a cyan-dye image forming layer, an interlayer containing a UV absorbing agent and a protective layer.

With the silver halide color photographic light-sensitive materials of the invention, an image can be formed by a color development thereof.

In the invention, the aromatic primary amine color developing agents to be used in a color developer include any well-known ones being popularly used in various color photographic processes. These developers include, for example, an aminophenol derivative and a p-phenylenediamine derivative. These compounds are generally used in the form of the salts thereof, such as a chloride or sulfate, rather than in the free state, because the salts are more stable. Such compounds are generally used at a cendensation of from about 0.1 g to about 30 g per liter of a color developer and more preferably from about 1 g to about 15 g per liter of the color developer used.

Such aminophenol developers include, for example, o-aminophenol, p-aminophenol, 5-amino-2-oxytoluene, 2-amino-3-oxytoluene, 2-oxy-3-amino-1,4-dimethylbenzene, and the like.

The particularly useful aromatic primary amine color developers include, for example, a N,N'-dialkyl-p-phenylene diamine compound, and the alkyl and phenyl groups thereof may be substituted by any arbitrary substituents. Among the compounds, the particularly useful compounds include, for example, a N,N'-diethyl-p-phenylenediamine chloride, a N-methyl-p-phenylenediamine chloride, a N,N'-dimethyl-p-phenylenediamine chloride, 2-amino-5-(N-ethyl-N-dodecylamino)-toluene, a N-ethyl-N-$\beta$-methanesulfonamidoethyl-3-methyl-4-aminoaniline sulfate, N-ethyl-N-$\beta$-hydroxyethylaminoaniline, 4-amino-3-methyl-N,N'-diethylaniline, 4-amino-N-(2-methoxyethyl)-N-ethyl-3-methylaniline-p-toluene sulfonate, and the like.

In the processes of the invention, the color developers used contain the above-mentioned aromatic primary amine color developing agents and in addition they are further allowed to contain any various components which are normally added to color developers, including, for example, such an alkalizer as sodium hydroxide, sodium carbonate, potassium carbonate; an alkali metal sulfite, an alkali metal bisulfite, an alkali metal thio-cyanate, an alkali metal halide, benzyl alcohol, a water softening agent, a thickening agent and the like. A pH value of the above-mentioned color developers is normally not lower than 7 and most popularly from about 10 to about 13.

In the invention, a color photographic light-sensitive material for printing use is color-developed and is then processed with a processing liquid capable of fixing the light-sensitive material. When the processing liquid capable of fixing is a fixer, a bleaching step is to be taken before the fixing step. As for bleaching agents to be used in such a bleaching step, the metallic complex salts of an organic acid are used. Such metallic complex salts have the function that a metallic silver produced by a development is oxidized and restored to the silver halide thereof and, at the same time, the undeveloped color portions of a color-developing chemical are color-developed. Such a metal complex salts is composed of an aminopolycarboxylic acid or such an organic acid as oxalic acid, citric acid or the like, with which such a metal ions as that of iron, cobalt, copper or the like are coordinated. The organic acids most preferably useful to form such a metal complex salt thereof as mentioned above include, for example, a polycarboxylic acid or aminocarboxylic acid. These polycarboxylic acid or aminocarboxylic acid may alternatively be an alkali metallic salt, an ammonium salt or a water-soluble amine salt.

The typical examples thereof may be given below:

[1] Ethylenediaminetetraacetic acid,
[2] Nitrilotriacetic acid,
[3] Iminodiacetic acid,
[4] Disodium ethylenediaminetetraacetate,
[5] Tetra(Tri)methylammonium ethylendiaminetetraacetate
[6] Tetrasodium ethylenediaminetetraacetate, and
[7] Sodum nitrilotriacetate.

The bleaching agents to be used therein contain various additives as well as the above-mentioned metallic complex salts of the organic acids to serve as the bleaching agents. It is desirable that such an additive contains an alkali halide or ammonium halide in particular including, for example, a rehalogenater such as potassium bromide, sodium bromide, sodium chloride, ammonium bromide or the like, a metallic salt and a chelating agent.

It is also allowed to suitably add such a matter as a borate, oxalate, acetate, carbonate, phosphate or like salts which is well-known to be put into a pH buffer, and such a metter as an alkylamine, polyethylene oxide or the like which is well-known to be put into an ordinary type bleaching liquid.

In addition to the above, the fixers and the bleach-fixers are also allowed to contain a single or not less than two kinds of pH buffers comprising such a sulfite as ammonium sulfite, potassium sulfite, ammonium bisulfite, potassium bisulfite, sodium bisulfite, ammonium metabisulfite, potassium metabisulfite, sodium metabisulfite and the like, and various kinds of salts such as a boric acid, borax, sodium hydroxide, potassium hydroxide, sodum carbonate, potassium carbonate, sodium bisulfite, sodium bicarbonate, potassium bicarbonate, acetic acid, sodium acetate, ammonium hydroxide and the like.

When a process of the invention is carried out while adding a bleach-fix replenisher to a bleach-fix solution (bath), the bleach-fix solution (bath) may contain a thiosulfate, a thiocyanate, a sulfite or the like, or the bleach-fix replenisher may contain the above-mentioned salts to be replenished to a processing bath.

In the invention, for a further activation of a bleach-fixer, the air or oxygen may be blown, if desired, through the bleach-fixing bath and the reservoir of a bleach-fix replenisher, or such a suitable oxidizer as hydrogen peroxide, a bromate, a persulfate and the like may suitably be added thereto.

When the silver halide color photographic hight-sensitive material of the invention are applied to a printing use, a high blue sensitivity is exhibited, and the green hue reproductivity is improved. In addition, the range of color reproducibility from blue to red, which is formed with a magenta color developing dye and a cyan color developing dye or a yellow color developing dye, is widened.

EXAMPLE

The invention is described further in detail by showing the embodied examples as follows. However, the modes of the invention shall not be limited to them.

Example 1

The coating liquids were prepared according to the constitutions shown in Tables 1 and 2, and coated in order on the support to make a multilayered silver halide color photographic light-sensitive material.

After being exposed according to a prescribed testing manner, the obtained sample was treated under the following processing conditions

| (Developing Processing) | | |
|---|---|---|
| Color developing | 38° C. | 3½ minutes |
| Bleach/fix | 33° C. | 1½ minutes |
| Washing | 25–30° C. | 3 minutes |
| Drying | 75–80° C. | ca. 2 minutes |

The composition of the treating solutions used in each process were as follows:

| | |
|---|---|
| (Color Developer) | |
| Benzyl alcohol | 15 ml |
| Ethyleneglycol | 15 ml |
| Potassium sulfite | 2.0 g |
| Potassium bromide | 0.7 g |
| Sodium chloride | 0.2 g |
| Potassium carbonate | 30.0 g |
| Hydroxylamine sulfate | 3.0 g |
| Polyphosphoric acid (TPPS) | 2.5 g |
| 3-Methyl-4-amino-N—ethyl-N—(B-methane sulfonamido ethyl) aniline sulfate | 5.5 g |
| Optical brightening agent (4,4-Diaminostilbendisufonic acid derivative | 1.0 g |
| Potassium hydroxide | 2.0 g |
| Water | to make 1000 ml |
| pH | adjusted to 10.20 |
| (Bleach-fixer) | |
| Ferric ammonium ethylenediaminetetro-acetate | 60 g |
| Ethylenediaminetetraacetic acid | 3 g |
| Ammonium thiosulfate (70% soln.) | 100 ml |
| Ammonium sulfite (40% soln.) | 27.5 ml |
| Potassium carbonate or glacial acetic acid | pH = 7.1 |
| Water | to make 1000 ml |

TABLE 1

| Layer | Constitution |
|---|---|
| 7th layer (A protective layer) | Gelatin (1.0 g/m$^2$) |
| 6th layer (The 3rd intermediate layer) | Gelatin (1.0 g/m$^2$)<br>UV absorbers:<br>UV-1 (0.2 g/m$^2$)<br>UV-2 (0.1 g/m$^2$)<br>Antistaining agent AS-1 (0.02 g/m$^2$)<br>High-boiling solvent<br>Dinoyl phthalate (0.2 g/m$^2$) |
| 5th layer (A red-sensitive layer) | Gelatin (1.2 g/m$^2$)<br>Silver chlorobromide<br>Emulsion [contg. 70 mol % AgBr] (Ag 0.25 g/m$^2$)<br>Cyan coupler [C-29/C-47] (0.4 mol per mol of a silver halide)<br>Antistaining agent AS-1 (0.01 g/m$^2$)<br>High-boiling solvent<br>Dinonyl phthalate (0.2 g/m$^2$)<br>Sensitizing dye D-4 ($2 \times 10^{-5}$ mol per mol of a silver halide) |
| 4th layer (The 2nd intermediate layer) | UV absorbers:<br>UV-1 (0.5 gm$^2$)<br>UV-2 (0.2 g/m$^2$)<br>Antistaining agent AS-1 |

TABLE 1-continued

| Layer | Constitution |
|---|---|
| | (0.03 g/m$^2$) |
| | High-boiling solvent |
| | Dinonyl phthalate (0.3 g/m$^2$) |
| 3rd layer | Gelatin (1.5 g/m$^2$) |
| (A green-sensitive layer) | Emulsion [contg. 70 mol % AgBr] |
| | (See Table 2.) |
| | Magenta coupler* (0.4 g/m$^2$) |
| | Antistaining agent AS-1 |
| | (0.01 g/m$^2$) |
| | High-boiling solvent |
| | Dinonyl phthalate (0.25 g/m$^2$) |
| | Sensitizing dye D-3 |
| | ($2 \times 10^{-4}$ mol per mol of a silver halide) |
| 2nd layer | Antistaining agent AS-1 |
| (The 1st intermediate layer) | (0.07 g/m$^2$) |
| | High-boiling solvent |
| | Dinonyl phthalate (0.4 g/m$^2$) |
| 1st layer | Gelatin (2.0 g/m$^2$) |
| (A blue-sensitive layer) | silver chlorobromide emulsion** |
| | (Ag 0.3 g/m$^2$) |
| | Yellow coupler Y-1 (0.8 g/m$^2$) |
| | Antistaining agent AS-1 |
| | (0.02 g/m$^2$) |
| | High-boiling solvent |
| | Dinonyl phthalate (0.3 g/m$^2$) |
| Support | Polyethylene-coated paper*** |

Coating or added amount is shown in parenthesis.
*Shown in Table 2.

[Method of Preparing A Silver Chlorobromide Emulsion]

In a double-jet precipitation process taken constantly at pAg 8.2 and pH=3.0, grains were grown while the adding amounts ofboth a silver salt and a halide solution were being controlled, and then, after adjusting the pH value to 6.0, the emulsion was desalted and washed in a usual way.

Thus obtained silver chlorobromide emulsion was composed of octehedral grains as shown below.

| | |
|---|---|
| Grain size (μm) | 0.70 |
| Coefficient of variation (%) | 10 |
| K | 0.5 |
| Content of AgBr (mol %) | 90 |

Then, this emulsion was divided, and then each of the aliquot perts was sulfur sensitized, and color sensitized with the sensitizing dyes ($3.0 \times 10^{-4}$ mol per mol of AgX) shown in Table 2, respectively.

*** Polyethylene-coated paper:

One side of a paper support was extrusion-coated, at a rate of 25 g/m$^2$, with polyethylene containing 15 g of titanium dioxide per 100 g of the polyethylene, and then the other side of the support was extrusion-coated, at a rate of 25 g/m$^2$, with polyethylene without containing any titanium dioxide so as to make a both-side polyethylene-coated paper support.

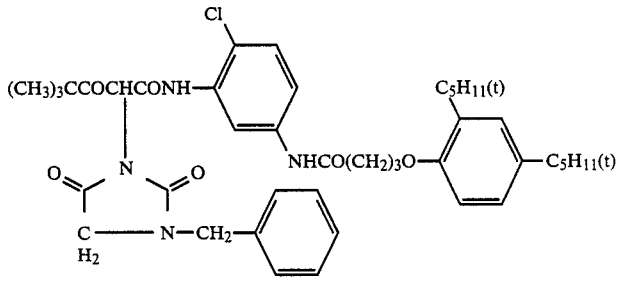

Yellow couper (Y-1)

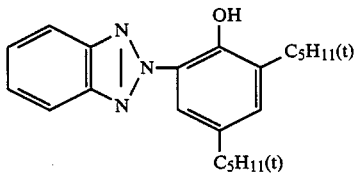

UV-absorber (UV-1)

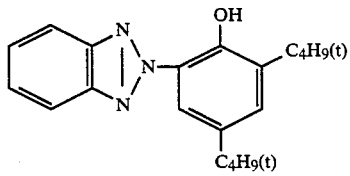

UV-absorber (UV-2)

-continued

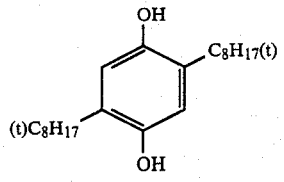

Antistaining agent (AS-1)

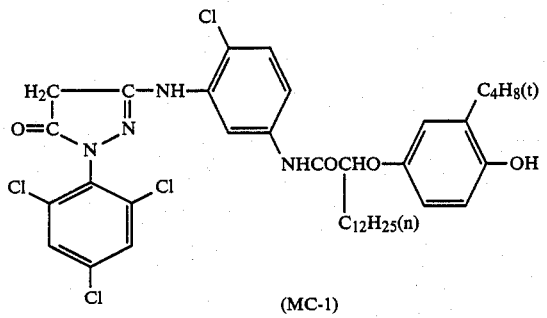

(MC-1)

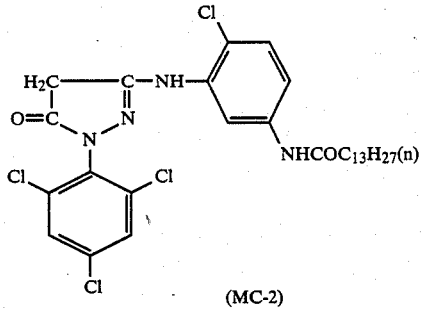

(MC-2)

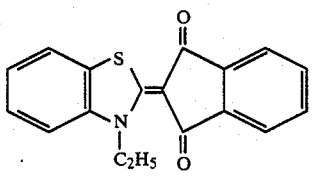

Comparative sensitizing dye CD-1

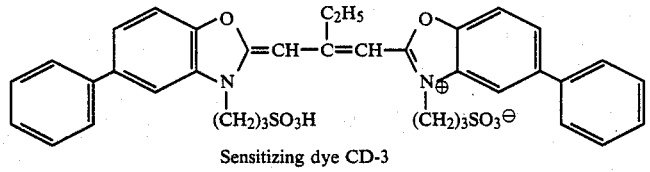

Sensitizing dye CD-3

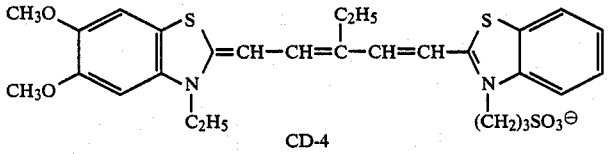

CD-4

[Method of Measuring Blue Sensitivity]

With respect to the Samples, each blue sensitivity was measured by that each of the above samples was wedge-exposed, processed and dried according to the above-mentioned processes, and then submitted to sensitormetry in a usual way using Sakura Color Densitometer Model PDA-60 (Konishiroku Photo Ind. Co., Ltd.). The results are shown in Table 2 in terms of the relative values to the blue sensitivity of Sample No. 5 as 100.

[Method of Evaluation Green Hue Reproduction]

A Macbeth color checker was photographed on a Sakura Color film, SR 100, and the negatives thus obtained were printed on each of the above samples using a Sakura Color Printer, 7NII. The printing conditions were selected so that L*, U', and V' in reproction of the neutral 5- color chip come out to the same, respectively, as those by the expressing method (described in JIS Z 8729-1980) according to the L* U* V* color specification system.

Then L*, U', and V', which were simultaneously reproduced, of the green color chip of the Macbeth color checker were obtained, and U' and V' were shown as differences (ΔU' and ΔV') from those of the original color chip, respectively. The results are shown in Table 2.

[Method of Evaluating Blue to Red Color Reproduction]

A U', V'-chromacity diagram at L*=50 was made out according to the above-mentioned expressing method in terms of L*, U*, V* of the color specification system, using each of the above samples, the areas of reproduction of from blue to red color, which was formed with the magenta color developing dye and the cyan color developing dye, or the yellor color developing dye, was expressed in terms of relative areas to that of Sample No. 5.

The results are shown in Table 2.

No. 5 and No. 6 where the conventionally known magenta couplers other than those of the invention were used, ΔU' and ΔV' indicate the reproduction of the green hue getting out of position toward bluish green from that of the original color chip, resulting in a relatively poor color reproducibility. On the other hand, in samples No. 7 to 13, where the magenta couplers of the invention were used, the reproductivity of reen hue is much improved, and the area of blue to red color reproduction is widened in comparison with samples No. 5 and No. 6. These results indicate the silver halide color photographic light-sensitive material of the invention has a high blue sensitivity and an improved color reproductivity.

EXAMPLE 2

Samples were prepared in the same way as in Example 1, except that yellow coupler Y-1, cyan coupler C-29/C-47, comparative magenta coupler MC-2 and comparative sensitizing dye DC-1 in Example 1 were changed to Y-2, C-36, MC-3 and CD-2 respectively, and that the constitution in Table 2 for Example 1 was changed to the constitution in Table 3, and the samples wereexposed, processed, dried, and then submitted to the tests as in Example 1. The results are shown in Table 3.

TABLE 2

| | Constitution | | | | Results | | | | | |
|---|---|---|---|---|---|---|---|---|---|---|
| | | Spectral Sensitivity in color sensitized area; max. | | Ag of green-sensitive layer | Blue-sensitivity | Green hue reproducibility | | | Area of blue to red | |
| No. | Sensitizing dye | wavel. (nm) | Magenta coupler | (g/m²) | | L* | ΔU' | ΔV' | reproduction | Remark |
| 1 | — | — | MC-1 | 0.35 | 15 | 50 | −0.002 | −0.002 | 97 | comparison |
| 2 | — | — | 59 | 0.18 | 14 | 50 | −0.002 | −0.001 | 112 | " |
| 3 | CD-1 | 425 | MC-1 | 0.35 | 17 | 50 | −0.003 | −0.003 | 98 | " |
| 4 | CD-1 | 425 | 59 | 0.18 | 16 | 50 | −0.003 | −0.002 | 113 | " |
| 5 | A-12 | 472 | MC-1 | 0.35 | 100 | 50 | −0.09 | −0.014 | 100 | " |
| 6 | A-12 | 472 | MC-2 | 0.35 | 100 | 50 | −0.09 | −0.015 | 99 | " |
| 7 | A-12 | 472 | 59 | 0.18 | 101 | 50 | −0.002 | −0.003 | 114 | Invention |
| 8 | A-13 | 470 | 59 | 0.18 | 101 | 50 | −0.001 | −0.002 | 113 | " |
| 9 | A-15 | 475 | 59 | 0.18 | 99 | 50 | −0.001 | −0.002 | 114 | " |
| 10 | A-11 | 468 | 59 | 0.18 | 99 | 50 | −0.002 | −0.002 | 113 | " |
| 11 | A-3 | 467 | 59 | 0.18 | 100 | 50 | −0.001 | −0.003 | 113 | " |
| 12 | B-6 | 463 | 59 | 0.18 | 95 | 50 | −0.001 | −0.002 | 112 | " |
| 13 | B-4 | 466 | 59 | 0.18 | 97 | 50 | −0.002 | −0.002 | 112 | " |

As seen in Table 2, the blue-sensitivity comes out sharply high in samples No. 5 to No. 13, where was used the silver halide emulsion of the invention, which the maximum value of color sensitized spectral sensitivity is from not less than 450 to less than 500 nm, in comparison with samples No. 1 to No. 4. However, in samples

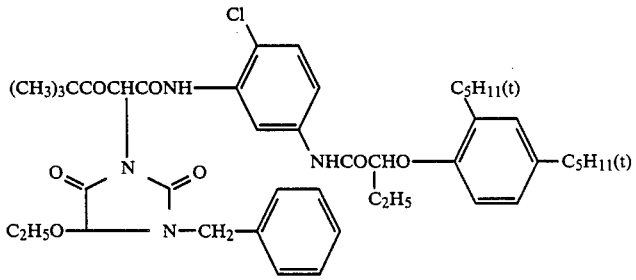

(Y-2)

-continued

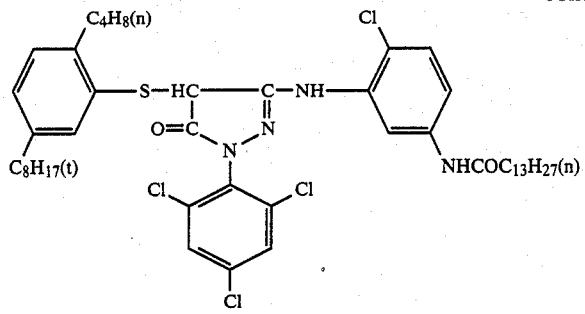

Comparative magenta coupler MC-3

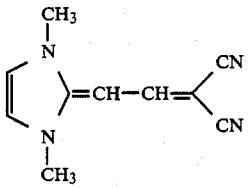

Comparative sensitizing dye CD-2

TABLE 3

| | Constitution | | | | Results | | | | | |
|---|---|---|---|---|---|---|---|---|---|---|
| | | Spectral Sensitivity in color sensitized area; max. | | Ag of green-sensitive layer | | Gree hue reproducibility | | | Area of blue to red | |
| No. | Sensitizing dye | wavel. (nm) | Magenta coupler | (g/m²) | Blue-sensitivity | L* | ΔU' | ΔV' | reproduction | Remark |
| 14 | — | — | MC-3 | 0.18 | 15 | 48 | +0.002 | +0.002 | 96 | comparison |
| 15 | — | — | 44 | " | 15 | 48 | +0.003 | +0.002 | 112 | " |
| 16 | CD-2 | 424 | MC-3 | " | 33 | 48 | +0.002 | +0.001 | 98 | " |
| 17 | " | 424 | 44 | " | 34 | 48 | +0.001 | +0.001 | 113 | " |
| 18 | A-12 | 472 | MC-3 | " | 100 | 48 | −0.005 | −0.012 | 100 | " |
| 19 | " | 472 | 44 | " | 100 | 48 | 0 | +0.001 | 113 | Invention |
| 20 | " | 472 | 45 | " | 100 | 48 | +0.001 | +0.001 | 113 | " |
| 21 | " | 472 | 22 | " | 100 | 48 | 0 | +0.001 | 112 | " |
| 22 | " | 472 | 60 | " | 100 | 48 | 0 | +0.001 | 113 | " |
| 23 | " | 472 | 99 | " | 100 | 48 | +0.001 | 0 | 113 | " |
| 24 | " | 472 | 127 | " | 100 | 48 | 0 | 0 | 112 | " |
| 25 | " | 472 | 5 | " | 100 | 48 | +0.001 | +0.001 | 113 | " |
| 26 | " | 472 | 18 | " | 100 | 48 | 0 | +0.001 | 113 | " |

As seen in Table 3, similarly to the case of Example 1, it is clear that samples No. 19 to No. 26 of the silver halide color photosensitive materials of the invention have a high blue-sensitivity, an improved reproducibility of green hue, and a widened area of blue to red color reproduction, in comparison with comparative samples No. 14 to No. 17.

What is claimed is:

1. A silver halide photographic light-sensitive material comprising a substrate and blue-sensitive silver halide emulsion layer, a green-sensitive silver halide emulsion layer and red-sensitive silver halide emulsion layer provided thereon, wherein silver halide grains contained in said blue-sensitive silver halide emulsion layer are optically sensitized to make a maximum spectral sensitivity at a wavelength region from 450 nm to 500 nm, and at least one of said silver halide emulsion layers except said blue-sensitive silver halide emulsion layer contains a magenta coupler represented by the general formula [I]:

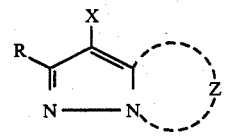

[I]

wherein, Z represents a group of non-metallic atoms necessary to form a nirogen-containing heterocyclic ring which may have a substituent, X represents a hydrogen atom, halogen atom or a monovalent group which is, upon a reaction with an oxydation product of a color developing agent, capable of being released from the coupler residue and R represents a hydrogen atom, a halogen atom or a monovalent group.

2. The silver halide photographic light-sensitive material of claim 1, wherein said magenta coupler is represented by the general formula [VIII]:

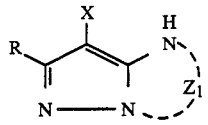

[VIII]

whrein, $Z_1$, X, R represent the same atoms or groups represented by Z, X, R of the formula [I] respectively.

3. The silver halide photographic light-sensitive material of claim 2, wherein said magenta coupler is represented by the general formula [II]:

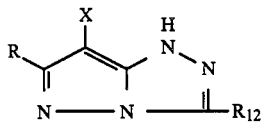

[II]

wherein, R represents the same atom or group represented by in formula [I], X is the same atom or group as in formula [I], and $R_{12}$ represents a monovalent group.

4. The silver halide photographic light-sensitive material of claim 1, wherein said R represents a hydrogen atom, a halogen atom or a monovalent group selected from the group consisting of an alkyl group, a cycloalkyl group, an alkenyl group, a cycloalkenyl group, an alkynyl group, an aryl group, a heterocyclic group, an acyl group, a sulfonyl group, a sulfinyl group, a carbamoyl group, a sulfamoyl group, a cyano group, a residue of spyro compounds, a residue of bridged hydrocarbons, an alkoxy group, an aryloxy group, an heterocycloxy group, a siloxy group, an acyloxy group, a carbamoyloxy group, an amino group, an acylamino group, a sulfonamido group, an imido group, an ureido group, a sulfamoylamino group, an alkoxycarbonylamino group, an aryloxycarbonylamino group, an alkoxycarbonyl group, an aryloxycarbonyl group, an alylthio group arylthio group, and a heterocyclicthio group.

5. The silver halide photographic light-sensitive material of claim 4 wherein said R is represented by the general formula [IX]:

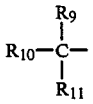

[IX]

wherein, said $R_9$, $R_{10}$ and $R_{11}$ independently represent a hydrogen atom, a halogen atom or a group selected from the group consisting of an alkyl group, a cycloalkyl group, an alkenyl group, a cycloalkenyl group, an alkynyl group, an aryl group, a heterocyclic group, an acyl group, a sulfonyl group, a sulfinyl group, a carbamoyl group, a sulfamoyl group, a cyano group, a residue of spyro compounds, a residue of bridged hydrocarbons, an alkoxy group, an aryloxy group, an heterocycloxy group, a siloxy group, an acyloxy group, a carbamoyloxy group, an amino group, an acylamino group, a sulfonamido group, an imido group, an ureido group, a sulfamoylamino group, an alkoxycarbonylamino group, an aryloxycarbonylamino group, an alkoxycarbonyl group, an aryloxycarbonyl group, an alkylthio group, arylthio group, and a heterocyclic thio group provided that at least two of $R_9$, $R_{10}$ and $R_{11}$ are other than hydrogen, and two of $R_9$, $R_{10}$, and $R_{11}$ may couple to each other to form a saturated or unsaturated ring.

6. The silver halide photographic light-sensitive material of claim 5, wherein at least two of said $R_9$, $R_{10}$ and $R_{11}$ are inependently selected from alkyl groups.

7. The silver halide photographic light-sensitive material of claim 5 wherein wo of said $R_9$, $R_{10}$ and $R_{11}$ are a saturated or unsaturated ring selected from a cycloalkane ring, a cycloalkene ring, or a heterocyclic ring.

8. The silver halide photographic light-sensitive material of claim 7 wherein one of said $R_9$, $R_{10}$ and $R_{11}$ is a hydrogen atom and the other two are a cycloalkyl ring with carbon atom combined with said two groups to form a crosslinked hydrocarbon.

9. The silver halide photographic light-sensitive material of claim 3, wherein $R_{12}$ is represented by the general formula [X]:

$$R_{21}—SO_2—R_{22} \quad [X]$$

wherein, $R_{21}$ represents an alkylene group, and $R_{22}$ represents an alkyl group, a cycloalkyl group or an aryl group.

10. The silver halide photographic light-sensitie material of claim 3, wherein said magenta coupler is represented by the general formula [XI]:

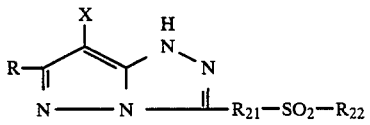

[XI]

wherein, R and X are the same as in general formula [I], and $R'_{21}$ and $R'_{22}$ are the same in general formula [X].

11. The silver halide photographic light-sensitive material of claim 1, wherein said blue-sensitive silver halide grains are optically sensitized with a sensitizing dye represented by the general formula [A]:

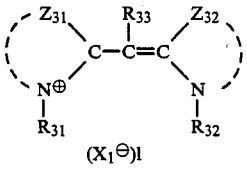

[A]

wherein, $Z_{31}$ and $Z_{32}$ independently represent an group of atoms necessary to form a heterocyclic ring selected from the group consisting of a benzoxazol ring, naphthoxazol ring, benzothiazol ring, naphthothiazol ring, benzoselenazole ring, naphthoselenazol ring, benzoimidazol ring, naphthoimidazol ring, pyridin ring and quinolin ring said rings may have substituents, $R_{31}$ and $R_{32}$ independently represent an alkyl group, an alkenyl group or an aryl group, $R_{33}$ represents a hydrogen atom, a methyl group or an ethyl group, $X^{\ominus}$ represents an anion and l represents 0 and 1.

12. The silver halide photographic light-sensitive material of claim 1, wherein said blue-sensitive silver halide grains are optically sensitized with a sensitizing dye represented by the general formula [B]:

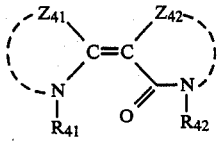

[B]

wherein, $Z_{41}$ represents a group of atoms necessry to form a heterocyclic ring selected from the group consisting of a benzoxazol ring, naphthoxazol ring, benzothiazol ring, naphthothiazol ring, benzoselenazole ring, naphthoselenazol ring, benzoimidazol ring and naphthoimidazol ring, these rings may have substituent, $Z_{42}$ represents a group of atoms necessary to form a rohdanin ring, 2-thiohidantin ring or 2-thioselenazolin-2,4-dion ring, and $R_{41}$, and $R_{42}$ independently represent an alkyl group, an alkenyl group or an aryl group, which may be substituted.

13. The silver halide photographic light-sensitive material of claim 1, wherein said silver halide grains essentially consist of silver chlorobromide.

14. The silver halide photographic light-sensitive material of claim 1, wherein said magenta coupler is contained in said green-sensitive silver halide emulsion layer.

15. The silver halide photographic light-sensitive material of claim 2, wherein said R represents a hydrogen atom, a halogen atom or a monovalent group selected from the group consisting of an alkyl group, a cycloalkyl group, an alkenyl group, a cycloalkenyl group, an alkynyl group, an aryl group, a hetercyclic group, an acyl group, a sulfonyl group, a sulfinyl group, a carbamoyl group, a sulfamoyl group, a cyano group, a residue of spyro compounds, a residue of bridged hydrocarbons, an alkoxy group, and aryloxy group, an heterocycloxy group, a siloxy group, an acyloxy group, a carbamoyloxy group, an amino group, an acylamino group, a sulfonamido group, an imido group, an ureido group, a sulfamoyamino group, an alkoxycarbonylamino group, an aryloxycarbonylamino group, an alkoxycarbonyl group, an aryloxycarbonyl group, an alkylthio group arylthio group, and a hetercyclicthio group.

16. The silver halide photographic light-sensitive material of claim 3, wherein said R represents a hydrogen atom, a halogen atom or a monovalent group selected from the group consisting of an alkyl group, a cycloalkyl group, an alkenyl group, a cycloalkenyl group, an alkynyl group, an aryl group, a heterocyclic group, an acyl group, a sulfonyl group, a sulfinyl group, a carbamoyl group, a sulfamoyl group, a cyano group, a residue of spyro compounds, a residue of bridged hydrocarbons, an alkoxy group, an aryloxy group, an heterocycloxy group, a cyloxy group, an acyloxy group, a carbamoyloxy group, an amino group, an acylamino group, a sulfonamido group, an imido group, an ureido group, a sulfamoylamino group, an alkoxycarbonylamino group, an aryloxycarbonylamino group, an alkoxycarbonyl group, an aryloxycarbonyl group, an alkylthio group arylthio group, and a hterocyclicthio group.

17. The silver halide photographic light-sensitive material of claim 15, wherein said R is represented by the general formula [IX]:

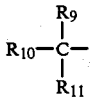

wherein, said $R_9$, $R_{10}$ and $R_{11}$ independently represent a hydrogen atom, a halogen atom or a group selected from the group consisting of a an alkyl group, a cycloalkyl group, an alkenyl group, a cycloalkenyl group, an alkynyl group, an aryl group, a heterocyclic group, an acyl group, a sulfonyl group, a sulfinyl group, a carbamoyl group, a sulfamoyl group, a cyano group, a residue of spyro compounds, a residue of bridged hydrocarbons, an alkoxy group, an aryloxy group, an heterocycloxy group, a siloxy group, an acyloxy group, a carbamoyloxy group, an amino group, an acylamino group, a sulfonamido group, an imido group, a ureido group, a sulfamoylamino group, an alkoxycarbonylamino group, an aryloxycarbonylamino group, an alkoxycarbonyl group, an aryloxycarbonyl group, an alkylthio group, an arylthio group, and a heterocyclicthio group provided that at least two of $R_9$, $R_{10}$ and $R_{11}$ are selected from atoms or groups other than hydrogen atoms.

18. The silver halide photographic light-sensitive material of claim 16, wherein said R is represented by the general formula [IX]:

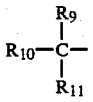

wherein, said $R_9$, $R_{10}$ and $R_{11}$ independently represent a hydrogen atom, a halogen atom or a group selected from the group consisting of a an alkyl group, a cycloalkyl group, an alkenyl group, a cycloalkenyl group, an alkynyl group, an aryl group, a heterocyclic group, an acyl group, a sulfonyl group, a sulfinyl group, a carbamoyl group, a sulfamoyl group, a cyano group, a residue of spyro compounds, a residue of bridged hydrocarbons, an alkoxy group, an aryloxy group, an heterocycloxy group, a siloxy group, an acyloxy group, a carbamoyloxy group, an amino group, an acylamino group, a sulfonamide group, an imido group, a ureido group, a sulfamoylamino group, an alkoxycarbonylamino group, an aryloxycarbonylamino group, an alkoxycarbonyl group, an aryloxycarbonyl group, an alkylthio group, an arylthio group, and a heterocyclicthio group provided that at least two of $R_9$, $R_{10}$ and $R_{11}$ are selected from atoms or groups other than hydrogen atoms.

* * * * *